US006015211A

United States Patent [19]

Kinoshita et al.

[11] Patent Number: 6,015,211

[45] Date of Patent: Jan. 18, 2000

[54] PORTABLE PRINTING DEVICE WITH SHUTTER FOR COVERING PRINT HEAD

[75] Inventors: Naohisa Kinoshita; Koji Imai, both of Nagoya, Japan

[73] Assignee: Brother Kogyo Kabushiki Kaisha, Nagoya, Japan

[21] Appl. No.: 08/879,633

[22] Filed: Jun. 20, 1997

[30] Foreign Application Priority Data

| | | | |
|---|---|---|---|
| Jun. 21, 1996 | [JP] | Japan | 8-181339 |
| Jun. 21, 1996 | [JP] | Japan | 8-181340 |
| Jul. 17, 1996 | [JP] | Japan | 8-207903 |
| Dec. 28, 1996 | [JP] | Japan | 8-358507 |

[51] Int. Cl.[7] ..... B41J 3/36

[52] U.S. Cl. ..... 347/109

[58] Field of Search ..... 347/29, 109, 30; 400/88, 175, 692, 693

[56] References Cited

U.S. PATENT DOCUMENTS

| | | | |
|---|---|---|---|
| 4,899,228 | 2/1990 | Sano et al. | 358/473 |
| 4,999,016 | 3/1991 | Suzuki et al. | 400/88 |
| 5,798,777 | 8/1998 | Yoshimura et al. | 347/44 |
| 5,883,648 | 3/1999 | Hetzer | 347/30 |

FOREIGN PATENT DOCUMENTS

| | | |
|---|---|---|
| 63-072261 | 4/1988 | Japan . |
| 63-274553 | 11/1988 | Japan . |
| 1-67052 | 4/1989 | Japan . |
| 2-43059 | 3/1990 | Japan . |

OTHER PUBLICATIONS

Abbott et al. Reliable Operation of Multinozzle Printhead in a Start/Stop Mode. IBM Technical Disclosure Bulletin vol. 25 No. 3a, p. 919, Aug. 1992.

*Primary Examiner*—N. Le
*Assistant Examiner*—Thien Tran
*Attorney, Agent, or Firm*—McGinn & Gibb, P.C.

[57] ABSTRACT

A portable printing device including: a case; a print unit having a print head with a print surface, the print head being switchable between a raised position and a lowered position with respect to the case; and a shutter member that covers the print surface of the print head when the print head is in its raised position. A link mechanism including crossed arms is provided for freely pivotably supporting the print unit with respect to the case.

34 Claims, 35 Drawing Sheets

PORTABLE PRINTING DEVICE WITH SHUTTER FOR COVERING PRINT HEAD

BACKGROUND OF THE INVENTION

1. Field of the Invention

The present invention relates to a portable printing device having a print head capable of printing characters and the like on a print medium, such as a paper sheet, by being scanned across the print medium.

2. Description of the Related Art

There have been known a variety of small portable printing devices having an outer case and a print head housed inside the case. The portable printing devices can be used to print characters and the like at a desired position on print media such as paper sheets. In order to print using such a device, a user scans the case of the portable printing device across the print medium at a desired speed in a printing direction. The portable printing device prints on the print medium using the print head based on an amount of movement of the portable printing device.

For example, there are a number of handy portable printing devices which use a thermal head as the print head. Thermal print devices are convenient because as long as an ink ribbon is provided, printing can be easily performed by manually scanning the case over the printing medium. However, thermal heads rely on transfer of heat to print images so that the thermal head must be extremely close to the printing medium, that is, separated from the print medium only by the ink ribbon, in order to head. Therefore, the thermal print head must be exposed from the outer casing in order to print.

Because the devices are small and compact, the user can easily move them from place to place. However, if the thermal print head is exposed from the case of the portable printing device, the thermal print head can be easily damaged when bumped into other objects. A variety of configurations have been proposed for protecting the thermal head of a thermal type portable printing device when the thermal portable printing device is not being used.

For example, Japanese Laid-Open Patent Publication No. SHO-63-72261 describes a thermal portable printing device including: a fixed link member pivotably fixed at one end to a case; a sliding link member fixed at one end to the free end of the fixed link and at the other end to a print head; and a single rod connected to the linked portion of the link members. A spring urges the linked members to pivot at their linked portion so that the thermal print head is drawn into the case. By pressing the rod against the urging of the spring, the link members straighten out with respect to each other so that the thermal print head is pushed out of the case. By again operating the rod, the print head can be retracted back into the outer case.

Japanese Laid-Open Utility Model Publication No. HEI-1-67052 describes a thermal portable printing device having a swingable frame bolted onto an activation switch. A thermal head is attached to a support frame. A linking mechanism links the swingable frame and the support frame together so that when the activation switch is pushed inward into a non-printing position, the linking mechanism moves the thermal head into a housed position within the outer case and so that when the activation switch is pulled out into a printing position, the linking mechanism lowers the thermal head into a printing position. In this way, the thermal head can be switched between the housed position and the printing position.

Further, Japanese Laid-Open Utility Model Publication No. HEI-2-43059 describes a manual scanning type copy device wherein a printing mechanism including a thermal head is fixed internally in a case near the open lower end portion of the case. A movable member is fitted in the open lower end tip of the case. The movable member can move from a lowered position, wherein its lower end protrudes from the lower end of the case, to a raised position, wherein its lower end is flush with the lower end of the case. The movable member is formed with a hole at a position confronting the thermal head. A lid mechanism is provided for opening and closing the hole in association with raising and lowering movements of the movable member.

With the configuration of Japanese Laid-Open Utility Model Publication No. HEI-2-43059, during non-printing times, that is, when the lower tip portion of the movement member is not placed against a print medium and so protrudes below the lower tip of the case, then the lid closes so that the printing mechanism is housed within the movement member. On the other hand, when the case is pressed against the print medium in order to print characters and the like, the movable member is pushed into the case and, in association with this, the lid slides to the side to open the opening portion so that printing can be performed using the printing mechanism.

There are also a number of handy portable printing devices which use an ink jet head as the print head.

However, ink jet print heads are different from thermal heads, so that ink jet print heads have particular requirements different from those of thermal heads. For example, jet print heads eject ink droplets through tiny nozzles to print images. When ink clinging to the print head surface dries out while the print head is not being used, the dried ink can clog the ink ejection nozzles and interfere with proper ejection of ink droplets.

Stationary ink jet printers, which are normally used in a permanent position on a table or desk top, are provided with a purge mechanism for sucking dried ink from the nozzles to return the ink jet head to a proper printing condition.

Stationary ink jet printers are also provided with a capping mechanism for capping the ink jet print head during non-printing times. The capping mechanism is located at a side position, which is outside the printing region of a carriage on which the ink jet print head is mounted. During non-printing times, the carriage is moved to the position of the capping mechanism and a cap member of the cap mechanism is brought into intimate sealing contact with the head surface of the print head, thereby preventing ink on the head surface drying out.

Japanese Laid-Open Patent Application Publication No. SHO-63-274553 describes a recording device having a case formed with a hole for exposing an ink ejection portion of an ink jet print head. A slidable head cap is provided to slide between the case and the ink jet head in order to prevent ink of the head from drying during non-printing periods, thereby preventing defective ejection of ink.

SUMMARY OF THE INVENTION

It is conceivable to provide an ink jet portable printing device with a purge unit. However, a purge unit would take us a great deal of space, thereby increasing the size of the portable printing device. A separate purge unit could conceivably be provided for purging the nozzles each time before the portable printing device is used. However, this would require that the user always have the separate purge mechanism nearby in case he or she wanted to print something. Also, purge operates consume a good deal of ink and also delay the start of printing. The user would also have to manually connect and disconnect the purge mechanism to and from the ink jet print head before and after each purging operation, thereby complicating operations of the portable printing device.

Another requirement of ink jet print devices is that only a small gap from 1 to 2 mm can be opened between the print head and a print medium on which images are to be printed. For this reason, the head cap described in Japanese Laid-Open Patent Application Publication No. SHO-63-274553 for capping the print head must be made thinner than the gap between the head and the medium. However, few materials, when formed as thin as is required to fit within the gap, are strong enough to sufficiently protect the print head from shock such as when the print device is dropped during non-printing periods. If the capping member is accidentally brought into contact with the print head by such shocks during non-printing times, the print head can be damaged or areas around the device can be stained with ink. Because the gap is so narrow, it is difficult to design a mechanism for sliding the cap into the gap so that the type of design is limited. Also, a separate mechanism must be provided for attaching and removing the cap member, which increases the size of the print device.

Although the handy type portable printing devices described in Japanese Laid-Open Patent Publication No. SHO63-72261, Japanese Laid-Open Utility Model Publication No. HEI-1-67052, and Japanese Laid-Open Utility Model Publication No. HEI-2-43059 all use a thermal head as the print head, it is conceivable to use an ink jet type print head such as described in Japanese Laid-Open Patent Application Publication No. SHO-63-274553 so that printing can be performed on print media other than paper such as cloth and the like. However, if the portable thermal print devices of the above-described publications were provided with ink jet print heads, some kind of capping mechanism would need to be provided for preventing ink clinging to the head surface of the print head from drying out. Because portable printing device have no carriages, there is no side position where a capping mechanism can be provided as in stationary ink jet printers.

It is conceivable to provide a cap member that a user manually attaches to the bottom of the case during non-printing times and detaches in order to print. Although, no capping mechanism would be needed with such a configuration, the user would have to remove the cap before each use and then reattach it after each use, which are troublesome operations. With such a configuration, attachment and removal of the cap member would be troublesome.

Further, a mechanism could be provided for removing and attaching the cap member. However, such a mechanism in addition to a switching mechanism for switching the position of the print head would complicate and increase the cost of operations for assembling these mechanisms. Also, the portable printing devices would have to be made in a larger size.

Further, were an activation switch for switching the print head from a housed position to a printing position provided in the manner described in Japanese Laid-Open Patent Application No. HEI-1-67052, then after printing is completed, the user would have to operate the activation switch to move the print head from its printing position to its housed position.

It is conceivable to provide a portable printing device with a spring-activated mechanism for moving the print head between a printing position and a housed position. An example of housed position could be within the case of the portable printing device. However, the spring-activated mechanism could be accidentally activated, whereupon the head would pop out of the case and be exposed to damage by collision with surrounding objects. Also, providing the spring or other such mechanism restricts attempts to reduce the size of portable printing device.

It is an objective of the present invention to overcome the above-described problems and to provide a portable printing device including a shutter mechanism for protecting the print head during non-printing periods, wherein the shutter member has sufficient strength to protect the print head and wherein the mechanism for moving the shutter member can be freely designed and easily positioned.

It is another objective of the present invention to provide a portable printing device with a mechanism capable of simply switching the print head between a non-printing position and a printing position and which can simply and reliably prevent ink clinging to the head surface from drying out by using a cap member.

It is another objective of the present invention to provide a portable printing device having a retractable print head and a capping mechanism for capping the print head when the print head is housed within the case during non-printing times.

It is a still further objective of the present invention to provide a portable printing device with a compact size even when the device is not being used to print and wherein the print head will not be exposed by erroneous operations during non-printing times.

It is another objective of the present invention to provide portable printing device with a mechanism for maintaining the print head in a stable posture with the printing medium regardless of the posture of the case.

In order to achieve the above-described objectives, a portable printing device according to the present invention include: a case; a print unit having a print head with a print surface, the print head being switchable between a raised position and a lowered position with respect to the case; and a shutter member that covers the print surface of the print head when the print head is in its raised position.

With this configuration, the print head is raised upward into the case of the portable printing device during non-printing periods so that a large gap is opened between the print head and the print medium. Therefore, the shutter can be made from a thicker member than in the conventional slide type print head described in Japanese Laid-Open Patent Application Publication No. SHO-63-274553. For this reason, the shutter can be easily made stronger so that the print head can be better protected from damage. Because the large gap is opened between the print head and the print medium, the mechanism for moving the shutter can be more freely positioned within the portable printing device.

According to another aspect of the present invention, the shutter for protecting the print head is opened and closed in association with raising and lowering movement of the print head. With this configuration, no separate drive unit needs to be provided for specifically opening and shutting the shutter so that the configuration can be simplified and produced at a lower cost.

According to another aspect of the present invention, a print medium detection switch is provided so that, while the print head is disposed at its uppermost position during non-printing periods, the print medium detection switch detects that the print medium is at a position in confrontation with the print head, then the print head is lowered into a position where printing is possible. On the other hand, when the print medium detection switch detects that no print medium exists in confrontation with the print head, then the print head is raised upward and covered and protected by the shutter. With this configuration, the print head will be lowered into a printable position only when the print medium is in confrontation with the print head. This ensures that the print head will be sufficiently protected.

According to another aspect of the present invention, a position detection switch is provided for detecting whether or not the print head is lowered into a printable position. When the position detection switch detects that the print head is in the printable position, then the drive of the motor for lowering the print head is stopped. With this configuration, the user need not perform troublesome operations to accurately position the print head in its printable position because this will be automatically performed by the portable printing device itself.

According to another aspect of the present invention, the print head is an ink jet type print head so that configuration of the print head is simpler than were a wire dot type print head, which requires ink ribbon, used. As a result, the overall size of the portable printing device can be made smaller.

According to another aspect of the present invention the case has an open portion and a housing portion provided interior to the open portion; and the print head is in a housed position housed within the housing portion of the case when in its raised position and is in a printing position where it is capable of performing print operations through the open portion of the case when in its lowered position. Also the portable printing device further includes a head position switching mechanism that switches the print head between its housed position and its printing position.

In this case, the shutter member can be provided with a cap member brought into sealing contact with the print surface of the print head when the head position switching mechanism switches the print head into its housed position. With this configuration, during non-printing times, the position switching mechanism switches the print head of the printer unit into a housed position, wherein the print head is housed within the housing portion provided to the interior of the case. At this time, the capping member is brought into sealing contact with the head surface of the print head.

Therefore, attaching the cap member is simple and the ink on the head surface can be reliably prevented from drying out. Further, the cap member protects the print head from damage while the portable printing device is carried around. On the other hand, when the print head is switched into its printing position, the cap member is retracted away from the head surface so that printing can be performed on a print medium using the print head.

According to another aspect of the present invention, the cap member is movably supported on the case movable between a capping position in sealing contact with the print head and a retracted position retracted away to the side of the print head. When the position switching mechanism moves the print head to the printing position, the cap member is moved into its retracted position in association with movement of the print head into the printing position. Therefore, printing can be performed using the print head. Also, the cap member wipes away unnecessary print material, such as ink, clinging to the surface of the head when it starts moving into its retracted position. In this case, when the print material is ink, ejection of ink during printing is improved so that clear printing can be obtained. According to another aspect of the present invention, an urging member is provided for urging the cap member into the capping position. Therefore, when the print head is moved from its printing position to its housed position, the urging member moves the cap member into its capping position so that the head surface is automatically capped during non-printing times and the ink on the head surface is properly prevented from drying out.

According to another aspect of the present invention, the print head is fixed to a slide plate so that when the slide plate is raised into its uppermost position, the print head is moved into its housed position. At this time, a first engagement portion provided to the slide plate and a protrusion portion provided to the case engage with each other so that the slide plate is supported in its uppermost raised position, and the print head is supported in its housed position. On the other hand, when the slide plate is lowered into its lowermost position, the print head is move into its printing position. At this time a second engagement portion provided to the slide plate engages with the protrusion portion, so that the slide plate is supported in its lowermost, and the print head is supported in its printing position.

According to another aspect of the present invention, an urging means is provided so that at the end of printing processes, when the slide plate is pressed to release engagement between the second engagement portion of the slide plate and the engagement protrusion portion, the urging means urges the slide plate upward to its uppermost position so that the print head can be easily moved into the housing portion of the case.

According to another aspect of the present invention, a movable frame connected to the print head is provided to the lower portion of the case so as to be movable in the vertical direction between an uppermost position, wherein the movable frame is entirely housed within the case, and a lowermost position, wherein the movable frame slightly protrudes from the case. When the movable frame is moved into its lowermost position, a switching mechanism switches the print head into its housed position in association with downward movement of the movable frame. At this time, the capping member is in sealed contact with the head surface of the print head. With this configuration, capping the print head can be simply performed and ink of the head can be reliably prevented from drying out. On the other hand, when the movable frame is moved into its uppermost position, the switching mechanism switches the print head into its printing position in association with upward movement of the movable frame. At this time, the cap member is in a retracted position out of the way of the print head so that printing can be performed on the desired medium.

According to another aspect of the present invention, the cam member is supported on the case so as to be movable between a capping position, wherein it is sealing contact with the print head, and a retracted position, wherein it is retracted to the side of the print head. When the switching mechanism moves the print head into its printing position, in association with this the cap member will be moved into its retracted position. Therefore, printing can be easily performed on a desired medium without the user having to remove the cap member. Further, the cap member wipes off the surface of the print head when the cap member starts moving into its retracted position. Therefore, when ink is used to record images, then ink clinging to the surface of the print head will be wiped off the print head, so that ink can be properly ejected from the print head.

According to another aspect of the present invention, an urging means is provided for urging the cap member into its capping position. With this configuration, when the print head is moved from its printing position into its housed position, the cap member is moved by urging force of the urging means into its capping position. Therefore, the cap member will automatically cover the print head during non-printing periods so that ink of the print head can be prevented from drying out.

According to another aspect of the present invention, the switching mechanism includes a freely rotatable pinion in meshing engagement from one side with a drive rack provided to the movable frame and from the opposite side with a follower rack provided to a movable plate to which the print head is fixed.

With this configuration, when the case is pressed downward while the movable frame is in abutment with the surface of the print medium so that the movable frame rises upward into its uppermost position in the case, then the pinion is rotated by the drive rack moving upward with the movable frame. The rotation of the pinion will move the follower rack downward, so that the print head is moved into its printing position. On the other hand, when the case is lifted upward so that the movable frame moves downward into its lowermost position where it protrudes from the bottom of the case, the pinion is rotated by the drive rack moving downward with the movable frame. The rotation of the pinion will move the follower rack upward, so that the print head is moved into its housed position. The switching mechanism can be made with a simple configuration capable of easily and quickly switching the print head between its printing position and its housed position merely by manually moving the movable frame vertically with respect to the case.

According to another aspect of the present invention, an urging means is provided for resiliently urging the movable frame into its lowermost position. With this configuration, a user needs to merely overcome the urging force of the urging means, that is, by pressing the case downward, to move the print head into its printing position. When printing is completed, the user need only release the downward pressure from the case to enable the movable frame to move downward with the urging force of the urging means so that the print head can be easily moved into its housed position.

According to another aspect of the present invention, the head position switching mechanism includes: a link mechanism freely swingably supporting the print unit with respect to the case; and a pair of shafts provided to the link mechanism and movable in a separation direction, wherein the shafts separate from each other, the print unit moving from the printing position to the housed position by movement of the shafts in the separation direction.

With this configuration, separation movement of the shaft portions of the link mechanism moves the print unit from its non-housed condition to its housed condition with respect to the case of the device. Therefore, the device has a more compact size when the head unit is housed within the case. When the head unit is covered using an openable and closable shutter mechanism by a switch mechanism such as a spring, when the switch mechanism is erroneously triggered, then the shutter will open and the head unit will be exposed from the case. However, according to the present invention, the head unit can be prevented from being exposed by such erroneous operations so that the print head can be more reliably protected.

When a crossed link mechanism is disposed between the case and the print unit near confronting sides of the case and the head unit, even if the case is tilted during scanning printing, only the case will tilt and the head unit will be maintained in a proper posture with respect to the printing medium so that stable printing can be performed.

According to another aspect of the present invention, a pair of pivotable arms are supported on the sides of the case. The shafts of the link mechanism, are freely rotatably supported on the tips of the pivot arms. Therefore, the shaft portions of the link mechanism move in association with pivoting movement of the pivot arms. As a result, the print head, which is connected to the link mechanism can be reliably moved into and out of its housed condition in the case in association with movement of the pivot arms.

According to another aspect of the present invention, the shafts of the pair of pivot arms are connected to meshingly engaged gears. One of the gears is rotatably drivable. Therefore, by rotating the drivable gear, both of the pivot arms can be rotated in lateral symmetry with each other. Accordingly, the shaft portion of the link mechanism can be moved simultaneously with this lateral symmetric movement of the pivot arms.

According to another aspect of the present invention, a rack provided to a cap member and a gear disposed on one of the pivot arms are meshingly engaged with each other so that when the cap member is slidingly moved, the pair of pivot arms pivot in association with the sliding movement. As a result, the print unit can be moved from its printing position into its housed position with respect to the case by sliding the cap member. With this configuration, no power source or driving means such as a motor is required to move the print unit into its housed and non-housed conditions with respect to the case. Therefore, operations for protecting the print unit by the cap member and operations for moving the print unit between its housed and non-housed conditions can be simply manually performed in a linked manner.

When an ink jet type print unit is used for the print unit, then the overall configuration of the portable printing device can be simplified and formed in a small compact shape and printing can be performed more clearly than with a wire dot method receding unit using ink ribbon.

A portable printing device according to still another aspect of the present invention includes: a case having an open portion and a housing portion provided interior to the open portion; a print unit having a print head for printing on the print medium; and a link mechanism having at least two crossed arms for supporting the print unit movable between a housed position, wherein the print head is housed within the housing portion of the case, and a printing position, wherein the print head is capable of performing print operations through the open portion of the case.

A portable printing device according to still another aspect of the present invention includes: a case; a print unit having a print head for printing on the print medium; and a link mechanism freely pivotably supporting the print unit with respect to the case.

BRIEF DESCRIPTION OF THE DRAWINGS

The above and other objects, features and advantages of the invention will become more apparent from reading the following description of the preferred embodiment taken in connection with the accompanying drawings in which:

FIG. 23 (*b*) is a bottom view of the portable printing device shown in FIG. 23 (*a*);

FIG. 24 (*b*) is a bottom view showing the portable printing device of FIG. 24 (*a*);

FIG. 28 (*b*) is a perspective view schematically showing a first and second link mechanisms according to the fourth embodiment for connecting the head unit to a case of the portable printing device;

FIG. 28 (*c*) is a side view of the link mechanisms shown in FIG. 28 (*b*);

FIG. 34 (*b*) is a cross-sectional view showing portable printing device when the head unit is in a housed position;

FIG. 37 (*b*) is a front view showing essential portions of the mechanism shown in FIG. 37 (*a*);

FIG. 37 (*c*) is a side view showing essential portions of the mechanism shown in FIG. 37 (*a*) while the print head is capped in a housed position; and FIG. 37 (*d*) is a front view showing essential portions of the mechanism shown in FIGS. 37 (*c*).

DETAILED DESCRIPTION OF THE PREFERRED EMBODIMENTS

Figure 1:
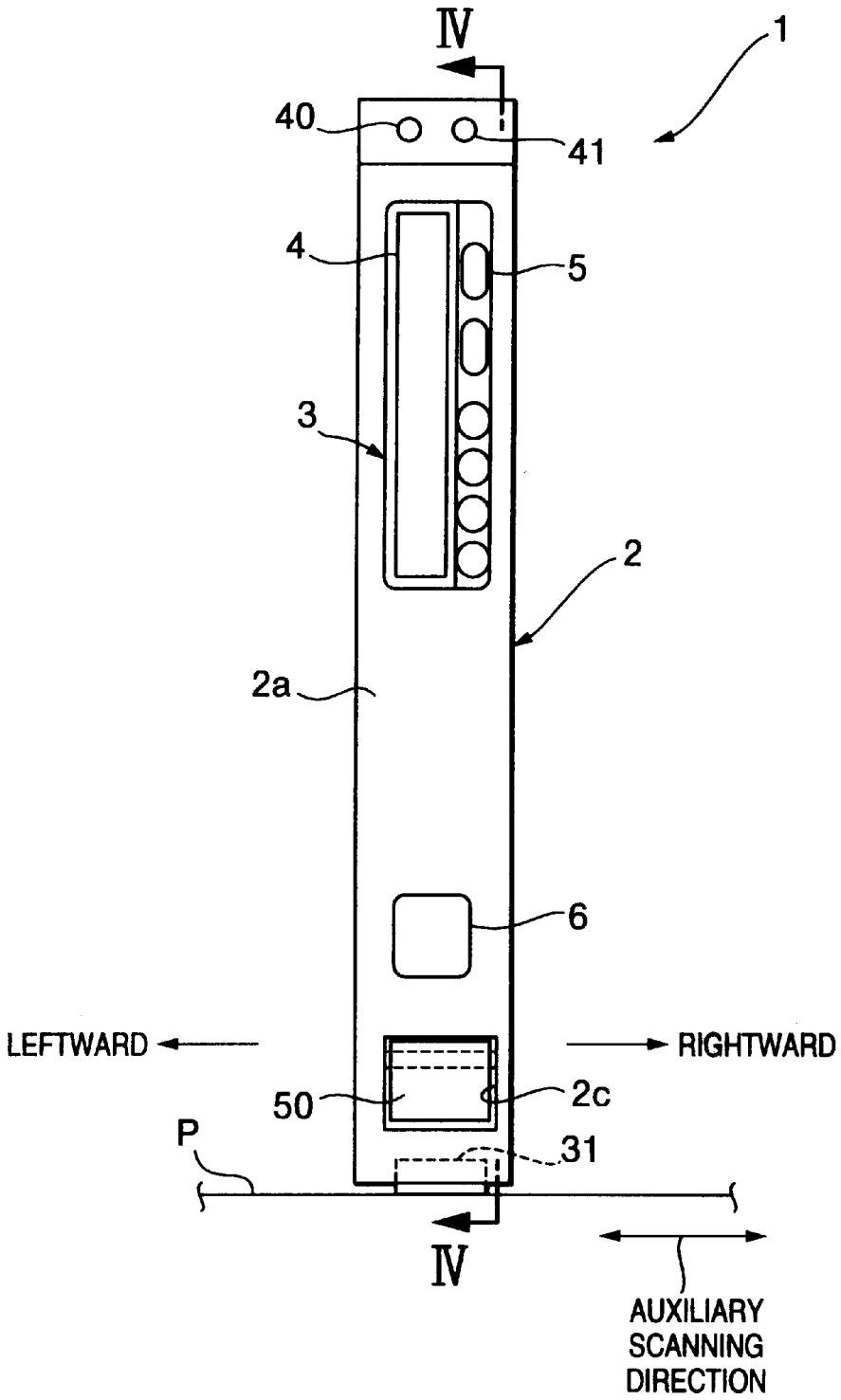
FIG. 1 is a front view showing a portable printing device according to a first embodiment of the present invention.

A portable printing device 1 according to a first embodiment of the present invention will be described while referring to the accompanying drawings wherein like parts and components are designated by the same reference numerals to avoid duplicating description. Directional terms, such as front, rear, right, left, up, and down, will be used in the following description assuming that the device is in an orientation in which it is intended to be used.

Figure 2:
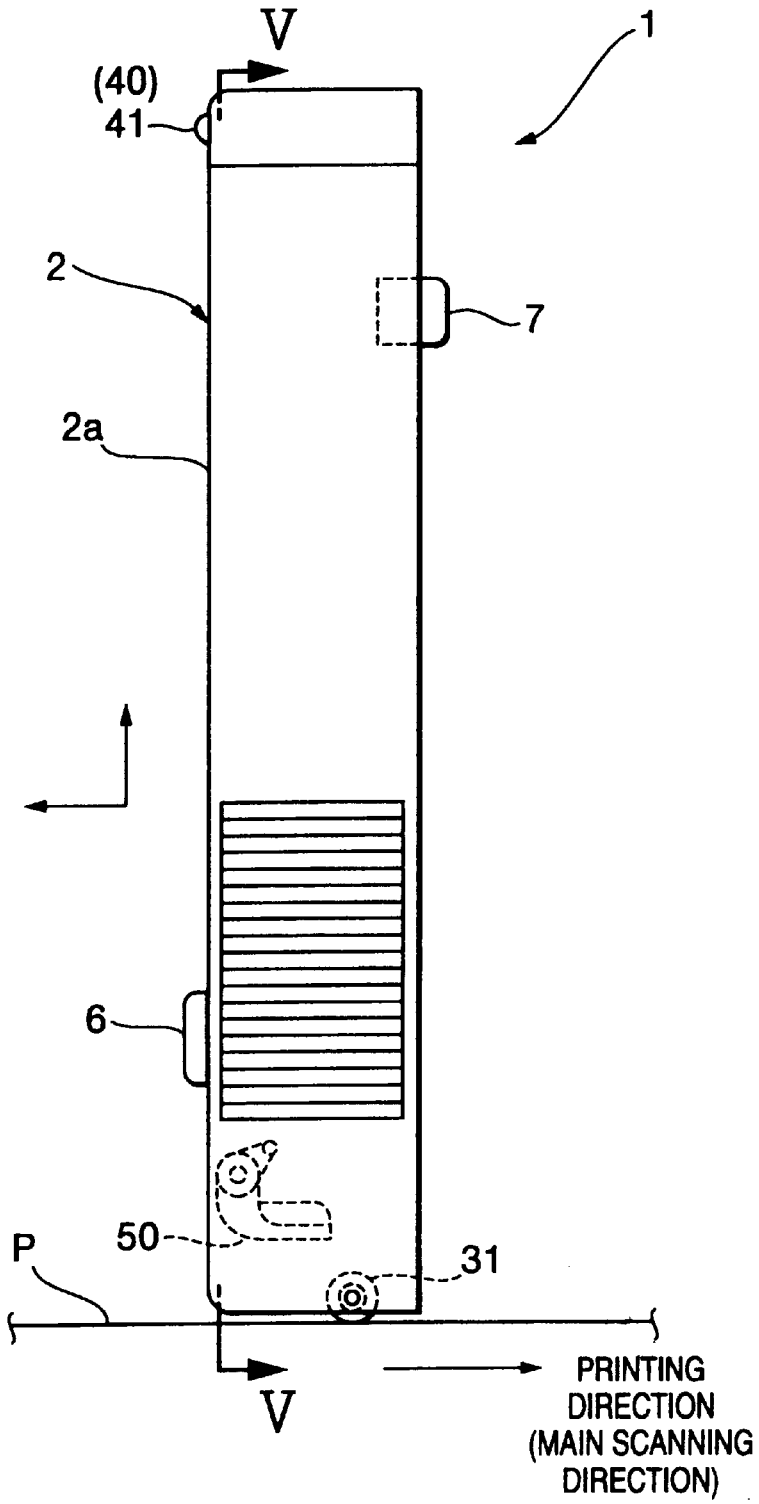
FIG. 2 is a side view showing the portable printing device of the first embodiment.
Figure 3:
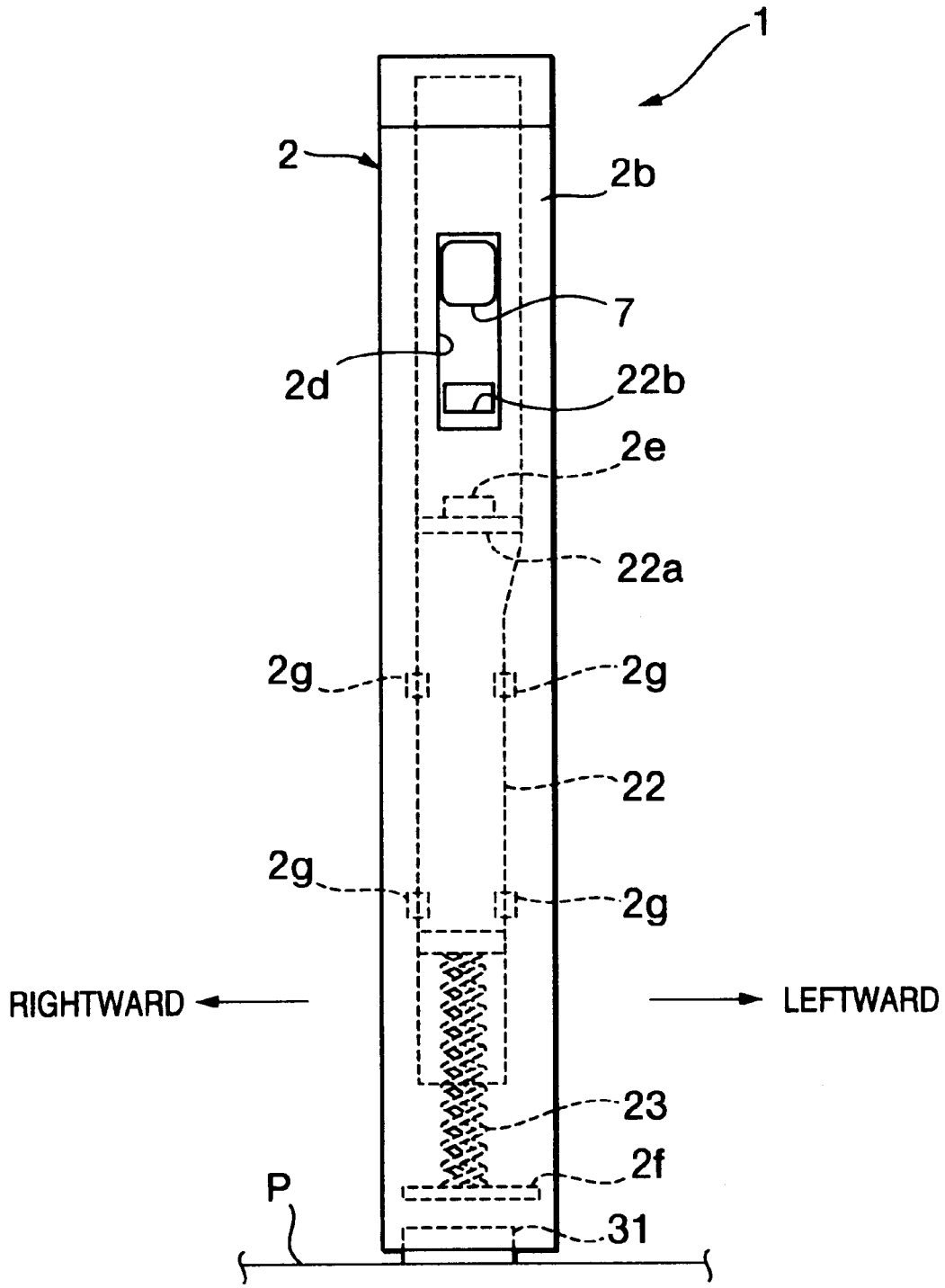
FIG. 3 is a back view showing the portable printing device of the first embodiment.

As shown in FIGS. 1 to 3, the portable printing device 1 of the first embodiment includes a case 2 formed from a synthetic resin into a hollow rectangular shape. The case 2 is formed with a rectangular opening at its lower end. As shown in FIG. 1, an operation panel 3 is provided at the upper half on a front wall portion 2*a* of the case 2. The operation panel 3 includes: a liquid crystal display 4 for displaying a variety of messages relating to printing operations and reception of print data; and a variety of switches such as a power source switch 5. A print start button 6 for starting printing operations is provided near the lower tip of the front wall portion 2*a*. An opening portion 2*c* for enabling pivoting movement of a cap member 50, to be described later, is formed below the print start button 6.

As shown in FIG. 2, infrared photo diodes 40, 41 for performing optical transmission using infrared light is provided to the upper end of the case 2. The infrared photo diode 40 is for receiving optical data transmitted by infrared light from an electronic device such as a personal computer (not shown in the drawings). The infrared emitting diode 41 is for transmitting to the electronic device, in the form of optical data, data relating to data transmission and data on print format such as character size and font.

As shown in FIG. 3, a rectangular cut-out portion 2*d* is formed near the upper end of a rear wall portion 2*b* of the case 2, which is opposite the front wall portion 2*a*. An operation button 7 is fitted in the cut-out portion 2*d* so as to be movable in the vertical direction. As will be described later, the operation button 7 is connected to a position switching mechanism 20, to be described later, for switching a print head 13 between a housed position and a printing position.

Figure 4:
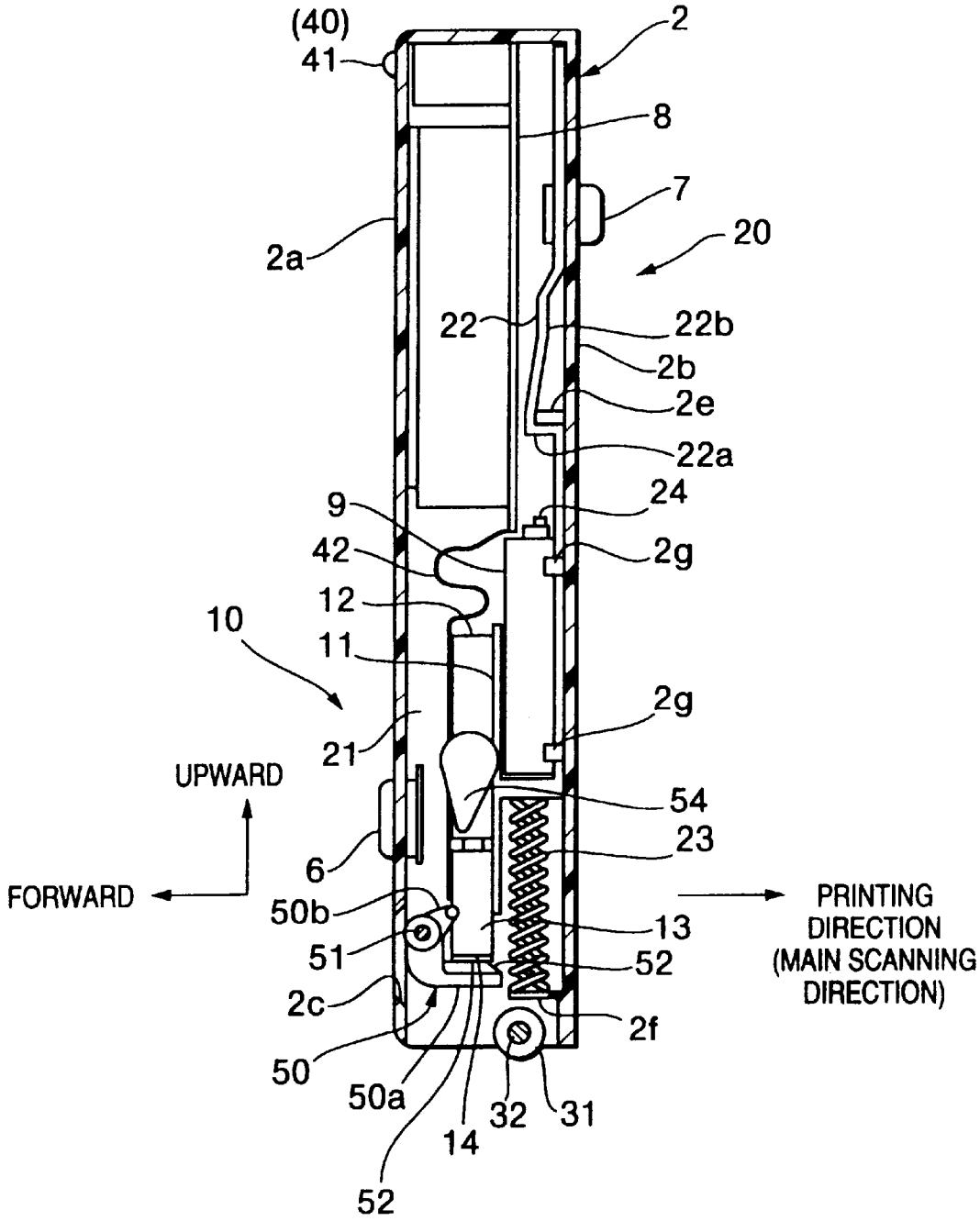
FIG. 4 is a cross-sectional view taken along line IV—IV of FIG. 1 showing the portable printing device of the first embodiment during a non-printing period.

As shown in FIG. 4, the case 2 houses various components, including: a printing mechanism 10 provided with the print head 13; a movement amount detection mechanism 30 having a rubber timing roller 31; and a control circuit board 8 provided with a control portion. A battery 9 serving as a power source is disposed to the side of the printing mechanism 10. The battery 9 is electrically connected to electrical components of the portable printing device 1. A printing condition detection switch 24 to be described later is attached to the upper tip of the battery 9. Because these components are housed in a compact case 2, characters and images can be printed on a print sheet P by manually moving the portable printing device 1 in a printing direction across the upper surface of the print sheet P.

Although not shown in the drawings, the print head 13 is formed with downward facing ejection nozzles. In the present embodiment, ejection nozzles are provided in two rows of 16 nozzles each, the rows extending in an auxiliary scanning direction, which extends perpendicular to the printing direction. An actuator is provided in each of the nozzles. A flexible wire cord 42 attached at one end to the side of the print head 13 connects each of the actuators in the nozzles of the print head 13 with the control circuit board 8.

The control portion of the control circuit board 8 controls drive of the printing mechanism 10 based on an encoder signal received from the movement amount detection mechanism 30. The control circuit board 8 uses the microprocessor to control transmission of optical data, including print data, by the infrared emitting diode 41 and to control reception of optical data from the infrared photo diode 40.

In addition to the control portion, the control circuit board 8 is provided with a microprocessor having a CPU, a ROM, and a RAM. The control circuit board 8 is also provided with a variety of circuits such as: a transmission circuit for performing optical transmission using the infrared photo diodes 40, 41 and a drive circuit for driving the print head 13 via the flexible wire cord 42. The control circuit board 8 executes print control for ejecting ink from the ejection nozzles in order to print based on the encoder signal received from the movement amount detection mechanism 30 and on print data transmitted as optical data.

Figure 5:
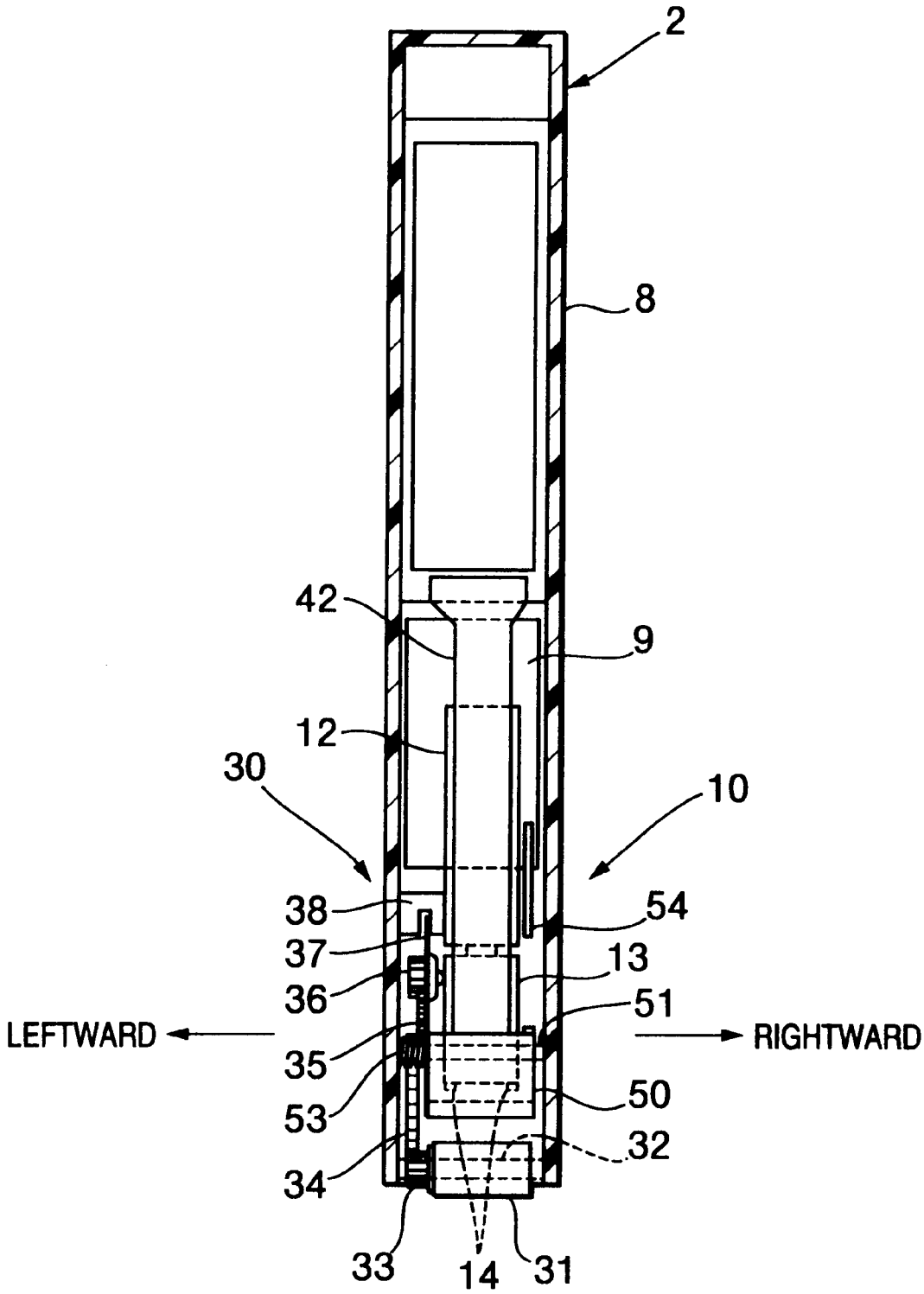
FIG. 5 is a cross-sectional view taken along line V—V of FIG. 2 showing the portable printing device of the first embodiment during the non-printing period.

Next, an explanation will be provided for the printing mechanism 10 while referring to FIGS. 4 and 5. A housing portion 21, into which the print head 13 can be housed, is provided to the lower half portion of the case 2. A vertically extending movable plate 11 is supported movable in the vertical direction in a guide groove, not shown in the drawings, formed near the lower end of the case 2. The movable plate 11 supports an ink tank 12 and the print head 13. The ink tank 12 is detachably mounted on the movable plate 11. Although not shown in the drawings, an ink absorbing material impregnated with ink or other print material is housed within the ink tank 12. The print head 13 is attached to the movable plate 11 so as to be in fluid connection with the ink tank 12. Ink in the ink tank 12 is supplied to each of the ejection nozzles in the print head 13.

Elongated protrusion portions 14 are formed at the left and right edge portions at the lower surface of the print head 13 so as to extend in a main scanning direction, that is, the printing direction. The elongated protrusion portions 14 serve as spacers for maintaining a distance between the nozzle plate of the print head 13 and the surface of the print sheet P. With this configuration, the nozzle plate is prevented from scraping against freshly ejected ink dots on the surface of the print sheet P so that the ink dots are not smudged.

Figure 6:
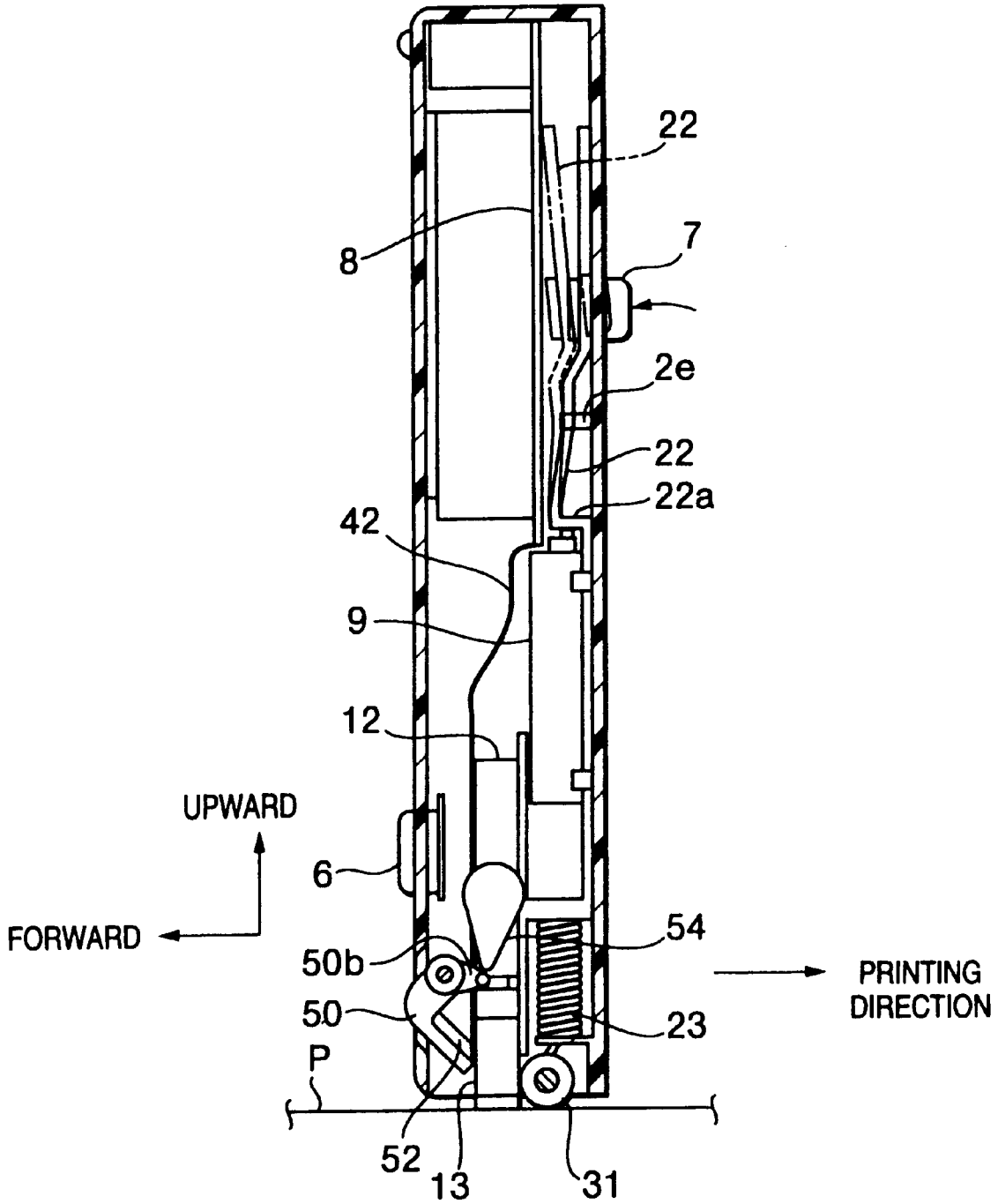
FIG. 6 is a cross-sectional view taken along line IV—IV of FIG. 1 showing the portable printing device of the first embodiment during a printing period.

Next, an explanation will be provided for the position switching mechanism 20 while referring chiefly to FIGS. 4 and 6. As mentioned above, the position switching mechanism 20 switches the print head 13 between its housed position housed within the case 2 and its printing position wherein the lower tip portion of the print head 13 protrudes slightly below the lower edge of the case 2 so that printing is possible. The position switching mechanism 20 includes: a vertically extending slide plate 22: a crank-shaped bent portion 22*a* formed near the vertical center of the slide plate 22; an engagement protrusion portion 2*e* for abuttingly engaging with the bent portion 22*a;* and a cut-out portion 22*b* capable of fittingly engaging with the engagement protrusion portion 2*e*.

The slide plate 22 is formed integrally at its lower end with the movable plate 11 and is fixed at its upper end to the operation button 8. A plurality of cut-out ribs 2*g* for supporting the slide plate 22 so as to be freely slidable in the vertical direction are formed on an interior central surface of the case 2.

The bent portion 22*a* is formed in the slide plate 22 below where the operation button 7 is fixedly provided. The engagement protrusion portion 2*e* for engaging with the bent portion 22*a* is formed integrally to the interior surface of the case 2. The cut-out portion 22*b* is formed in the slide plate 22 at a position directly above the bent portion 22*a*.

A spring bearing portion 2*f* is formed integrally with the lower tip portion of the case 2. A compression spring 23 is disposed between the spring bearing portion 2*f* and the lower tip of the slide plate 22. The compression spring 23 urges the slide plate 22, which is attached to the printing mechanism 10, resiliently upward so that as shown in FIG. 5, the slide plate 22 is normally supported in the uppermost position so that the bent portion 22*a* engages with the engagement protrusion portion 2*e*.

When a user wishes to print characters and images, he or she manually presses the operation button 7 downward so that the slide plate 22 is lowered from its uppermost position. In association with this, the movable plate 11, which is integrally formed with the slide plate 22, moves downward so that the print head 13 moves downward also. As shown in FIG. 6, the cut-out portion 22*b* engages with the engagement protrusion portion 2*e* so that the slide plate 22 is supported in its lowered position. At this time, the printing condition detection switch 24 is pressed down by the bent portion 22*a* so that power of the portable printing device 1 is turned on.

At the end of printing operations, the user presses the operation button 7 inward into the case 2 so that, as indicated by the two-dot chain line in FIG. 6, the upper half of the slide plate 22, that is, the portion of the slide plate 22 not supported by the cut-out ribs 2*g*, bends to the left as viewed in FIG. 6. As a result, engagement between the cut-out portion 22*b* and the engagement protrusion portion 2*e* is released so that urging force of the compression spring 23 raises the slide plate 22 up with a snap. The slide plate 22 stops at its uppermost position wherein the bent portion 22*a* abuttingly engages with the engagement protrusion portion 2*e*. Simultaneously with this, the print head 13 is moved with a snap into its housed position.

Figure 8:
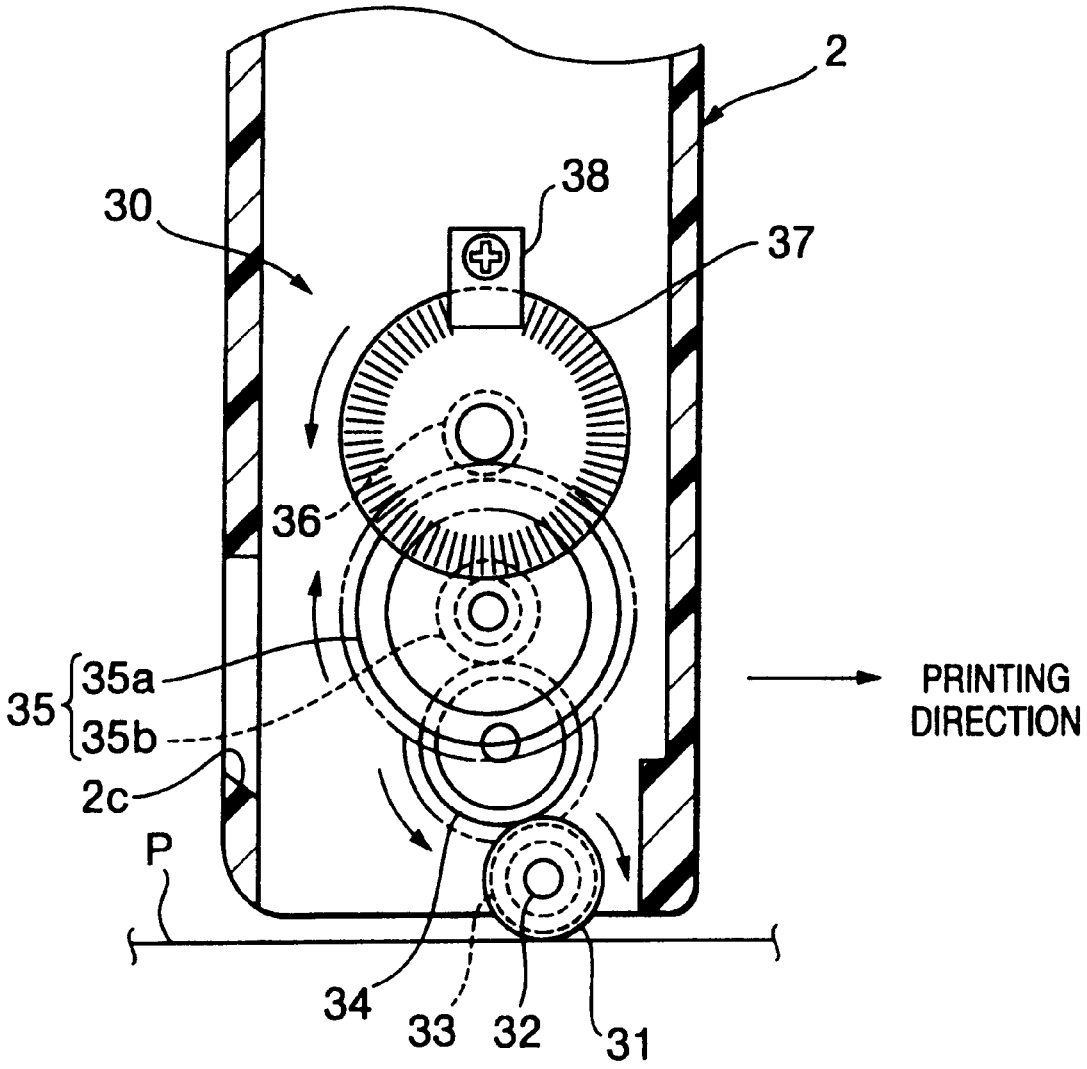
FIG. 8 is a cross-sectional view showing details of a movement detection mechanism of the portable printing device of the first embodiment.

Here, a brief explanation will be provided for the movement amount detection mechanism 30. As shown in FIGS. 5 and 8, the rubber timing roller 31 extends in the auxiliary scanning direction and is rotatably supported on a shaft 32 so that its lower edge protrudes below the lower edge of the case 2. A gear 33 is attached so as to rotate integrally with the timing roller 31 about the shaft 32. Rotational force of the gear 33 is transmitted to a gear 36 via a gear 34 and a two-step gear 35 (35*a*, 35*b*). A disk-shaped encoder plate 37 formed with a plurality of slits at its outer periphery is fixed to the gear 36. A photosensor 38 having a light emitting portion and a light receiving portion is disposed so as to sandwich the outer peripheral portion of the encoder plate 37.

As shown in FIGS. 1 and 2, when the case 2 is supported in a vertical orientation with respect to the print sheet P, the timing roller 31 contacts the upper surface of the print sheet P. When the user manually scans the case 2 in the printing direction, that is, the main scanning direction, while maintaining the case 2 in this vertical posture, the timing roller 31 and the gears 33 through 36 rotate in directions indicated by arrows in FIG. 8. When the encoder plate 37 rotates accordingly, the photosensor 38 outputs a pulse train, that is, an encoder signal. Based on the encoder signal and the print data, each time the case 2 is moved a predetermined distance, ink is selectively ejected from the plurality of ejection nozzles so that characters and images can be printed on the print sheet P regardless of the speed at which the portable printing device 2 is scanned.

Next, while referring to FIGS. 4 and 5, an explanation will be provided for the cap member 50 for protecting the head surface of the print head 13. The cap member 50 is supported on the case 2 by a shaft 51 at a position adjacent to the print head 13. As shown in FIG. 4, the cap member 50 is formed in a shape bent to an approximately 90 degree angle to form a cap portion 50*a* in confrontation with the print head surface of the print head 13. A block-shaped protective cap 52 made of rubber is fixed to the print head confronting surface of the cap portion 50*a*. As shown in FIG. 5, the cap member 50 is formed with a width dimension in the auxiliary scanning direction substantially the same as the width dimension of the print head 13.

The cap member 50 is pivotably supported on the case 2 by the shaft 51 so as to be pivotable between a capping position, shown in FIG. 4, wherein the protective cap 52 is in intimate contact with the head surface, and a retracted position, shown in FIG. 6, wherein the protective cap 52 is retracted to the side of the print head 13. A torsion spring 53 is mounted around the outer periphery of the shaft 51. As shown in FIG. 5, when the print head 13 is in its housed position, the protective cap 52 is urged by the torsion spring 53 into its capping position in intimate contact with the head surface of the print head 13.

An operation lever 50*b* is integrally fixed to the cap member 50. A teardrop-shaped cam 54 for switching position of the cap member 50 is attached with its tapered tip facing downward to the left edge of the slide plate 22 at a position near the lower edge of the ink tank 12. The tapered tip of the cam 54 is oriented so as to abut the operation lever 50*b* from above when the cam 54 moves downward.

With this configuration, when the slide plate 22 moves downward, the protective cap 52, which is in sealing contact with the head surface of the print head 13, will be pushed by downward movement of the print head 13 so that cap member 50 pivots in the clockwise direction as viewed in FIG. 4. At this point, the protective cap 52 will slide along the head surface of the print head 13. Further downward movement of the slide plate 22 brings the tapered tip of the cam 54 into abutment with the operation lever 50*b*. At this time, the tapered tip of the cam 54 abuts against and presses down the operation lever 50*b* so that the cap member 50 is forced to pivot into its retracted position, wherein it is separated from the side of print head 13. In other words, the cap member 50 is supported at its retracted position shown in FIG. 6 when the print head 13 is lowered into its printing position.

Next, an explanation will be provided for operations of the manually operated portable printing device 1. When the slide plate 22 is in its uppermost position shown in FIGS. 1 through 5, that is, when the portable printing device 1 is not being used for printing, then the print head 13 is in its housed position and the cap member 50 is in its capping position. When the operation button 7 is slid downward so that the print head 13 attached to the slide plate 22 is lowered from its housed position into its printing position, then the cut-out portion 22*b* engages with the engagement protrusion portion 2*e* so that the slide plate 22 is maintained in its lowermost position. At this point, the bent portion 22*a* abuts against the printing condition detection switch 24 so that the printing condition detection switch 24 is operated to turn on the power of the portable printing device 1.

Figure 7:
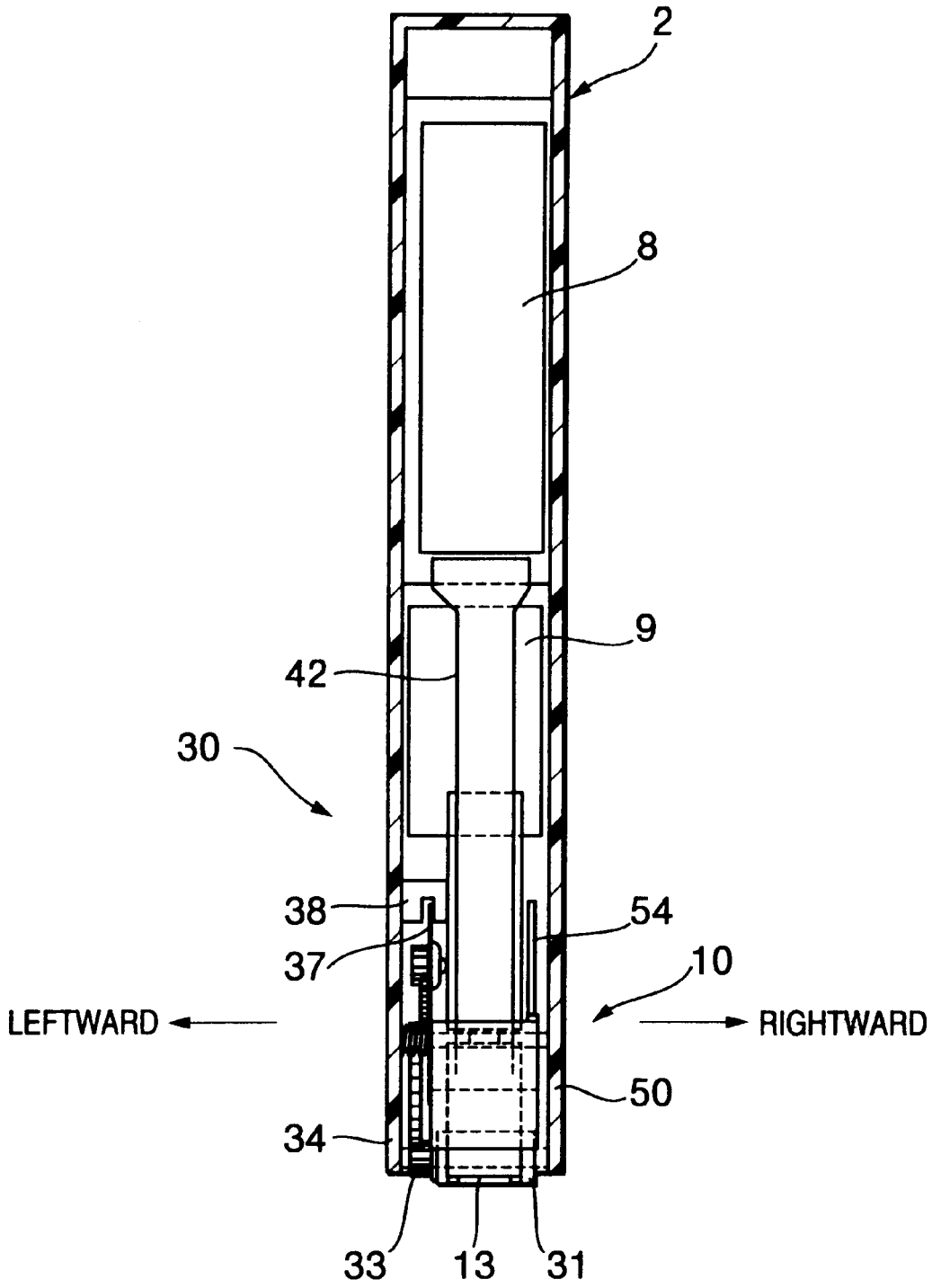
FIG. 7 is a cross-sectional view taken along line V—V of FIG. 2 showing the portable printing device of the first embodiment during the printing period.

In association with this downward movement of the slide plate 22, as shown in FIGS. 6 and 7, the cap member 50 in intimate contact with the print head 13 pivots in the clockwise direction as viewed in FIG. 6. At the start of the pivoting movement, the protective cap 52 slides along the head surface of the print head 13, thereby wiping away ink clinging to the head surface. The tapered tip of the cam 54 then presses down the operation lever 50*b* of the cap member 50 so that the cap member 50 is rotated into its retracted position as shown in FIG. 8, wherein the cap member 50 is supported so as not to contact the side wall of the print head 13. Because the cap member 50 does not touch the side wall of the print head 13, the flexible wire cord 42 attached to the side wall of the print head 13 will not be damaged by the cap member 50.

As mentioned above, when the print head 13 is in its printing position, the lower tip of the print head 13 will protrude slightly lower than the lower edge of the case 2 so that printing is possible. In this condition, as shown in FIG. 6, the user supports the case 2 in a vertical orientation with respect to the upper surface of the print sheet P. Next, while pressing the print start button 6, the user scans the case 2 in the printing direction across the upper surface of the print sheet P. Based on the print data received by the infrared photo diode 40 and on the encoder signal from the photosensor 38, printing is performed on the print sheet P by ejecting ink from the plurality of ejection nozzles each time the case 2 is moved by a predetermined printing pitch. Because the cap member 50 is formed into a bent shape, at this time, it is rotated into its retracted position and housed within the case 2 so it will not interfere with the user's view of the printed images and characters so that the user can easily confirm quality of the printed characters and images.

At the end of the printing operations, the user releases the print start button 6 and presses the operation button 7 inward into the case 2 so that the upper half of the slide plate 22 bends in the forward direction, thereby releasing engagement between the cut-out portion 22*b* and the engagement protrusion portion 2*e*. As a result, the compression spring 23 will snap the slide plate 22 upward until the bent portion 22*a* engages with the engagement protrusion portion 2*e*, whereupon the slide plate 22 is stopped at its uppermost position. Accordingly, the print head 13 will be snapped into its housed position. Because the cam 54 moves upward simultaneously with movement of the slide plate 22, the compression spring 23 will rotate the cap member 50 into intimate sealing contact with the head surface of the print head 13, which is in its housed position.

The position switching mechanism 20 switches the print head 13 into its housed position where it is housed within the housing portion 21 during non-printing times. Therefore, even if the portable printing device 1 is carried around while not being used to print, the print head 13 will be properly protected against damage. When the print head 13 is in its housed position, the protective cap 52 of the cap member 50 is in sealing contact with the head surface of the print head 13. Therefore, the ink on the head surface can be reliably prevented from drying out.

As mentioned above, the cap member 50 is supported with respect to the case 2 pivotable between the capping position, wherein it is intimate sealing contact with the head surface, and the retracted position, wherein it is retracted to the side of the print head 13. The cap member 50 pivots into its retracted position in association with movement of the print head 13 into its printing position. Also, when the cap member 50 first starts pivoting into its retracted position, the protective cap 52 wipes the head surface of the print head 13. With this configuration, when the print head 13 is moved into its printing position, the cap member 50 will pivot into its retracted position in association with movement of the print head 13 into its printing position. Therefore, the user can easily print on the print sheet P using the print head 13 without having to manually remove the cap member 50. Also, ink clinging to the head surface can be wiped away so that ink is properly ejected from the nozzles to print clean images and characters.

Because the torsion spring 53 urges the cap member 50 to pivot into its capping position, when the print head 13 moves from its printing position to its housed position, the urging force of the torsion spring 53 pivots the cap member 50 into its capping position so that the print surface is automatically capped during non-printing times and the ink on the head surface can be easily prevented from drying out.

The position switching mechanism 20 includes the manually operated slide plate 22; the engagement protrusion portion 2*e* provided to the case 2; and the bent portion 22*a* and the cut-out portion 22*b* provided to the slide plate 22. The print head 13 is fixed to the slide plate 22 so that when the slide plate 22 is in its uppermost position, the print head 13 is in its housed position and so that when the slide plate 22 is in its lowermost position, the movement amount print head 13 will be in its printing position.

With this configuration, when the slide plate 22 is manually moved into its uppermost position, the slide plate 22 can be easily maintained into its uppermost position by engagement between the bent portion 22*a* and the engagement protrusion portion 2*e*. Similarly, when the slide plate 22 is manually moved into its lowermost position, the slide plate 22 can be easily maintained into its lowermost position by engagement between the cut-out portion 22*b* and the engagement protrusion portion 2*e*.

Because the compression spring 23 resiliently urges the slide plate 22 into its uppermost position, by pressing the slide plate 22 at the end of print operations, engagement between the cut-out portion 22*b* of the slide plate 22 and the engagement protrusion portion 2*e* can be released so that the slide plate 22 is snapped into its uppermost position by urging force of the compression spring 23. As a result, the print head 13 can be easily housed within the housing portion 21.

Various changes and modifications may be made to the configuration described in the first embodiment. For example, the cap member 50 can be designed to slide between its capping position and its retracted position. Also, a variety of different springs can be used as urging members instead of the compression spring 23 and the torsion spring 53. The position switching mechanism 20 can be designed to switch position using an electric actuator such as a solenoid. The print head 13 can be formed with a single row of a plurality of ejection nozzles. The configuration described in the first embodiment can be further applied to a variety of different portable printing devices provided with an image retrieving device and the like.

Figure 9:
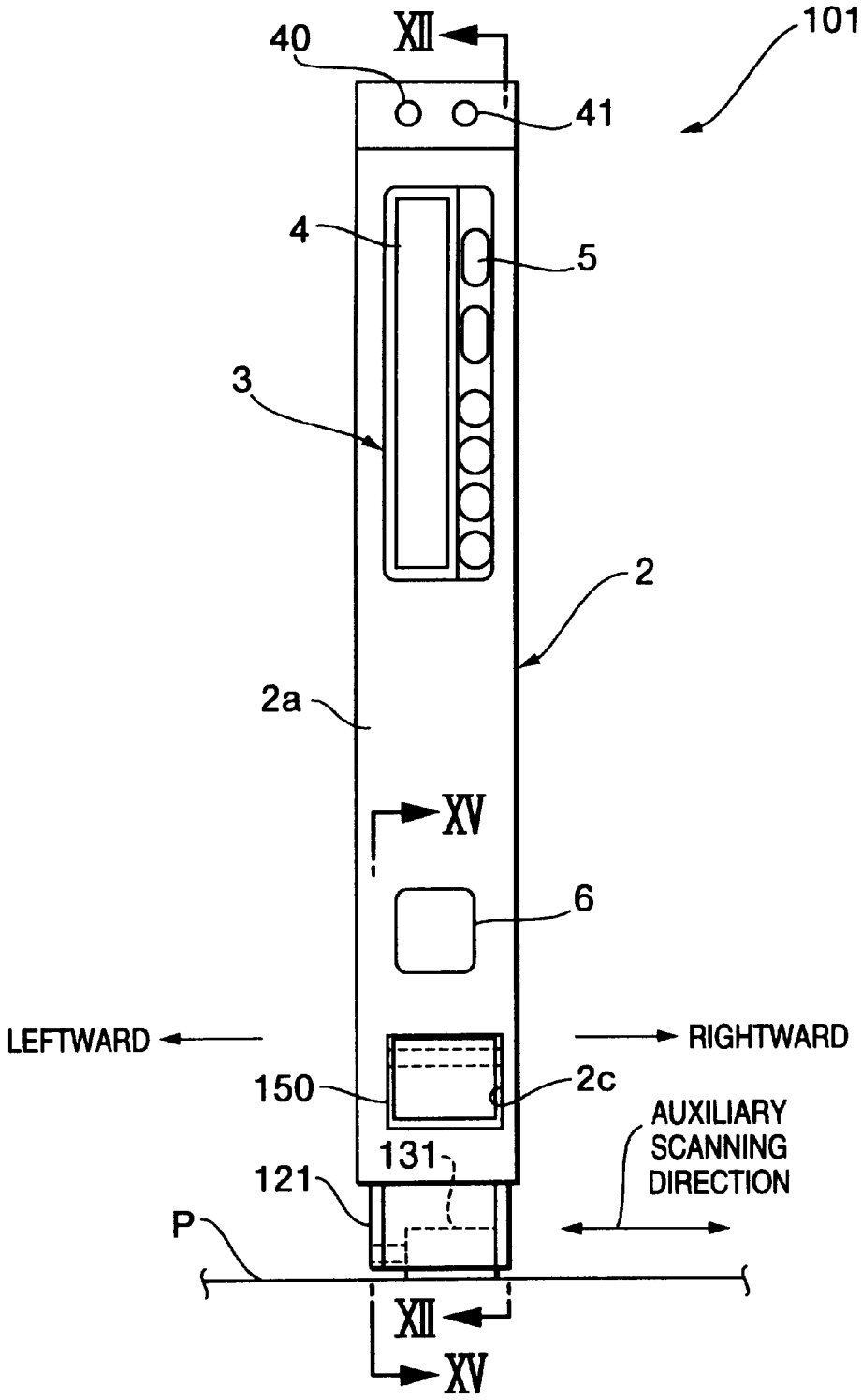
FIG. 9 is a front view showing a portable printing device according to a second embodiment of the present invention.
Figure 10:
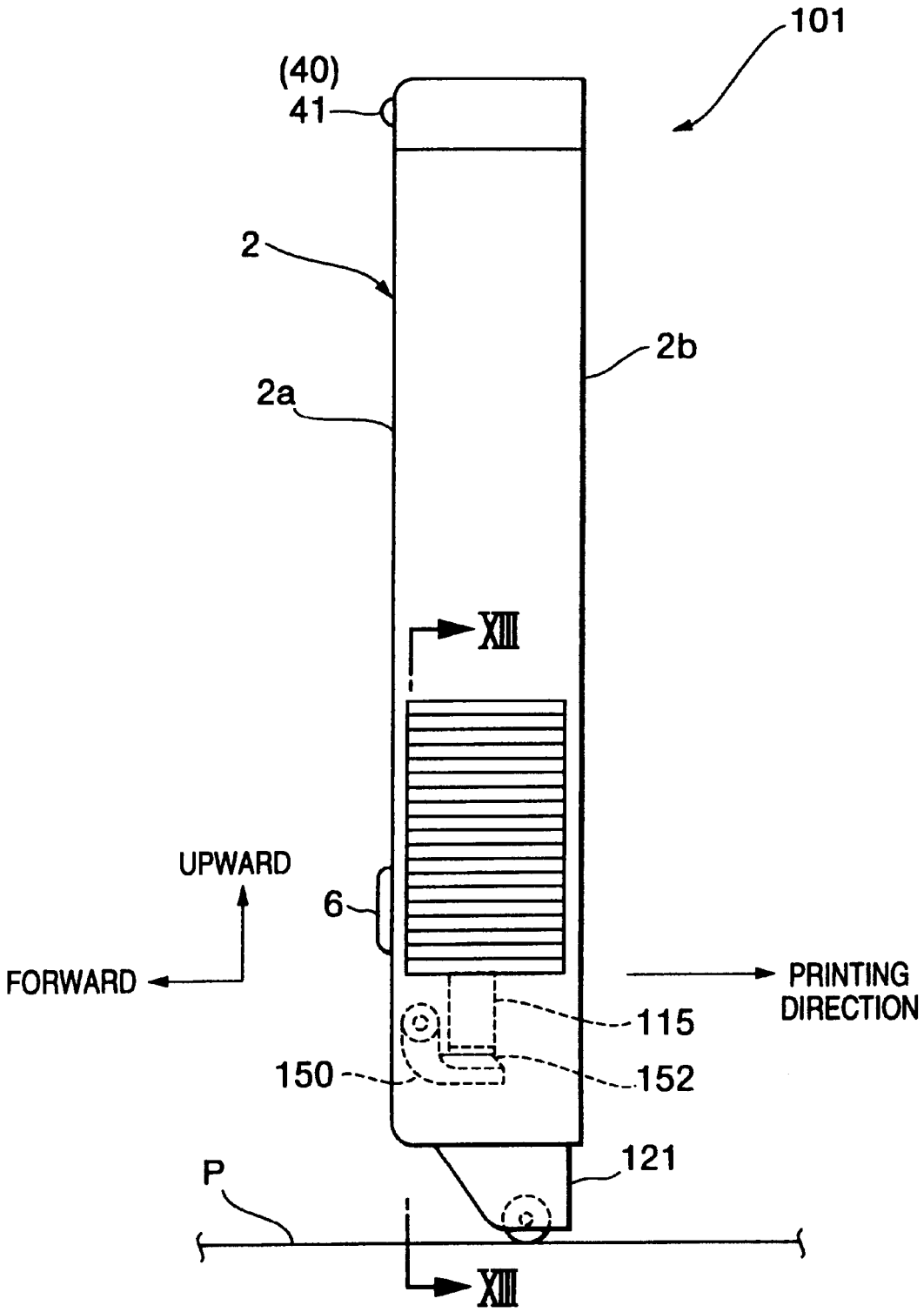
FIG. 10 is a side view showing the portable printing device of the second embodiment.

Next, while referring to FIGS. 9 to 19, an explanation will be provided for a portable printing device 101 according to a second embodiment of the present invention. The portable printing device 101 of the second embodiment has a control system similar to that of the portable printing device 1 described in the first embodiment. Also, as shown in FIGS. 9 and 10, the external appearance of the portable printing device 101 of the second embodiment is similar to that of the portable printing device 1 described in the first embodiment. However, the portable printing device 101 is provided with a movable frame 121. The movable frame is slidably disposed at the lower end of the case 2 so that vertical movement of the movable frame 121 partially protrudes the lower tip of the movable frame 121 from the lower end of the case 2.

Here, while referring to FIGS. 11 to 14, an explanation will be provided for the movable frame 121 and for a position switching mechanism 120 for switching a print head 115 between its printing position and its housed position.

Figure 11:
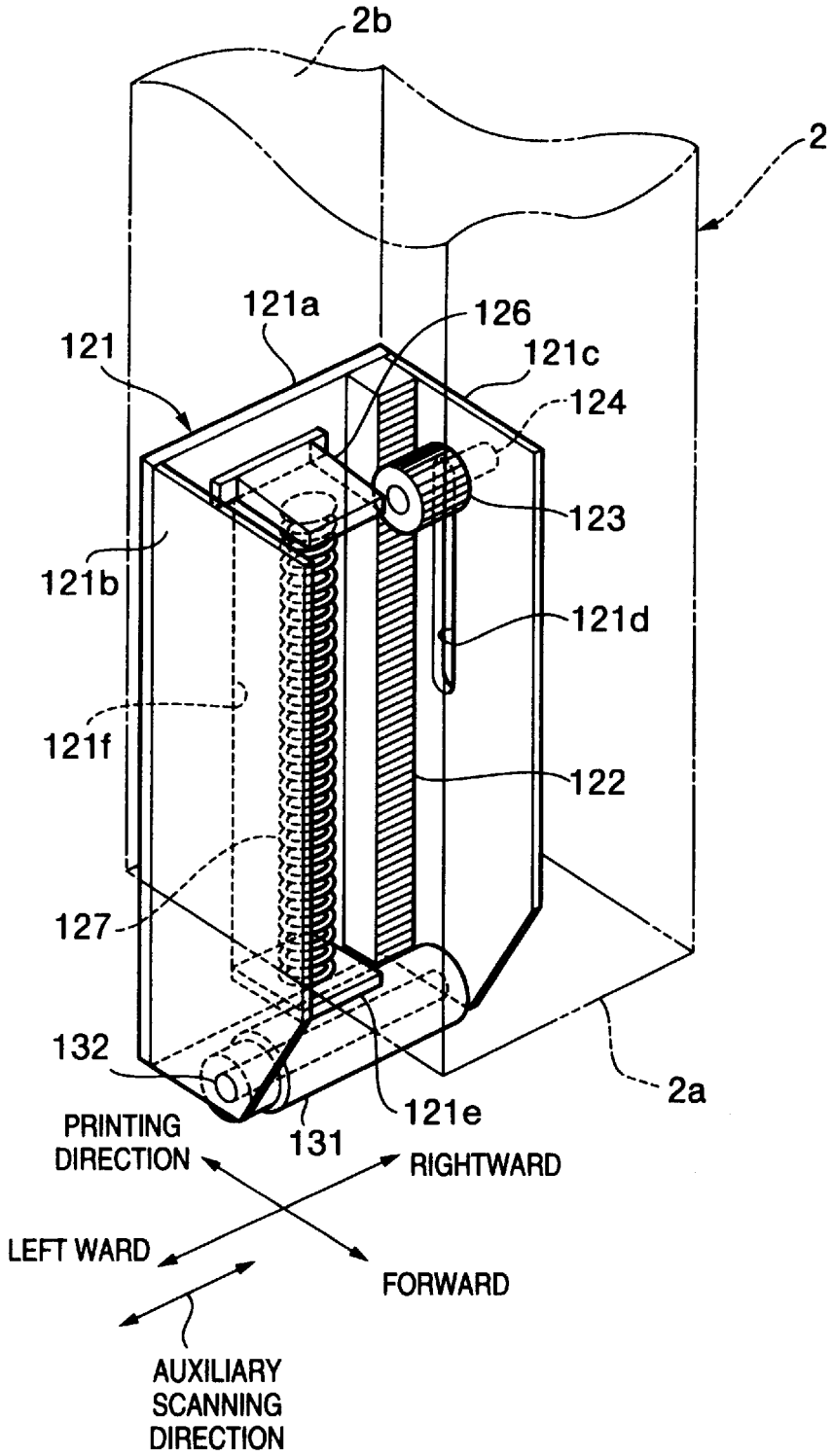
FIG. 11 is a perspective view partially in phantom showing details of a movable frame according to the second embodiment.
Figure 14:
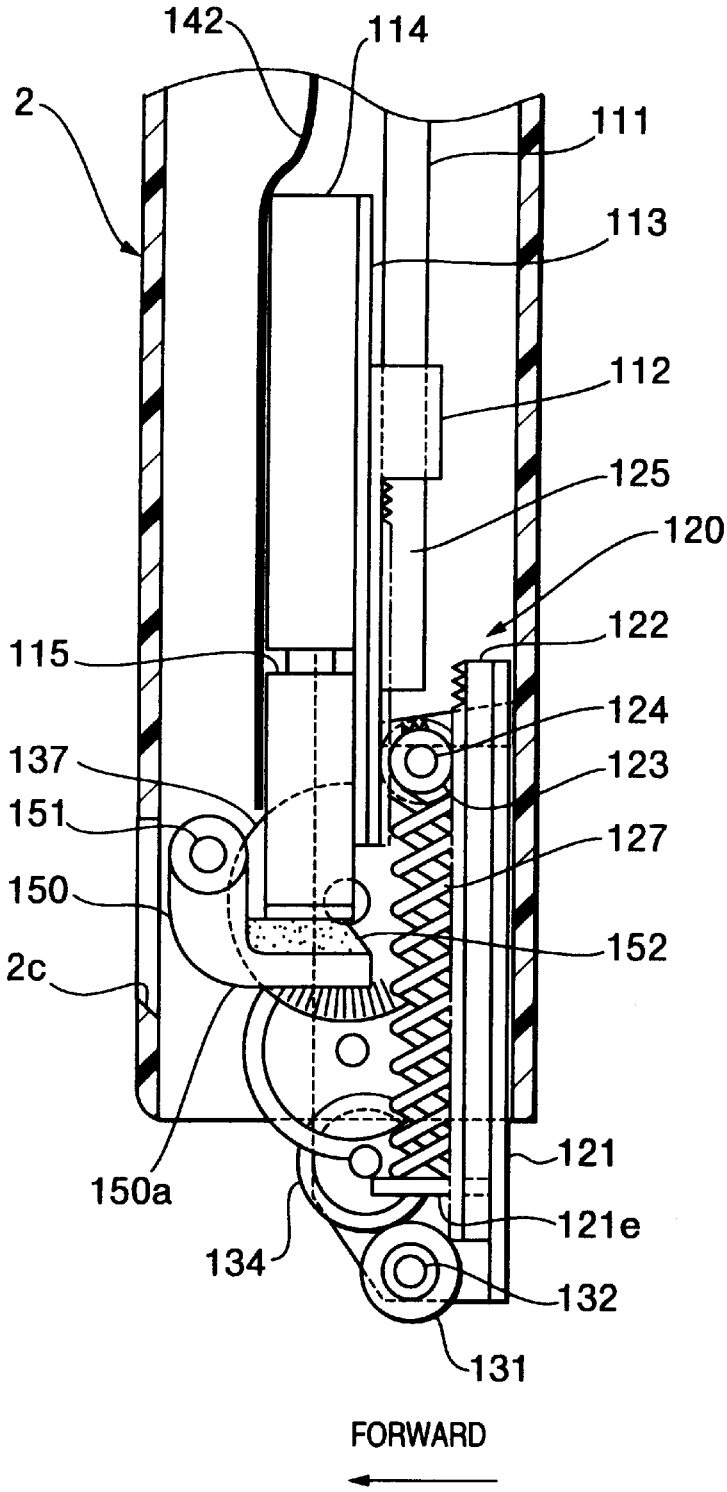
FIG. 14 is an enlarged view of the cross-sectional view of FIG. 12 showing details of components in the vicinity of a print head.

As shown in FIG. 11, the movable frame 121 is formed in an approximately C shape in cross section. In the present embodiment, a rubber timing roller 131 is rotatably supported on a shaft 132 between left and right wall portions 121*b* and 121*c* of the movable frame 121. The position switching mechanism 120 includes: a vertically extending drive rack 122 fixed to the inner surface of a back wall 121*a* of the movable frame 121; a pinion 123 rotatable supported on the case 2 so as to be meshingly engaged with the drive rack 122; and, as shown in FIG. 14, a follower rack 125 provided on a movable plate 113 to which is attached the print head 115. The follower rack 125 is in meshing engagement with the pinion 123, from the opposite side as the drive rack 122.

The drive rack 122 is fixed to the inner surface of the back wall 121*a* of the movable frame 121 so that its gear portion faces the front of the portable printing device 101. An elongated slit 121*d* extending in the vertical direction is formed in a right wall portion 121*c* of the movable frame 121. The pinion 123, which is in meshing engagement with the drive rack 122, is rotatably fixed to the side wall of the case 2 by a shaft 124 inserted through the elongated slit 121*d*.

As best seen in FIG. 14, the vertically extending follower rack 125 is fixed with its gear portion facing rearward to the rightward edge portion at the rear surface of a movable plate 113. As mentioned above, the pinion 123 is meshingly engaged with the follower rack 125. Said differently, the gear portion of the drive rack 122 is in meshing engagement with the pinion 123 from one side, and the follower rack 125 is in meshing engagement with the pinion 123 from an opposite side with respect to the drive rack 122. As shown in FIG. 14, a print head 115 fixed to the lower edge of the movable frame 121 is maintained in its housed position, wherein it is housed within the case 2.

Figure 13:
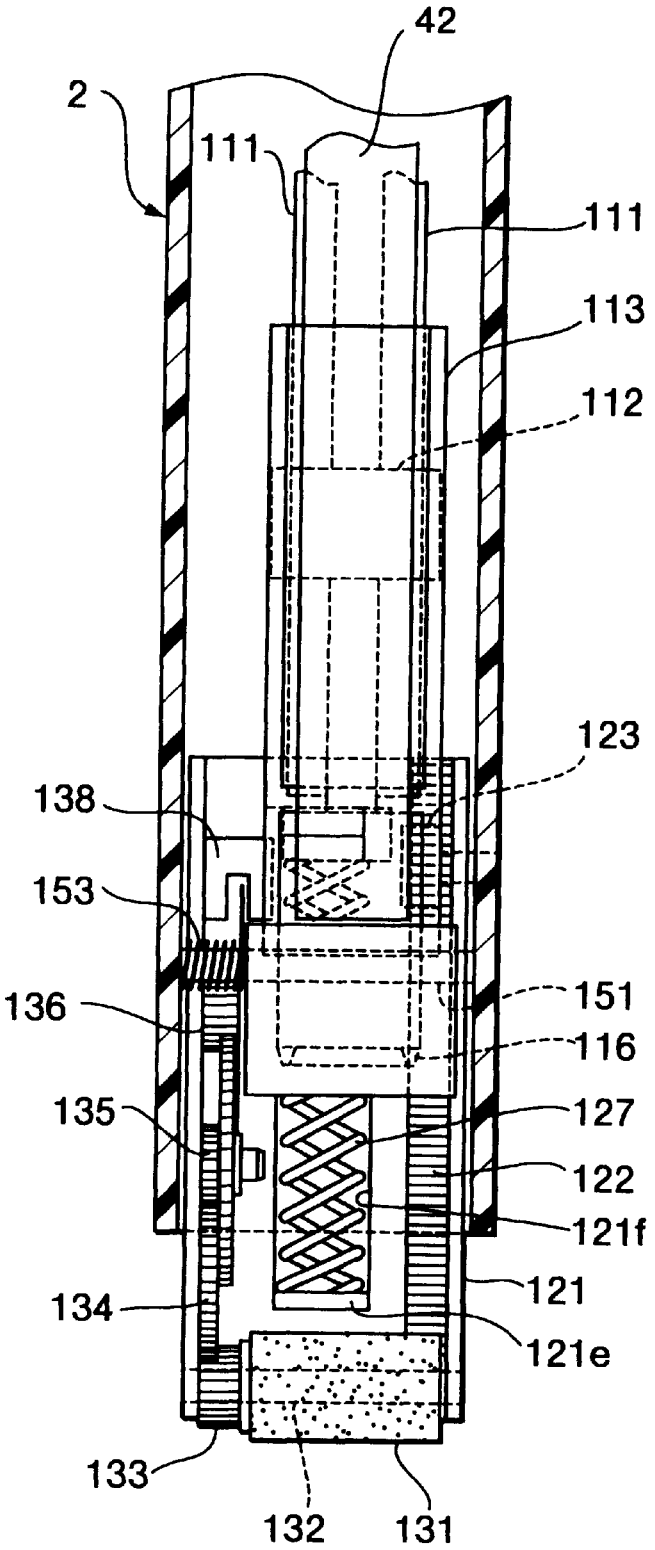
FIG. 13 is a cross-sectional view taken along line XIII—XIII of FIG. 10 showing the portable printing device of the second embodiment during the non-printing period.

As shown in FIGS. 11 and 13, a rectangular-shaped cut-out portion 121*f* extending in a vertical direction is formed in the inner back wall 121*a* of the movable frame 121. As shown in FIGS. 11 and 14, a forward protruding spring bearing plate 121*e* is formed integrally with the lower rear surface of the movable frame 121. The lower spring bearing plate 121*e* is inserted through the cut-out portion 121*f*.

Figure 15:
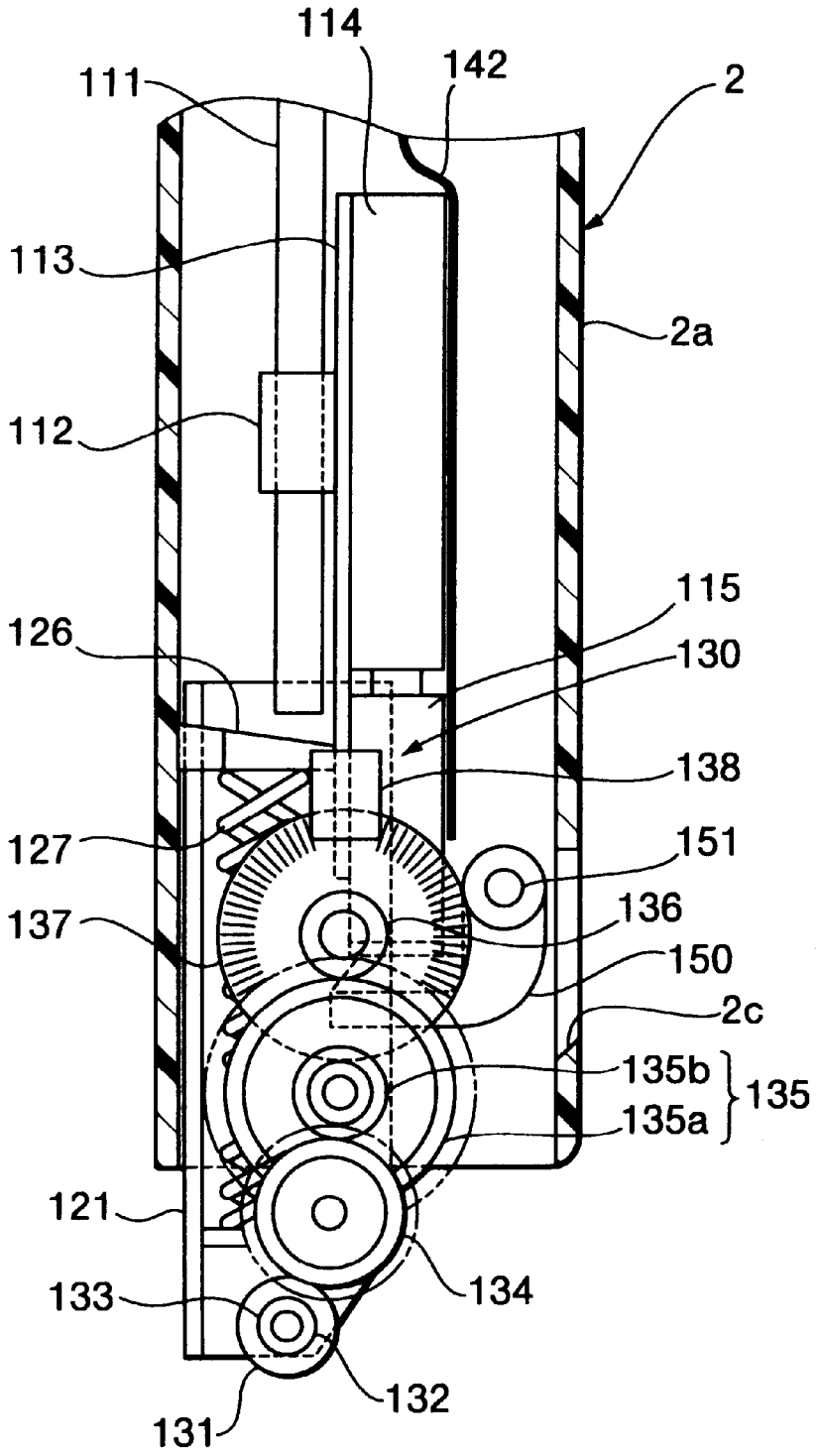
FIG. 15 is a cross-sectional view taken along line XV—XV of FIG. 9 showing details of a movement detection mechanism of the portable printing device of the second embodiment.

As can best be seen in FIG. 15, a forward protruding upper spring bearing plate 126 is integrally formed with a rear wall portion 102*b* of the case 2 so as to be in opposition with the lower spring bearing plate 121*e*. A compression coil spring 127 is disposed spanning between the upper spring bearing plate 126 and the lower spring bearing plate 121*e*.

With this configuration, when printing is not being performed, then, as shown in FIG. 11, the compression coil spring 127 presses the lower spring bearing plate 121*e*, and consequently the movable frame 121, downward into its lower most position, wherein the upper spring bearing plate 126 abuts the upper edge of the cut-out portion 121*f*. In this condition, the lowermost edge of the movable frame 121 partially protrudes from the lowermost edge of the case 2. Also, as shown in FIG. 14, the print head 115 fixed to the lower edge of the movable frame 121 is maintained in its housed position, wherein it is housed within the case 2.

Figure 17:
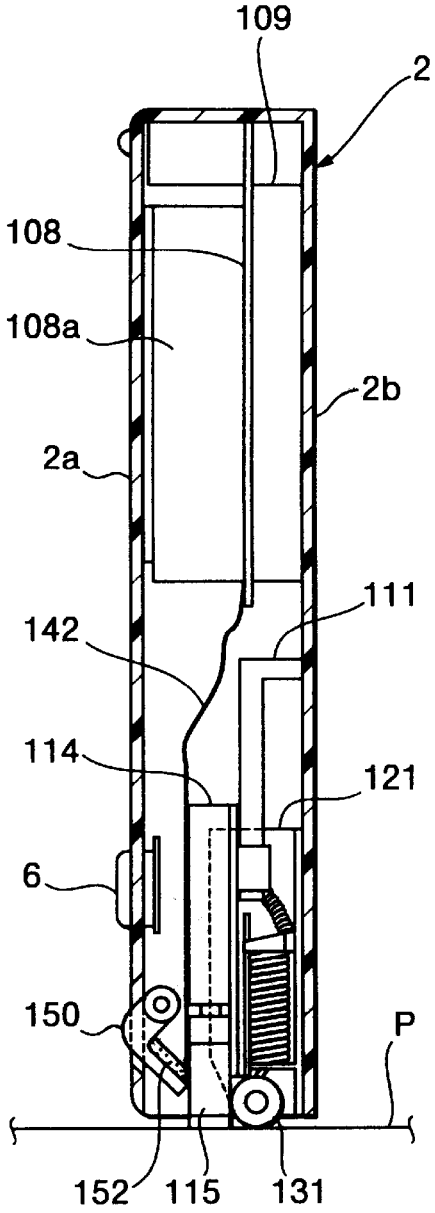
FIG. 17 is a cross-sectional view taken along line XII—XII of FIG. 9 showing the portable printing device of the second embodiment during a printing period.
Figure 18:
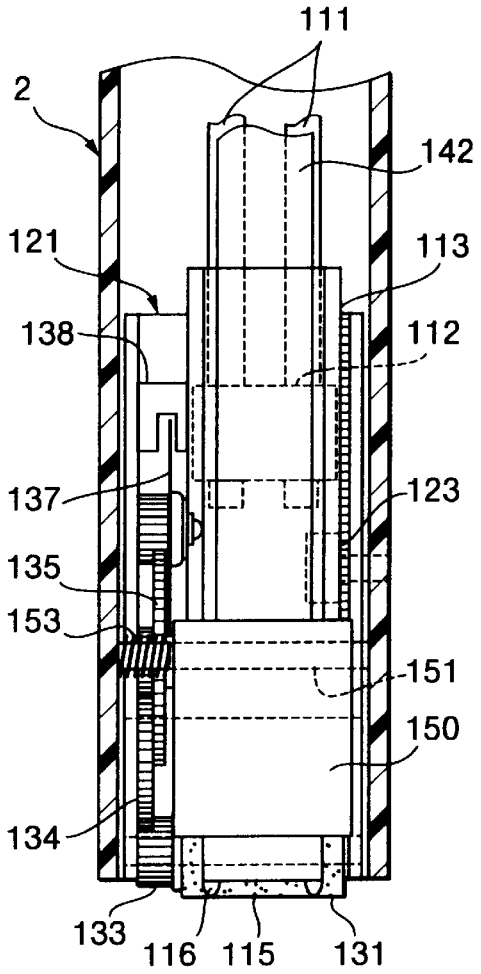
FIG. 18 is a cross-sectional view taken along line XIII—XIII of FIG. 10 showing the portable printing device of the second embodiment during the printing period.
Figure 19:
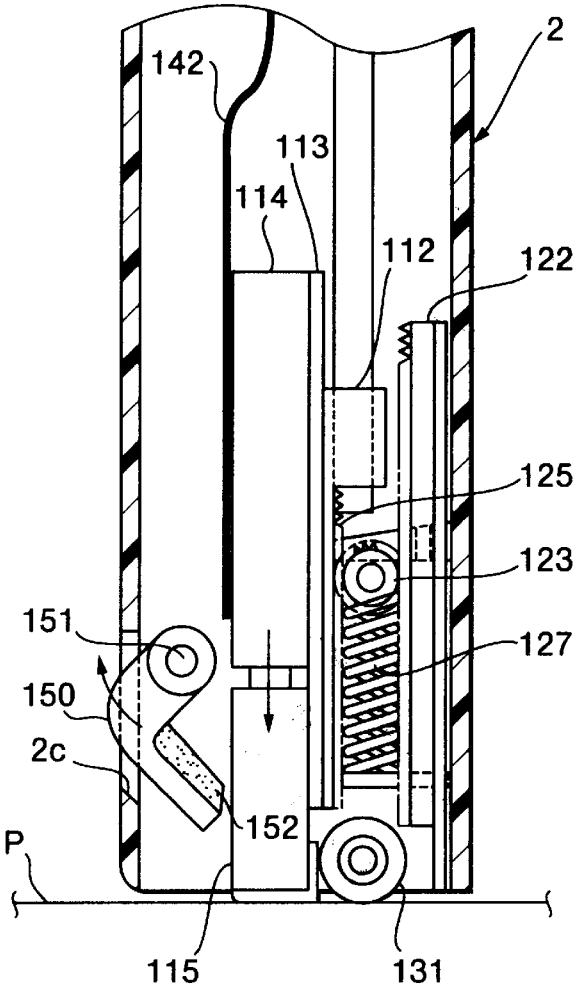
FIG. 19 is an enlarged view of the cross-sectional view of FIG. 17 showing details of components in the vicinity of a print head.

On the other hand, when printing is to be performed, then as shown in FIGS. 17 to 19, the user places the case 2 in a vertical orientation against the upper surface of a print sheet P and presses the case 2 downward so that the timing roller 131 is pressed against the print sheet P. This will move the case 2 downward with respect to the movable frame 121 against the urging force of the compression coil spring 127. Similarly, it can be said that when the case 2 moves downward with respect to the movable frame 121, contrarily the movable frame 121 moves upward with respect to the case 2. As a result, the pinion 123 rotates in the counterclockwise direction as viewed in FIG. 14 upward along the drive rack 122. The follower rack 125 in meshing engagement with the pinion 123 moves downward at this time in accordance with rotation of the pinion 123. As a result, the movable plate 113 fixed to the follower rack 125 is guided downward along a guide rod 111 so that the print head 115 moves into its printing position below its housed position. Because at this time the lower edge of the print head 115 is slightly lower that the lowermost edge of the case 2, printing is possible. With this configuration, the print head 115 can be easily and rapidly switched between its printing position and its housed position by merely manually moving the movable frame 121 in the vertical direction with respect to the case 2.

Next, an explanation will be provided for a movement amount detection mechanism 130 for detecting relative movement between the portable printing device 101 and the print sheet P.

Figure 16:
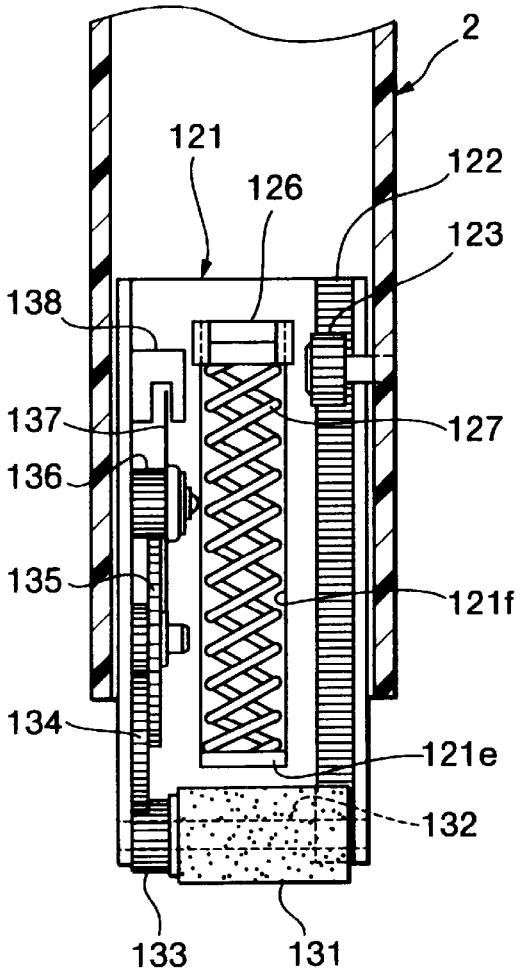
FIG. 16 is a cross-sectional view taken along line XVI—XVI of FIG. 12.

As shown in FIGS. 15 and 16, the movement amount detection mechanism 130 of the second embodiment is similar to the movement amount detection mechanism 30 of the first embodiment. As mentioned above, the rubber timing roller 131 is rotatably supported on the shaft 132 extending between the lower ends of side walls 121*b* and 121*c* of the movable frame 121 so that its lower edge protrudes below the lower edge of the movable frame 121.

A gear 133 is provided to the shaft 132 so as to rotate about the shaft 32 integrally with the timing roller 131. A gear 134, a two-step gear 135 including gears 135*a*, 135*b*, and a gear 136 are rotatably disposed on the side wall 121*b* in serial meshing engagement with each other. In other words, the gear 134 is rotatably disposed on the left wall portion 121*b* in meshing engagement with the gear 133, the two-step gear 135 (135*a*, 135*b*) is rotatably disposed on the left wall portion 121*b* in meshing engagement with the gear 134, and the gear 136 is rotatably disposed on the left wall portion 121*b* in meshing engagement with the two-step gear 135 so that rotational force of the gear 133 is transmitted to the gear 136 via the gear 134 and the two-step gear 135 (135*a*, 135*b*). A disk-shaped encoder plate 137 formed with a plurality of slits at its outer periphery is fixed to the gear 136. A photosensor 138 having a light emitting portion and a light receiving portion is disposed so as to sandwich the outer peripheral portion of the encoder plate 137.

As shown in FIG. 17, when the case 2 is supported with the vertical posture with respect to the print sheet P, the timing roller 131 contacts the upper surface of the print sheet P. When the user manually scans the case 2 in the printing direction, that is, in the main scanning direction, while maintaining the case 2 in this vertical posture, then the timing roller 131 and the gears 133 through 136 rotate. When the encoder plate 137 rotates accordingly, the photosensor 138 outputs a pulse train, that is, an encoder signal. Based on the encoder signal and on print data, each time the case 2 is moved a predetermined distance, ink is selectively ejected from the plurality of ejection nozzles so that characters and images can be printed on the print sheet P regardless of the speed at which the portable printing device 2 is scanned.

Here, an explanation will be provided for a cap member 150 for protecting the head surface of the print head 13. As shown in FIGS. 13 and 14, the cap member 150 of the second embodiment is configured similarly to the cap member 50 of the first embodiment. The cap member 150 is supported on the case 2 by a shaft 151 at a position adjacent to the print head 115in its housed position. The cap member 50 is formed in a shape bent approximately 90 degree angle to form a cap portion 150*a* in confrontation with the print head surface of the print head 115. A block-shaped protective cap 152 made of rubber is fixed to the print head confronting surface of the cap portion 150*a*. As shown in FIG. 13, the cap member 50 is formed with a width dimension in the auxiliary scanning direction substantially the same as the width dimension of the print head 115.

The cap member 150 is pivotably supported on the case 2 by the shaft 151 so as to be pivotable between a capping position, shown in FIG. 14, wherein the protective cap 152 is in intimate contact with the head surface, and a retracted position, shown in FIG. 19, wherein the protective cap 152 is retracted to the side of the print head 115. A torsion spring 153 is mounted around the outer periphery of the shaft 151. As shown in FIG. 14, when the print head 115 is in its housed position, the protective cap 152 is urged by the torsion spring 153 into its capping position in intimate contact with the head surface of the print head 115.

When the print head 115 moves downward, the cap member 150 in sealing intimate contact with the head surface of the print head 115 is pushed so that it pivots in the clockwise direction as viewed in FIG. 14 around the shaft 151 and to the side of the print head 115. As shown in FIGS. 18 and 19, the cap member 150 is supported in its retracted position when the head is lowered into its printing position. On the other hand, when the print head 115 moves into its housed position, the lower tip of the print head 115 moves above the lower tip of the print head 115. The torsion spring 153 rotates the cap member 150 in the counterclockwise direction as viewed in FIG. 19 so that when the print head 115 moves into its housed position, the cap member 150 pivots into its capping position shown in FIG. 14so as to protect the head surface of the print head 115.

Next, an explanation will be provided for operations of the portable printing device 101. When the portable printing device 101 is not being used to print, then as shown in FIG. 14, the movable frame 121 is in its lowermost position, the print head 115 is in its housed position, and the cap member 150 is in its capping position. As described above, when printing is to be performed, the user supports the case 2 in a vertical posture against the print sheet P and presses the case 2 downward. The timing roller 131 will be pressed against the print sheet P so that the case 2 moves downward with respect to the movable frame 121. The movable frame 121 will move with respect to the case 2 to its uppermost position where it is entirely housed within the case 2. When the drive rack 122 moves upward with the movable frame 121, the pinion 123 rotates so that the follower rack 125 moves downward. The movable plate 113 is guided downward on the guide rod 111 so that the print head 115 is moved from its housed position into its printing position.

In order to print, the user supports the case 2 in a vertical orientation with respect to the print sheet P as shown in FIGS. 9 and 10. The user then presses the case 2 downward so that the print head 115 moves into its printing position as shown in FIGS. 17 to 19 so that the print head 115 is exposed in confrontation with the print sheet P.

At this time, the cap member 150, which is in intimate sealing contact with the head surface of the print head 115, is pushed by downward movement of the print head 115 to pivot around the shaft 151 to the side of the print head 115, where it is maintained in its retracted position. With this action the protective cap 152 of the cap member 150 wipes away unnecessary ink from the head surface of the print head 115.

When printing operations are completed, the user releases the print start button 6 and lifts the case 2 upward. In association with this, the movable frame 121 is snapped downward with respect to the case 2 by spring force of the compression coil spring 127. The print head 115 also snaps into its housed position via the racks 122, 125 and the pinion 123. The cap member 150 is pivoted into its capping position in intimate contact with the print head 115 by the spring force of the torsion spring 153.

Here, the features of the portable printing device 101 according to the second embodiment will be summarized. When the portable printing device 101 is not being used for printing so the case 2 is not pressed against the print sheet P, then the movable frame 121 is moved to its lowermost position by the compression coil spring 127. In association with downward movement of the movable frame 121, the print head 115 is moved into its housed position housed within the case 2 via the position switching mechanism 120 and the cap member 150 is brought into intimate sealed contact with the head surface of the print head 115.

With this configuration, the cap member 150 can be easily brought into sealed contact with the head surface of the print head 115 to reliably prevent ink from drying out on the surface of the print head 115. Further, the cap member 150 reliably protects the print head 115 so that it will not be damaged when the portable printing device 101 is carried around.

On the other hand, when the portable printing device 101 is to be used to print images and the like, the user presses the case 2 downward against the surface of the print sheet P so that the movable frame 121 moves into its uppermost position within the case 2. In association with this, the position switching mechanism 120 moves the print head 115 downward into its printing position. Also, the cap member 150 is retracted to the side of the print head 115 so that ink can be ejected onto the print sheet P.

Because the movable frame 121 is urged downward into its lowermost position by the urging force of the compression coil spring 127, when printing is completed and the user raises the case 2 upward, then the movable frame 121 is snapped into its lowermost position by spring force of the compression coil spring 127. With this configuration, the print head 115 can be quickly and easily moved into its housed position where it is safely housed within the case 2.

Figure 20:
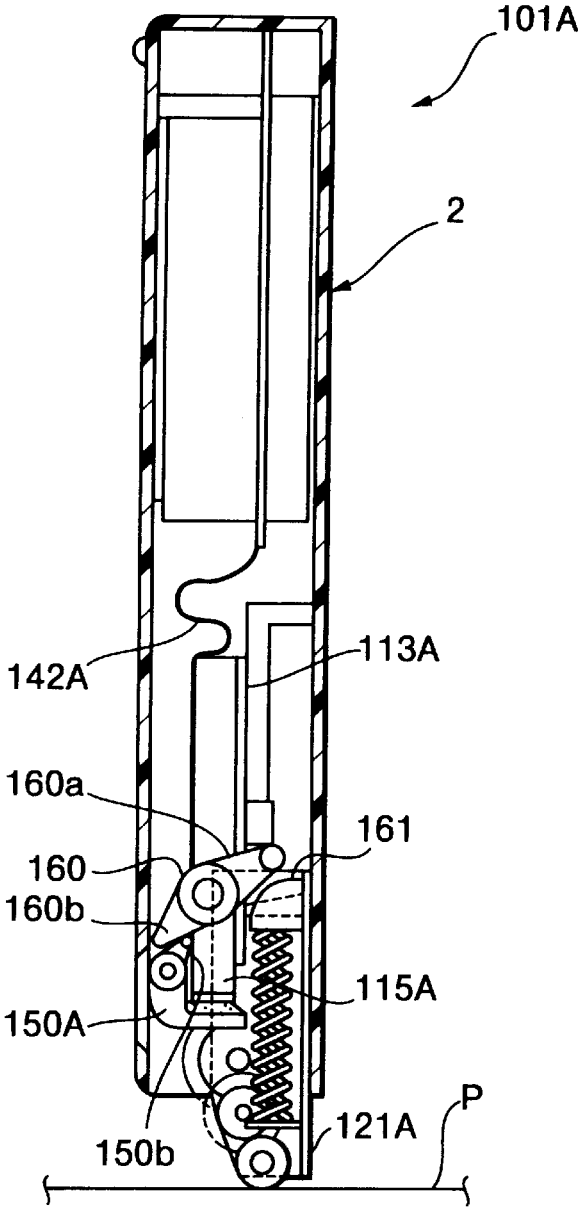
FIG. 20 is a cross-sectional view showing configuration of a modification of the second embodiment during a non-printing period.
Figure 21:
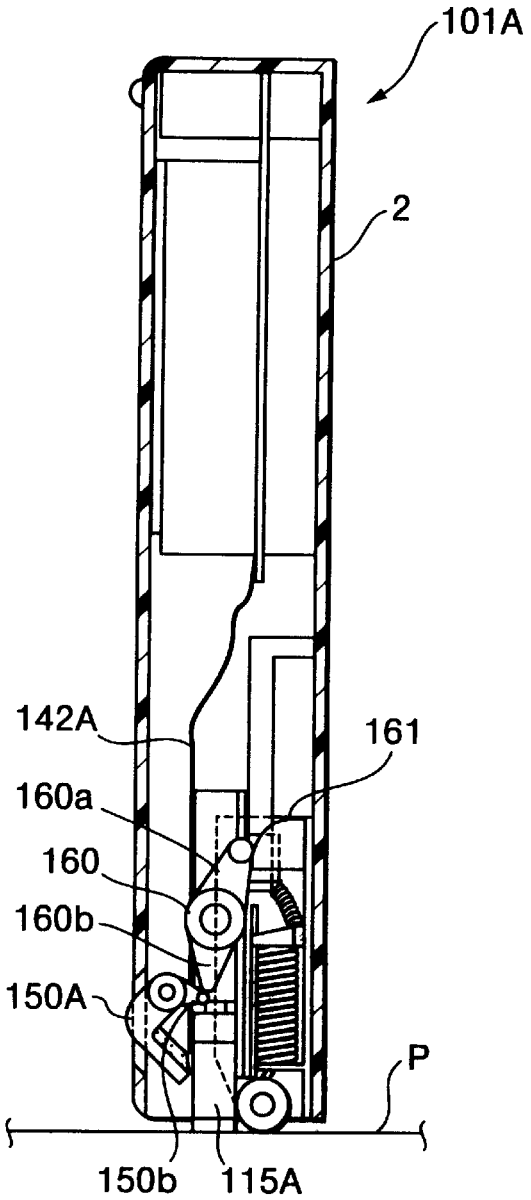
FIG. 21 is a cross-sectional view showing the modification of FIG. 20 during a printing period.

Next, an explanation will be provided for a portable printing device 101A according to a modification of the second embodiment while referring to FIGS. 20 and 21.

The portable printing device 101A of this modification is similar to the portable printing device 101 described above. For example, a movable frame 121A and a movable plate 113A are slidably disposed with respect to the case 2 in a manner similar to that described above for the movable frame 121 and the movable plate 113. A print head 111A is attached to the movable plate 113A. The portable printing device 101A differs from the portable printing device 101 by provision of a pivot lever 160, a pivot cam 161, and an operation lever 150*b*.

The pivot lever 160 has a drive portion 160*a* and an operation portion 160*b* and is pivotably attached to the right edge portion of the movable plate 113A. The pivot cam 161 is disposed above the movable frame 121A in a position where the drive portion 160*a* of the pivot lever 160 will abut against it when the movable plate 113A moves downward.

Although not shown in the drawings, a cut-out portion through which the pivot cam 161 is attached to the case 2 is formed in the movable frame 121A. The operation lever 150*b* for abutting the pivot lever 160 is integrally formed with a cap member 150A. As shown in FIG. 20, when the portable printing device 101A is not being used to print, then the print head 115A is in its housed position and the cap member 150A is in its capping position in sealed contact with the print surface of the print head 115A.

When the user presses the case 2A downward in order to print, then the print head 115A lowers into its printing position. At this time, the pivot lever 160 also moves downward so that the drive portion 160A of the pivot lever 160 abuts against the pivot cam 161. The drive portion 160A slides along the cam surface of the pivot cam 161 while moving downward so that the pivot lever 160 pivots in the counterclockwise direction as viewed in FIG. 20. At the same time, the operation arm 160B of the pivot lever 160 pushes the operation lever 150*b* so that the operation lever 150*b* pivots in the clockwise direction as viewed in FIG. 20, thereby retracting the cap member 150A into its retracted position wherein it does not contact the side wall of the print head 115A.

On the other hand, when printing is completed and the user lifts up the case 2, then the print head 115A is raised into its housed position. At this time, the pivot lever 160 also rises upward so that the cap member 150A is returned to its capping position. In other words, when the print head 115A is lowered during printing into its printing position, then the cap member 150A is forcibly driven to pivot into its retracted position by pivoting movement of the pivot lever 160. In this case, the cap member 150A can be forcibly pivoted from its capping position into its retracted position by the operation lever 150*b* and the pivot lever 160. Because the cap member 150A does not contact the side wall of the print head 115A in its retracted position, a flexible wiring cord 142A and the like attached to the side wall of the print head 115A will not be damaged.

Various changes and modifications may be made to the configuration described in the second embodiment. For example, the cap member can be designed to slide between its capping position and its retracted position. The position switching mechanism can be designed to switch position using an electric actuator such as a solenoid. The print head can be formed with a single row of a plurality of ejection nozzles. The configuration described in the first embodiment can be further applied to a variety of different portable printing devices provided with an image retrieving device and the like.

It should be noted that the pivot lever 160 and the pivot cam 161 of the portable printing device 101A can be replaced by a tear-shaped cam fixedly attached to the right edge portion of the movable plate 113A in a manner similar to the teardrop-shaped cam 54 described in the first embodiment.

Figure 22:
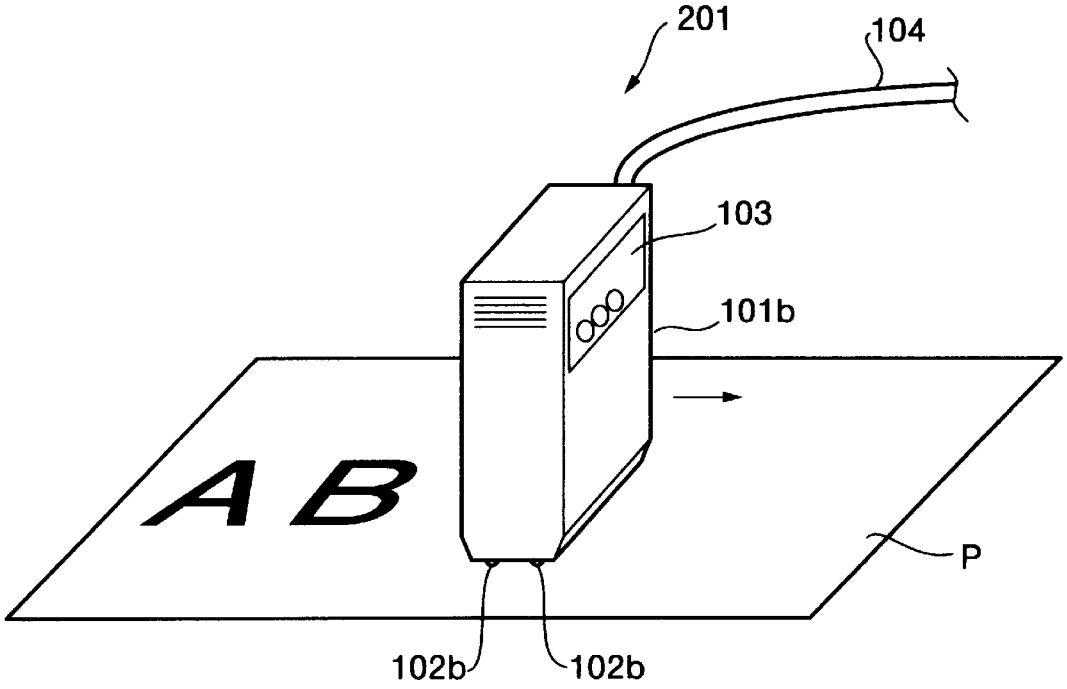
FIG. 22 is a perspective view showing a portable printing device according to a third embodiment of the present invention.

Next, an explanation will be provided for a portable printing device 201 according to a third embodiment of the present invention. FIG. 22 is a perspective view showing the portable printing device 201 according to the third embodiment. The portable printing device 201 includes a block-shaped case 201*b*. The case 201*b* is formed in a block shape so as to be easily held by a user. A front roller 202*a* and a rear roller 202*b* are rotatably provided to the lower side of the case 201*b*. An operation panel 203 is provided on the side of the case 201*b*. The operation panel 203 is provided with operation switches for turning on and off power supply of the portable printing device 201 and for selecting a print mode of the portable printing device 201. Also, a cable 204 through which print data and the like is inputted from an external device is provided to the case 201*b*.

In order to print images and the like on a print medium P, a user places the case 201*b* on the print medium P, such as a print sheet, and manually scans the case 201*b* in a printing direction, indicated by an arrow in FIG. 22, while maintaining contact between the print medium P and the front and rear rollers 202*a*, 202*b*. Printing is performed on the print medium P based on print data inputted from the external device through the cable 204. During printing, the front and rear rollers 202*a*, 202*b* maintain the posture of the case 201*b* and also fix the position of a print head, to be described later, with respect to the print medium P. Relative movement between the print head and the print medium P is detected based on rotation of the front and rear rollers 202*a*, 202*b* and printing is performed accordingly.

Figure 23:
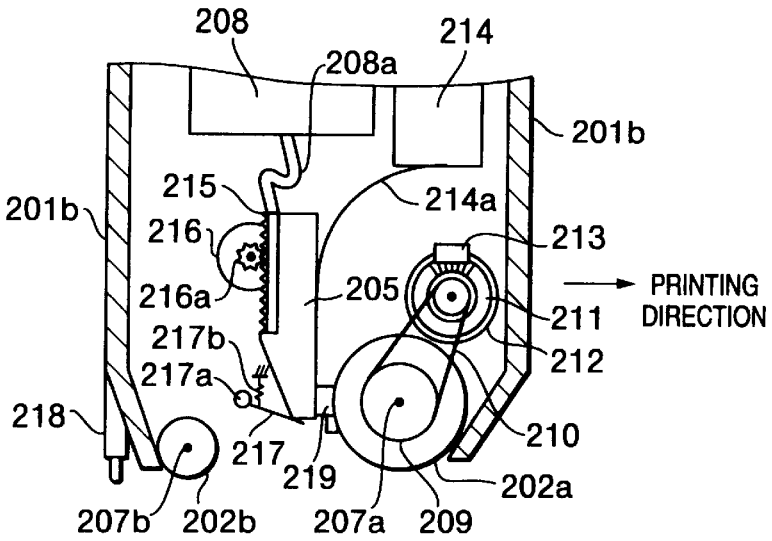
FIG. 23 (*a*) is a cross-sectional view showing internal components of the portable printing device according to the third embodiment during a non-printing period.
Figure 23:
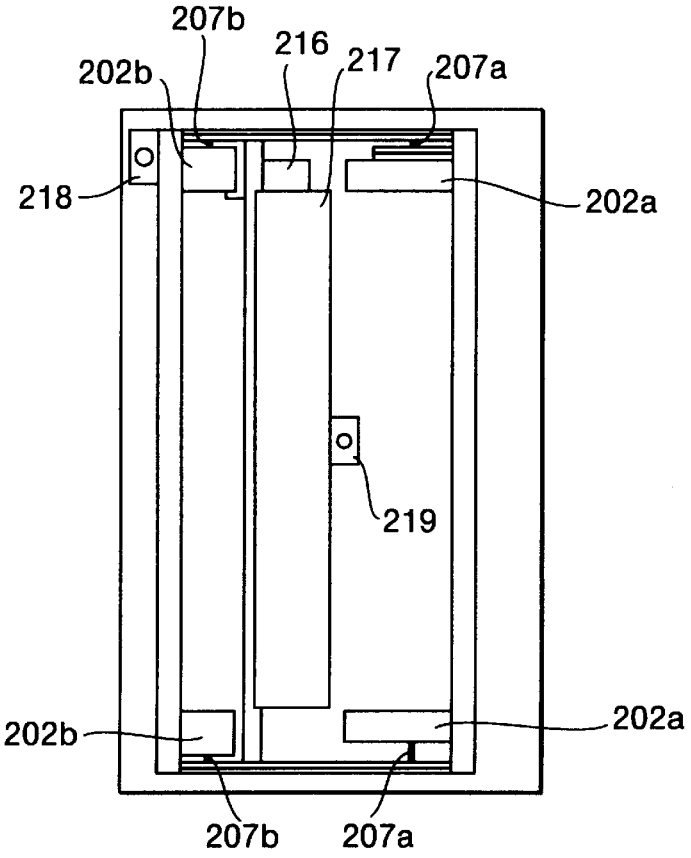
Figure 24:
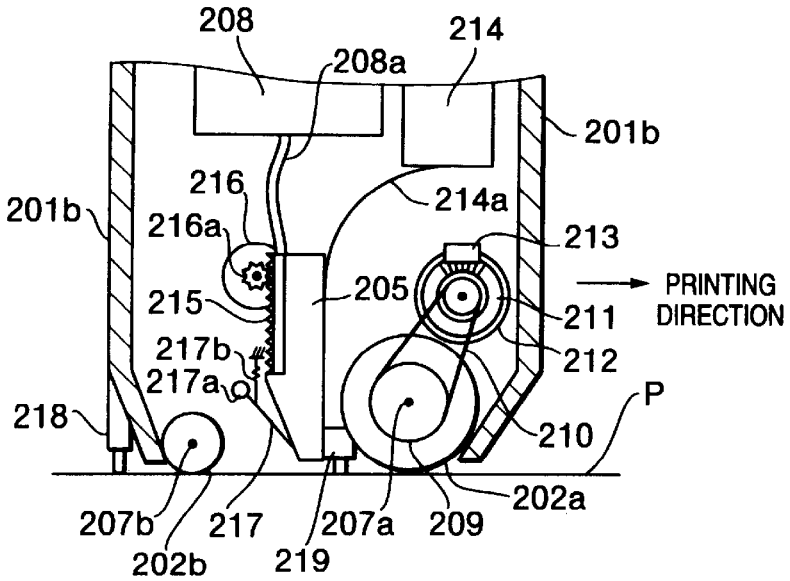
FIG. 24 (*a*) is a cross-sectional view showing internal components of the portable printing device according to the third embodiment during a printing period.
Figure 24:
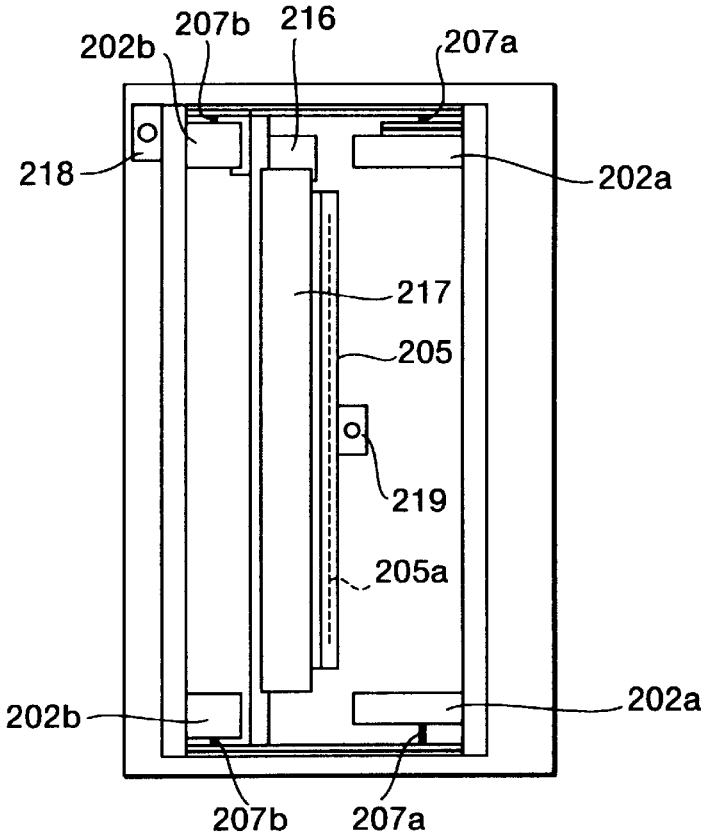

FIG. 23 (*a*)is a cross-sectional view showing internal components of the portable printing device 201 during non-printing periods. FIG. 23 (*b*) is a bottom view showing the portable printing device 201. FIG. 24 (*a*)is a cross-sectional view showing internal components of the portable printing device 201 in the vicinity of the print medium P during printing periods. FIG. 24 (*b*) is a bottom view showing the portable printing device 201 during printing periods. The front and rear rollers 202*a*, 202*b* are freely rotatably disposed about shafts 207*a*, 207*b* attached to the bottom edge of the case 201*b*.

A pulley 209 is attached to the same shaft 207*a* as the front roller 202*a* so that the pulley 209 rotates in association with rotation of the front roller 202*a*. An encoder 211 having a rotational disk 212 is disposed above the front roller 202*a*. A belt 210 is wrapped around the pulley 209 and the pulley of the encoder 211 so that rotational force of the front roller 202*a* is transmitted to the rotational disk 212. The rotational disk 212 is formed with slits on its periphery at an equidistant interval. A photosensor 213 is disposed so as to sandwich the rotational disk 212. The photosensor 213 reads the slits in the rotational disk 212 and generates on and off signals accordingly. In other words, rotation of the rotational disk 212 is converted into an electric pulse signal which represents the rotational speed of the front roller 202*a*, that is, relative position between the print head 205 and the print medium P. The electric pulse signal is inputted into a control portion 214, to be described later. Also, the photosensor 213 is configured to detect rotational direction of the front roller 202*a*.

The print head 205 is disposed to the rear of the front roller 202*a* with respect to the printing direction. An ink tank 208 for supplying ink to the print head 205 is disposed above the print head 205. An ink tube 208*a* connects the ink tank 208 with the print head 205 in order to supply ink from the ink tank 208 to the print head 205.

The control portion 214 is disposed above the encoder 211. The control portion 214 includes a CPU 221 (to be described later) for controlling detection operations by the photosensor 213 and for controlling an interface provided for receiving print data. A flexible print circuit (FPC) 214*a* is provided for transmitting print control signals from the control portion 214 to the print head 205.

A plurality of nozzles 205*a* are formed on the front surface of the print head 205. The row of nozzles 205*a* extends in a direction perpendicular to the printing direction to a predetermined width, which determines a maximum width of the printing region of the portable printing device 201. As shown in FIG. 23 (*a*), the front roller 202*a* is disposed in front of the print head 205 with respect to the print direction and the rear roller 202*b* is disposed behind the print head 205 with respect to the print direction. It should be noted that the portions of the front and rear rollers 202*a*, 202*b* which come in contact with the print medium P during printing are outside of the maximum print region enabled by the length and orientation with the plurality of nozzles 205*a*.

A rack 215 is provided on the print head 205. A motor 216 having a pinion 216*a* provided on its rotational shaft is disposed adjacent to the print head 205 so that the rack 215 and the pinion 216*a* are in meshing engagement with each other. With this configuration, when the motor 216 is rotated, drive force from the motor is transmitted to the rack 215 via the pinion 216*a* so that the print head 205 can be raised and lowered with respect to the case 201*b*. A shutter 217 is provided adjacent to the print head 205 so as to be freely pivotable about a rotational shaft 217*a*. The shutter 217 is formed with a greater width than the width of the portion of the print head 205 confronting the print medium P. A spring 217*b* is provided for urging the shutter 217 upward. As shown in FIG. 23 (*a*), the print head 205 is in its raised position and covered by the shutter 217 during non-printing periods. As shown in FIG. 24 (*a*), when the print head 205 is in its lowered position during printing periods, the shutter 217 is retracted out of the pathway of the print head 205.

A print medium detection switch 218 is provided to the case 201*b* at a position confronting the print medium P. The print medium detection switch 218 detects whether or not the portable printing device 201 is in contact with the print medium P. A position detection switch 219 for detecting whether or not the print head 205 is in its lowered position so that printing is capable is provided to the print head 205 at a position in confrontation with the print medium P.

Next, an explanation will be provided for a mechanism for moving the shutter 217. This mechanism includes the motor 216, the rotational shaft 217*a*, and the spring 217*b*. As shown in FIG. 23 (*a*), during non-printing periods of the portable printing device 201, the spring 217*b* urges the shutter 217 to cover the nozzles 205*a* of the print head 205. When the user places the portable printing device 201 against the print medium P in order to start printing operations, then the print medium detection switch 218 will be turned on so that the motor 216 is driven. The motor 216 will continue to be driven until the position detection switch 219 is pressed against the print sheet P and turned on by downward movement of the print head 205. As shown in FIG. 24 (*a*), when the print head 205 first starts to move downward, the shutter 217 is pressed downward by the print head 205 so that it pivots about the rotational shaft 217*a* into a position retracted away from the pathway of the print head 205.

With this configuration, during non-printing periods, the spring 217*b* urges the shutter 217 to cover and protect the print head 205. Therefore, even if the portable printing device 201 is shocked by collision with some other object, the print head 205 will not be damaged and the area around the portable printing device 201 will not be stained by ink. Because the print head 205 is raised up during non-printing periods, a large gap is formed between the print head 205 and the print medium P during non-printing periods. Because such a large gap is formed, a thick shutter 217 can be used so that it is easier to increase the strength of shutter 217. Further, it is easier to design the shutter 217 itself and the mechanism for moving the shutter 217. Because there is no need to provide a separate motor or other drive means for opening and closing the shutter 217, the shutter 217 and related mechanisms can have a simple configuration and be produced at low cost.

During non-printing periods, the print head 205 is raised into its upper position and the shutter 217 covers the print head 205. At this time, the print head 205 will be lowered so that printing is possible only when the print medium detection switch 218 detects that the print medium P is in confrontation with the print head 205. Therefore, the print head 205 will be sufficiently protected during non-printing periods. Further, the position detection switch 219 ensures that the lowermost position of the print head 205 is fixed to a predetermined position. Therefore, the user need not trouble him or herself to position the print head 205 at a predetermined vertical position. Because the print head 205 is lowered until the position detection switch 219 contacts the print medium P, the gap between the print head 205 and the print medium P during printing periods can be fixed to a set distance so that printing can be stably performed.

Figure 25:
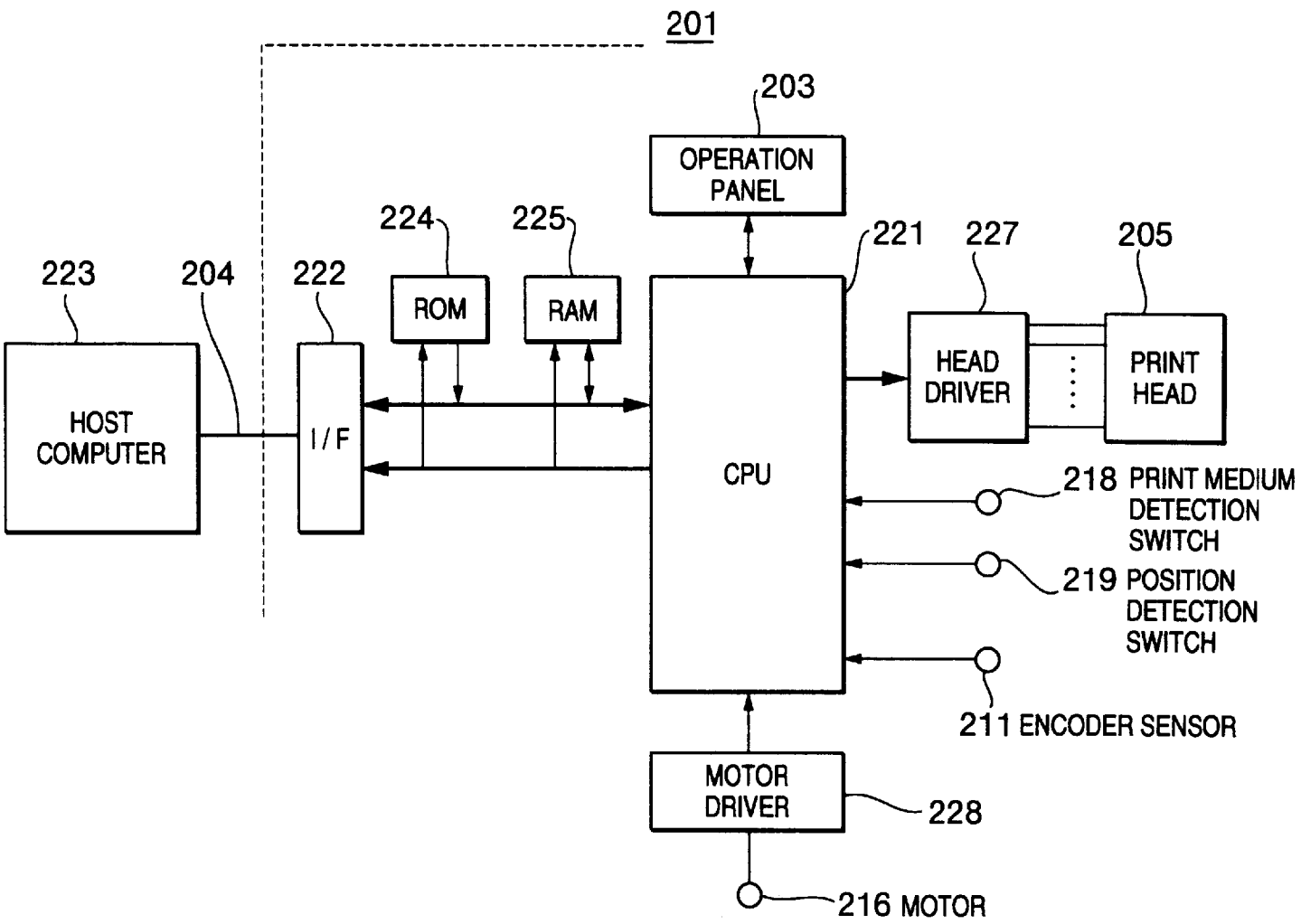
FIG. 25 is a block diagram showing a control system of the portable printing device according to the third embodiment.

FIG. 25 is a block diagram showing a control system of the portable printing device 201. The CPU 221 is provided for controlling overall operations of the portable printing device 201. The CPU 221 is connected to a variety of components such as: an interface portion 222 for connecting the CPU 221 with a host computer 223; a ROM 224 storing control programs for controlling the various components according to predetermined programs; a RAM 225 for storing print data inputted over the interface portion 222 from the host computer 223; and the operation panel 203, which includes operation switches and the like. Pulse signals from the encoder 211 for measuring rotational speed and direction of the front roller 202*a* and detection signals from the print medium detection switch 218 and the position detection switch 219 are inputted to the CPU 221, which uses the detection signals and the pulse signal to drive a head driver 227 for driving the print head 205 and a motor driver 228 for driving the motor 216.

Next, an explanation will be provided for printing operations of the portable printing device 201. The portable printing device 201 operates according to predetermined programs stored in the ROM 224. The CPU 221 performs input of print data when the operation panel 203 is operated to select a print mode of the portable printing device 201. At this time, print data from the host computer 223 is inputted to the CPU 221 through the interface portion 222 and temporarily stored in the RAM 225. A print start signal is inputted to the CPU 221 when the user operates an appropriate switch on the operation panel 203. When the CPU 221 receives this print start signal, after the CPU 221 determines that print data is stored in the RAM 225, it places the portable printing device 201 in a print standby mode.

At this time, the CPU 221 determines whether or not the rotational disk 212 of the encoder 211 has rotated or not. When the CPU 221 determines that the rotational disk 212 has rotated, the CPU 221 outputs the print data in association with rotational amount of the front roller 202*a* and drives the print head 205 to print on the print medium P. The CPU 221 outputs the print data in accordance with rotational amount of the front roller 202*a*. Accordingly, even if the user does not scan the case 201*b* at a uniform speed across the surface of the print medium P, stable printing can be performed on the print medium P.

Figure 26:
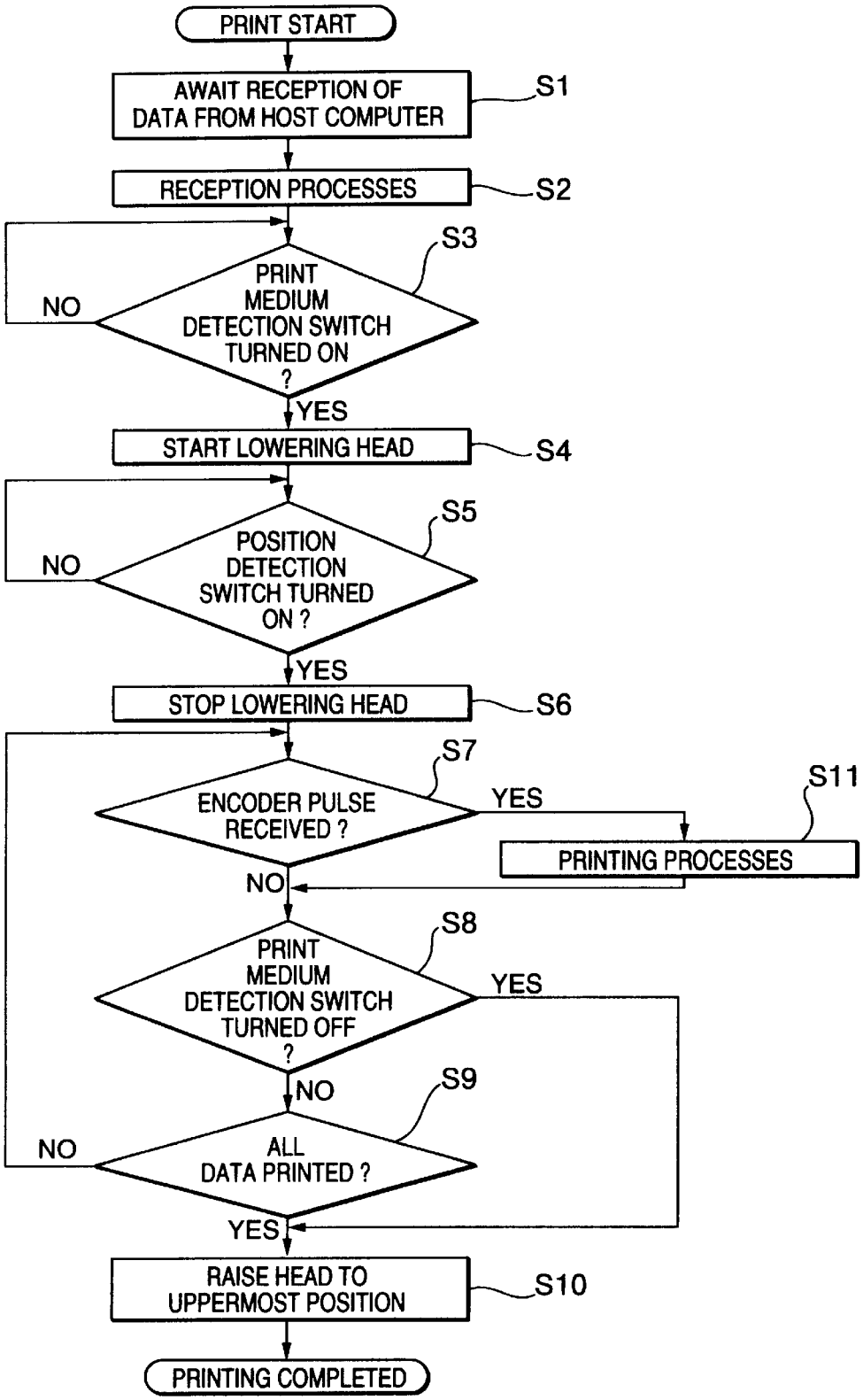
FIG. 26 is a flowchart represents a print program for controlling the portable printing device according to the third embodiment.

Next, while referring to the flowchart shown in FIG. 26, an explanation will be provided for printing operations performed by the CPU 221 and for protective operations performed by the shutter 217 to the print head 205. In S1, the CPU 221 awaits reception of print data from the host computer 223. Upon receiving the print data, the CPU 221 processes the reception signal in S2. In S3, the CPU 221 determines whether or not the print medium detection switch 218 is on. When the user places the portable printing device 201 on the print medium P, the print medium detection switch 218 will turn on, resulting in a positive determination in S3. Next, the CPU 221 controls the motor 216 to lower the print head 205 in S4. Next, the CPU 221 determines in S5 whether or not the position detection switch 219 is turned on. When the print head 205 reaches the position wherein printing is possible, then the position detection switch 219 contacts the print medium P and turns on, resulting in a positive determination in S5. Next in S6, the CPU 221 stops the motor 216 so that operations for lowering the print head 205 stop. Next in S7, the CPU 221 determines whether or not a pulse signal is received from the encoder 211. When the user manually scans portable printing device 201 across the print medium P so that the encoder 211 outputs the pulse signal (S7:YES), then in S11, printing processes are performed. When the CPU 221 detects no pulse signal from the encoder 211 (S7:NO) or after a printing process is performed in S11, then in S8, the CPU 221 determines whether or not the print medium detection switch 218 has turned off. If so (S8:YES), then the CPU 221 determines that print operations have stopped, and so in S10 drives the motor 216 to raise the print head 205 into its uppermost position. At this time, the shutter 217 will cover the print head 205 and printing operations are completed. When the print medium detection switch 218 is not turned off (S8:NO), then the CPU 221 determines in S9 whether or not any print data remains unprinted. If some print data remains unprinted (S9:NO), then the program returns to S7 and repeats operations in S8, S9, and S11 until all the data has been printed (S9:YES), whereupon the program proceeds to S10. This ends the printing processes.

As a result of these processes, when the user stops scanning the portable printing device 201 across the print medium P and lifts the portable printing device 201 away from the print medium P, then even if the printing processes are not completed, the print head 205 will automatically be raised up and covered and protected by the shutter 217. Also, even when all print data has been printed and the portable printing device 201 is in a non-printing condition, even if the user does not lift the portable printing device 201 away from the print medium P, again the print head 205 will be automatically raised up and covered and protected by the shutter 217.

Various changes and modifications may be made to the configuration described in the third embodiment. For example, the pivotable shutter described in the third embodiment can be replaced by a sliding type shutter which slides in the horizontal direction. In this case, movement of the print head can be converted into a sliding force of the shutter by using a cam or other conversion mechanism.

Next, a fourth embodiment of the present invention will be described while referring to FIGS. 27 to 36.

Figure 27:
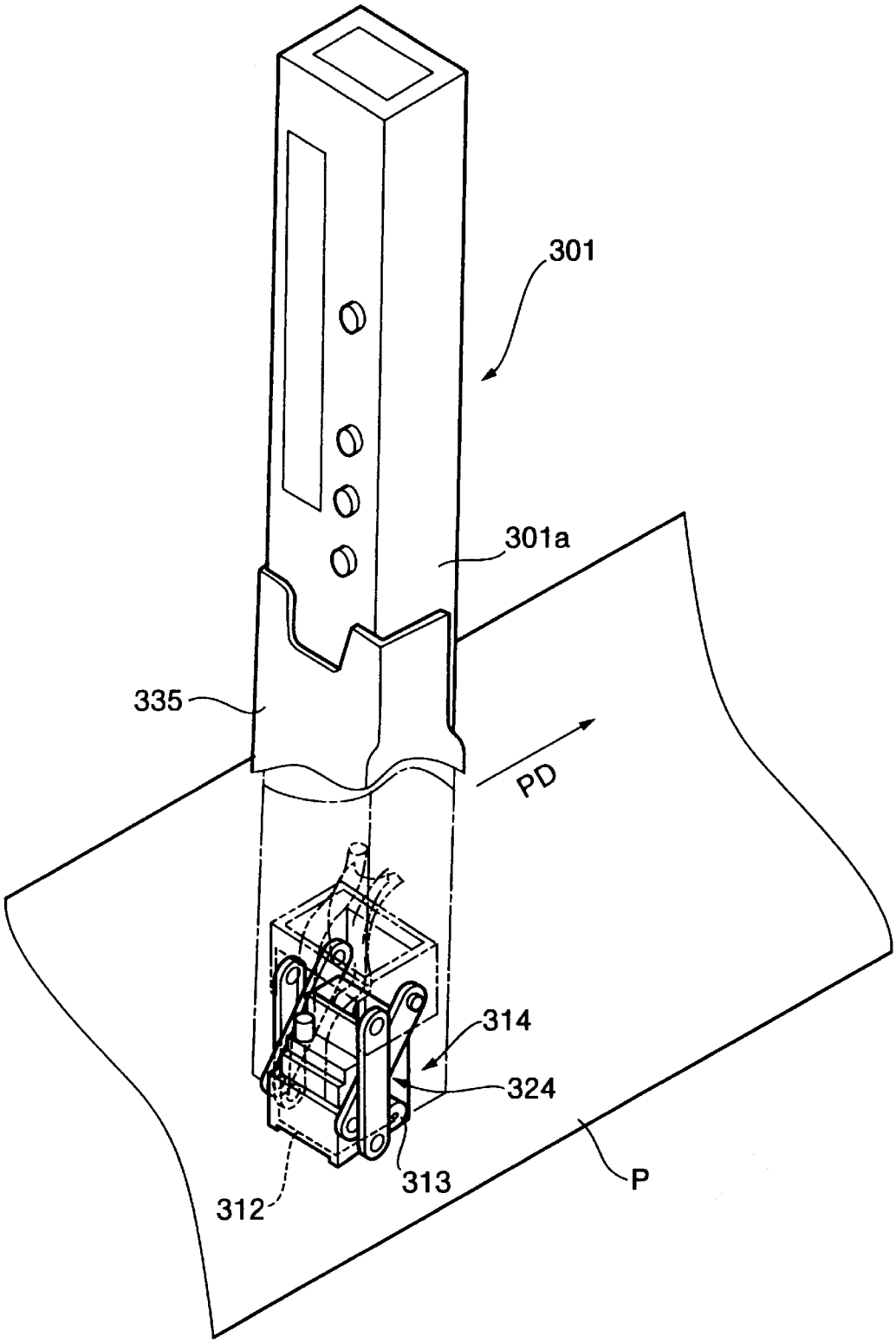
FIG. 27 is a perspective view showing a portable printing device according to a fourth embodiment during a printing period.

FIG. 27 is a perspective view showing a portable printing device 301 of the fourth embodiment in a printing condition wherein printing operations can be performed. The portable printing device 301 is an ink jet portable printing device capable of printing on a print medium P, such as paper by being scanned across the print medium P. The portable printing device 301 includes a case 301*a* and a head unit 314 disposed at a lower end of the case 301*a*. The head unit 314 includes a print head 312 for printing by ejecting ink droplets and a roller 313 for scanning the portable printing device 301 across the surface of the print medium P. A cap 335 for protecting the head unit 314 during non-printing times is provided to the case 301*a*. When printing is to be performed using the portable printing device 301, then as shown in FIG. 27, the user places the portable printing device 301 at a desired print start position on the print medium P. The user then scans the portable printing device 301 in a direction indicated by an arrow in FIG. 27. Ink is ejected from the print head 312 in accordance with scanning movement of the portable printing device 301 so that printing can be performed on the print medium P.

Figure 28:
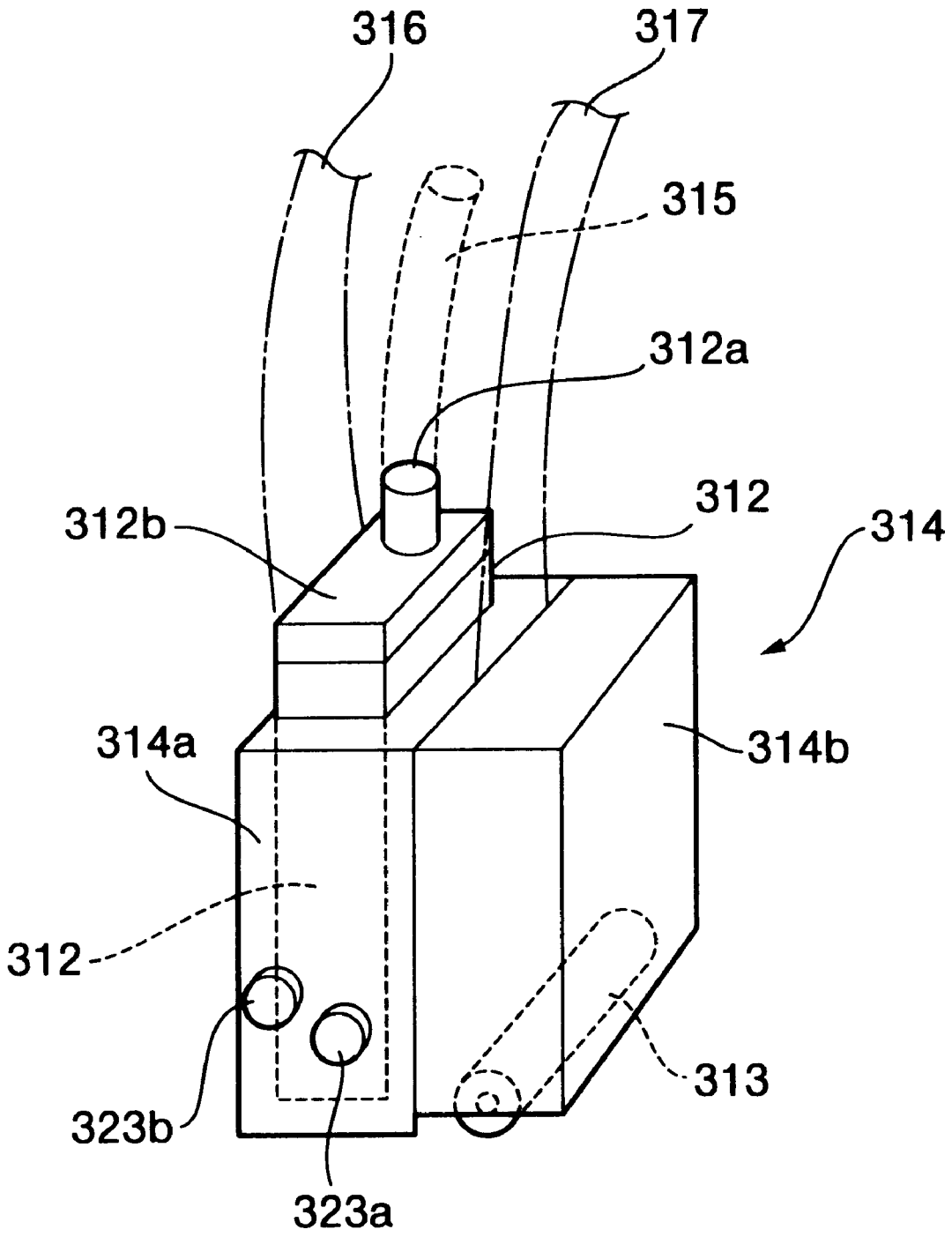
FIG. 28 (*a*) is a perspective view showing configuration of a head unit of the portable printing device according to the fourth embodiment.
Figure 28:
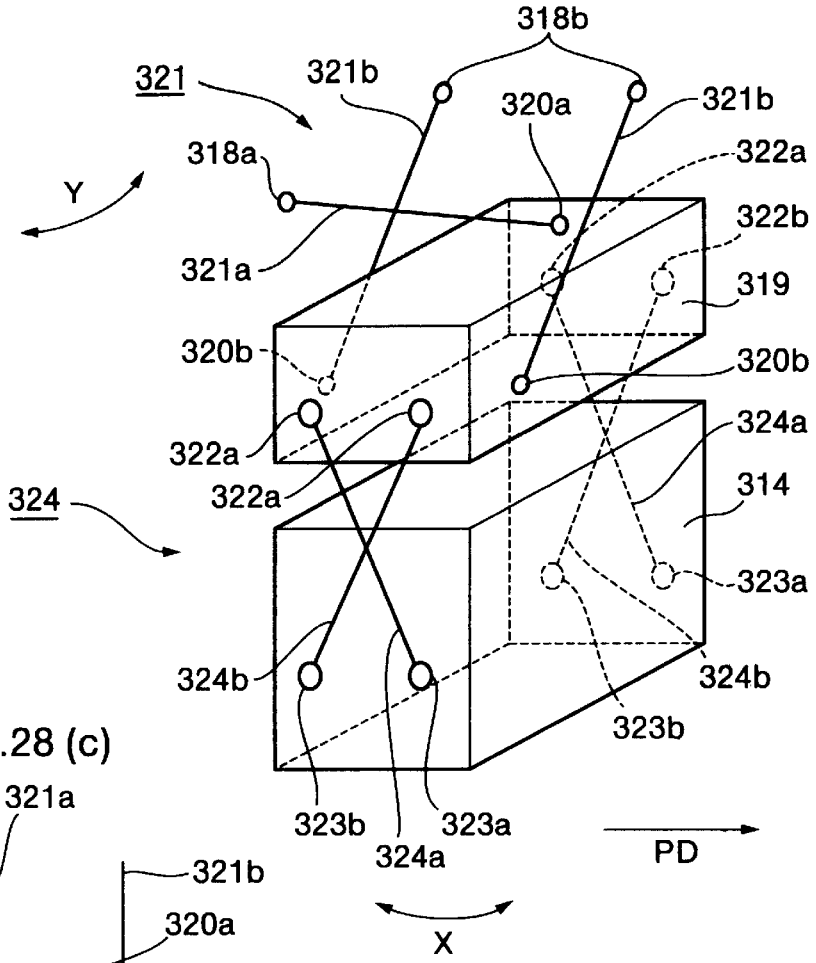
Figure 28:
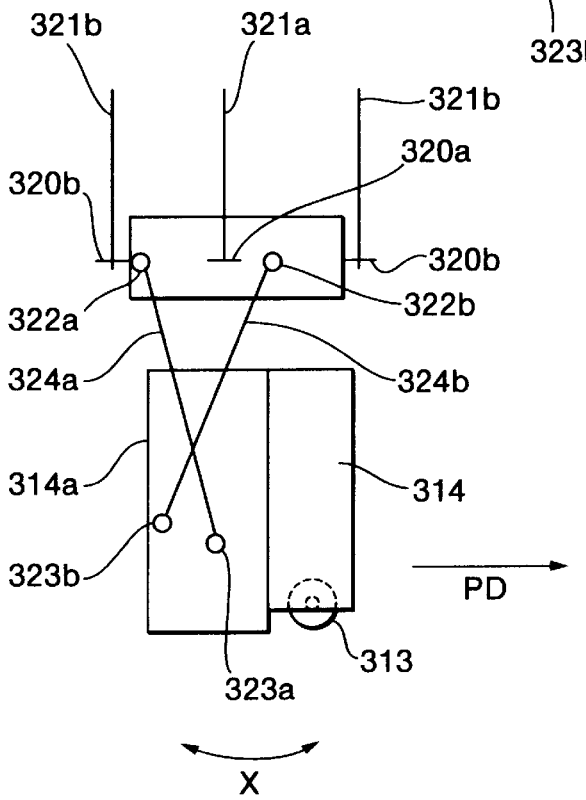

Here, the head unit 314 will be described while referring to FIG. 28 (*a*). FIG. 28 (*a*) is a perspective view schematically showing configuration of the head unit 314. The head unit 314 includes: a head holder 314*a* for supporting the print head 312; and an encoder unit 314*b* supporting the roller 313 and having an internally provided encoder for detecting rotation amount of the roller 313. The lower surface of the head holder 314*a* and the roller 313 support the print head 312 so as to maintain a fixed gap between the print head 312 and the print medium P.

The print head 312 is provided at its upper surface with a manifold 312*b* and a connection portion 312*a* connected to the manifold 312*b*. An ink supply tube 315 for supplying ink from an ink cartridge (not shown in the drawings) to the print head 312 is connected to the connection portion 312*a*. Ink supplied by the ink supply tube 315 is supplied to the print head 312 through the manifold 312*b*. A flexible printing circuit (FPC) 316 for inputting control signals from a control portion (not shown in the drawings) is connected to the print head 312. The FPC 317 is provided for connecting the control portion, which is provided for performing overall control of the portable printing device 301, to the encoder internally provided to the encoder unit 314*b*. Shafts 323*a*, 323*b* for attaching the second link mechanism 324 to the head holder 314*a* are provided to the head holder 314*a*.

Next, an explanation will be provided for a first and second link mechanisms 321, 324 while referring to FIGS. 28 (*b*) and 28 (*c*), wherein FIG. 28 (*b*) is a perspective view schematically showing the first and second link mechanisms 321, 324 and FIG. 28 (*c*) is a side view of the link mechanisms 321,324 shown in FIG. 28 (*b*).

As shown in FIG. 28 (*b*), a holder 319 is disposed above the head unit 314. The first link mechanism 321 is provided for connecting the holder 319 to the case 301*a*. The second link mechanism 324 is provided for connecting the holder 319 and the head unit 314. The first and second link mechanisms 321, 324 connect the head unit 314 swingable with respect to the case 301*a* in directions X and Y, which are perpendicular to the scanning direction, so that even if a user holds the case 301*a* tilted at an angle, the head unit 314 will remain in a fixed posture with respect to the print medium P. In other words, the first and second link mechanisms 321, 324 enable proper printing regardless of the posture of the case 301*a*.

The first link mechanism 321 includes three arms: a pair of arms 321*b*; and a single arm 321*a* disposed in a cross configuration with the pair of arms 321*b*. Shafts 318*b* are disposed on the confronting surface at the interior of the case 301*a*. Further, shafts 320*b* are provided on side surfaces of the holder 319 in confrontation with the interior wall of the case 301*a*. Each of the pair of arms 321*b* are freely pivotably disposed at one end on one of the shafts 318*b* and at the other end on the one of the shafts 320*b*. On the other hand, the arm 321*a* is connected at one end to a shaft 318*a* at the interior surface of the case 301*a* and at the other end to a shaft 320*a* connected to the upper surface of the holder 319.

The second link mechanism 324 includes two sets of intersecting arms 324*a,* 324*b* disposed at opposite sides of the holder 319 and the head holder 314. Two shafts 324*a,* 324*b,* on which one end of each of the arms 324*a,* 324*b* are freely pivotably disposed, are provided on each opposite side of the holder 319. Similarly, the two shafts 323*a,* 323*b* on which the other end of the arms 324*a,* 324*b* are freely pivotably disposed, are provided on each of the opposite ends of the head unit 314.

In summary, the arms 321*b,* 321*b* of the first link mechanism 321, which connects the holder 319 to the case 301*a*, are disposed on side surfaces of the case 301*a* and the holder 319 that face in the scanning direction of the portable printing device 301. On the other hand, the arms 324*a,* 324*b* of the second link mechanism 324, which connects the holder 319 and the head unit 314, are disposed on side surfaces of the head unit 314 and the holder 319 that face in a direction perpendicular to the scanning direction of the portable printing device 301. With this configuration, the first link mechanism 321 enables the case 301*a* to swing in a direction Y shown in FIG. 28 (*b*) with respect to the print medium P. Similarly, the second link mechanism 324 enables the case 301*a* to swing in a direction X, which is the printing direction, with respect to the print medium P.

Figure 29:
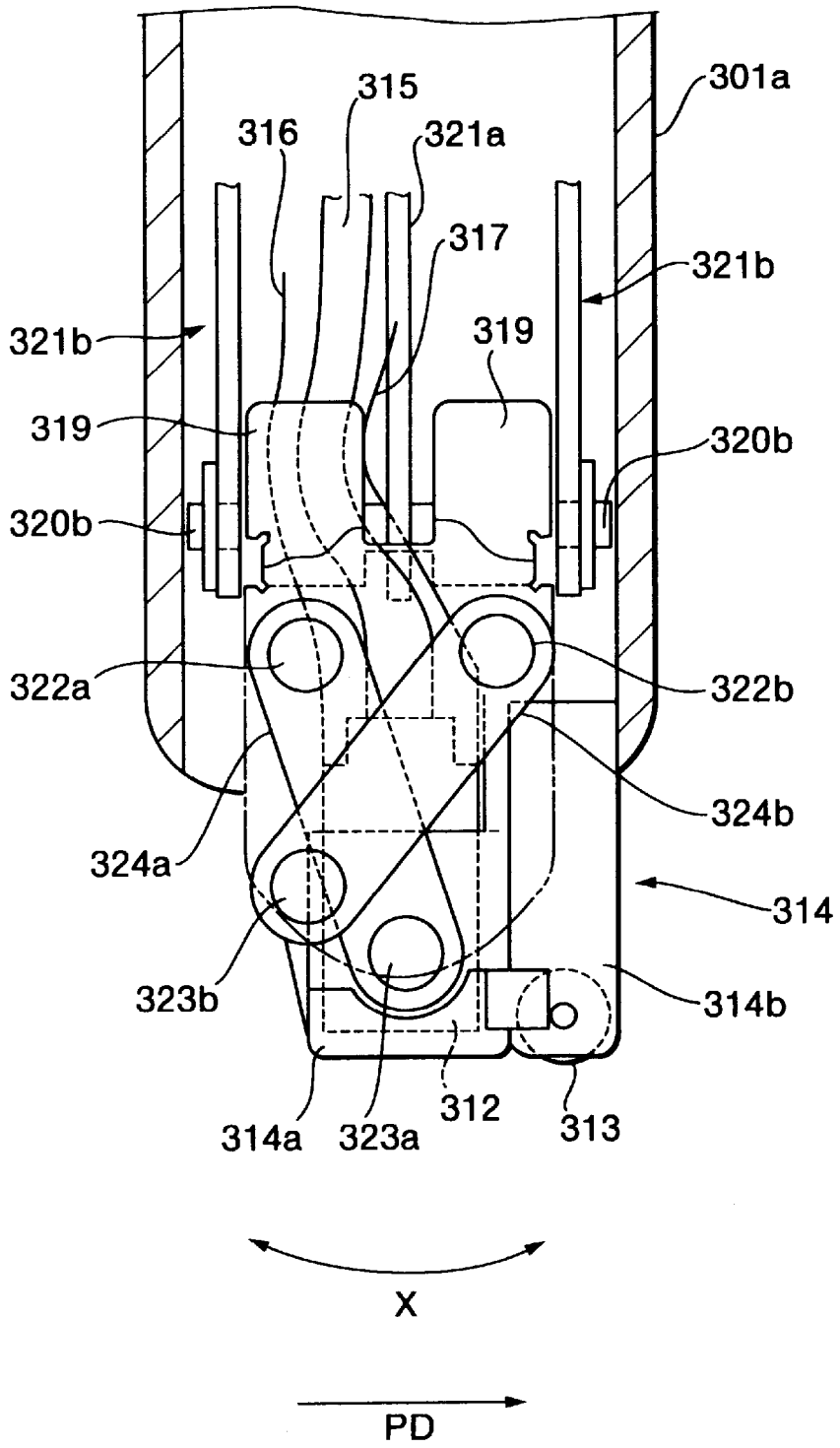
FIG. 29 is a cross-sectional view showing the head unit and the case according to the fourth embodiment when parallel with each other.
Figure 30:
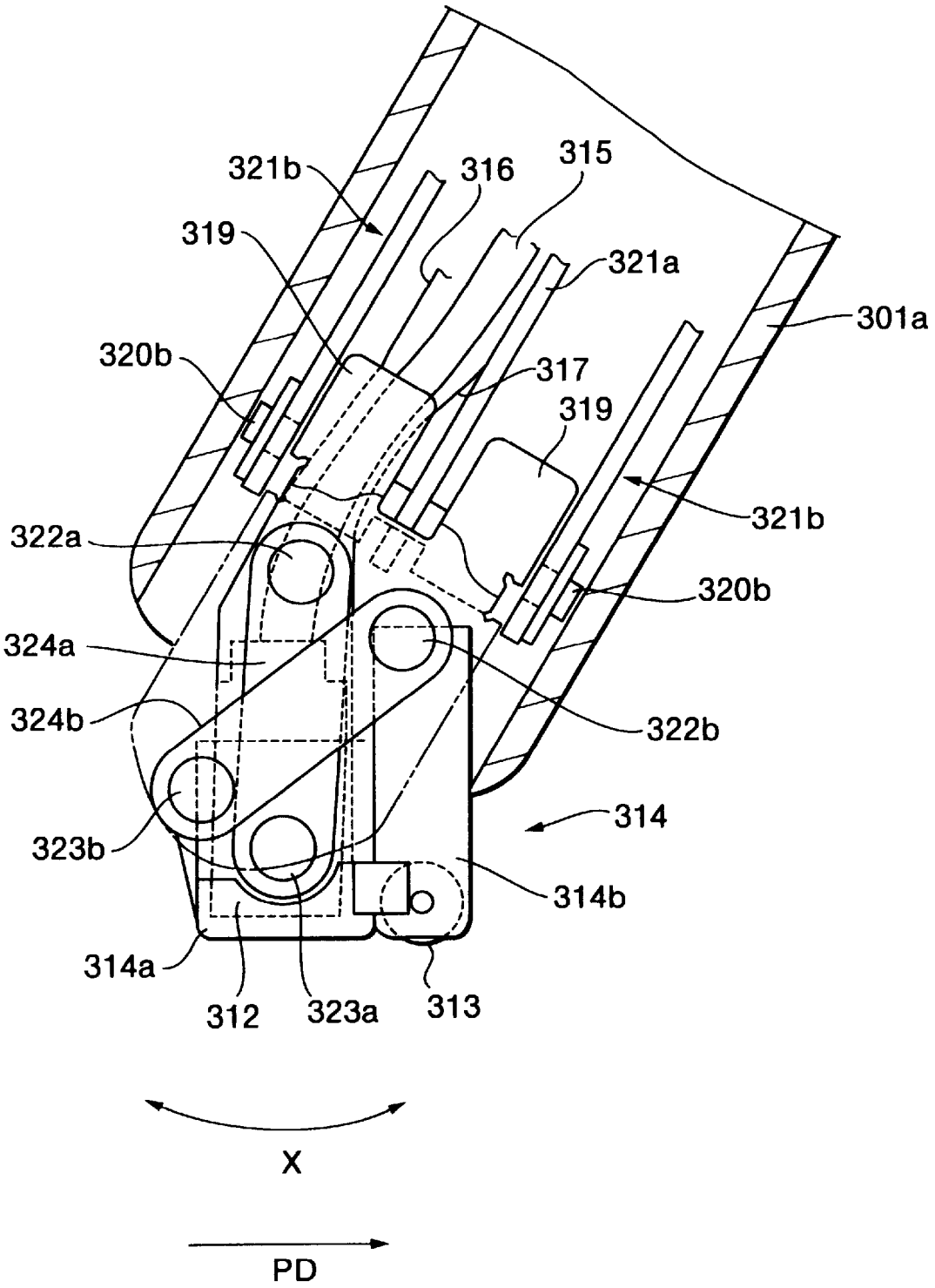
FIG. 30 is a cross-sectional view showing the head unit and the case according to the fourth embodiment when the case is tilted a printing direction.
Figure 31:
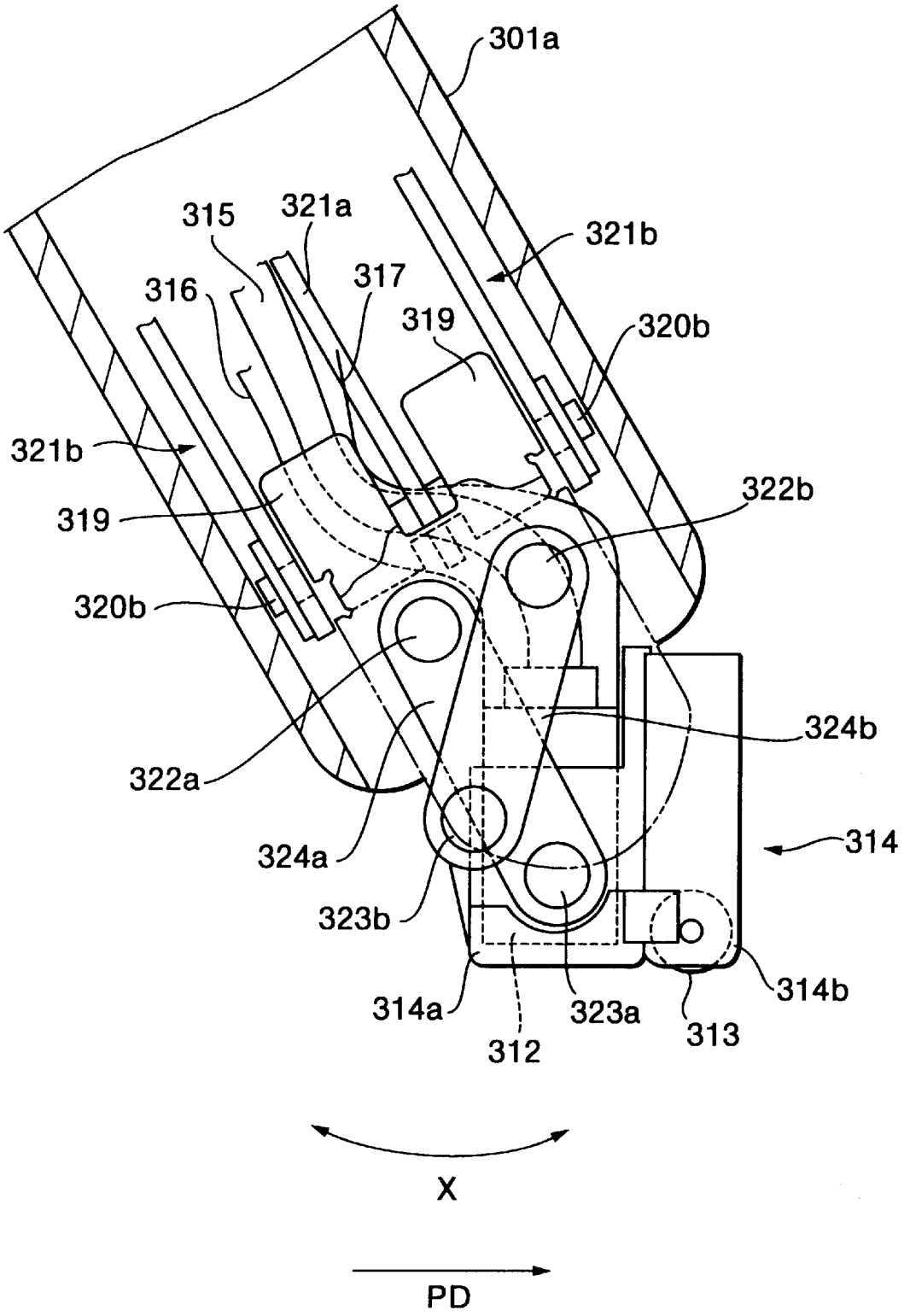
FIG. 31 is a cross-sectional view showing the head unit and the case according to the fourth embodiment when the case is tilted in a direction opposite to the printing direction.

Next, while referring to FIGS. 29 to 31, an explanation will be provided for swinging operation of the head unit 314 with respect to the holder 319 as enabled by the second link mechanism 324. FIG. 29 is a cross-sectional view showing the head unit 314 when not swinging. FIG. 30 is a cross-sectional view showing the head unit 314 when swinging in the printing direction. FIG. 31 is a cross-sectional view showing the head unit 314 when swinging in a direction opposite to the printing direction.

As described above, the link mechanism 324 includes two sets of arms 324*a,* 324*b* arranged so as to cross over each other. Normally, that is, when no force is applied to the case 301*a* in either the printing direction or the direction opposite to the printing direction, then, as shown in FIG. 29, the arms 324*a,* 324*b* support the head unit 314 in to a position parallel with the case 301*a*.

When force is applied with respect to the case 301*a* in the printing direction, then the arms 324*a* will pivot in a counterclockwise direction, that is, as viewed in FIG. 29, around the shafts 322*a* and the arms 324*b* will pivot in the counterclockwise direction around the shafts 322*b*. As a result, as shown in FIG. 30, the case 301*a* is tilted in the printing direction while the head unit 314 is maintained in an appropriate posture with respect to the print medium P. Said differently, the head unit 314 will swing In the printing direction with respect to the holder 319.

On the other hand, when pressure is applied to the case 301*a* in the direction opposite to the printing direction, the arms 324*a* will pivot in the clockwise direction as viewed in FIG. 29 around the shafts 322*a* and the arms 324*b* will pivot in the clockwise direction around the shafts 322*b*. As a result, as shown in FIG. 31, the case 301*a* is tilted in the direction opposite to the printing direction while maintaining the head unit 314 in an appropriate posture with respect to the print medium P. Said differently, the head unit 314 will swing in the direction opposite to the printing direction with respect to the holder 319. However, at this time, no force is applied in the direction perpendicular to the pivot direction, in which the arms 321*a* and the arms 321*b* pivot, so that the head unit 314 will not swing about the first link mechanism 321, which connects the holder 319 and case 301*a*.

Figure 32:
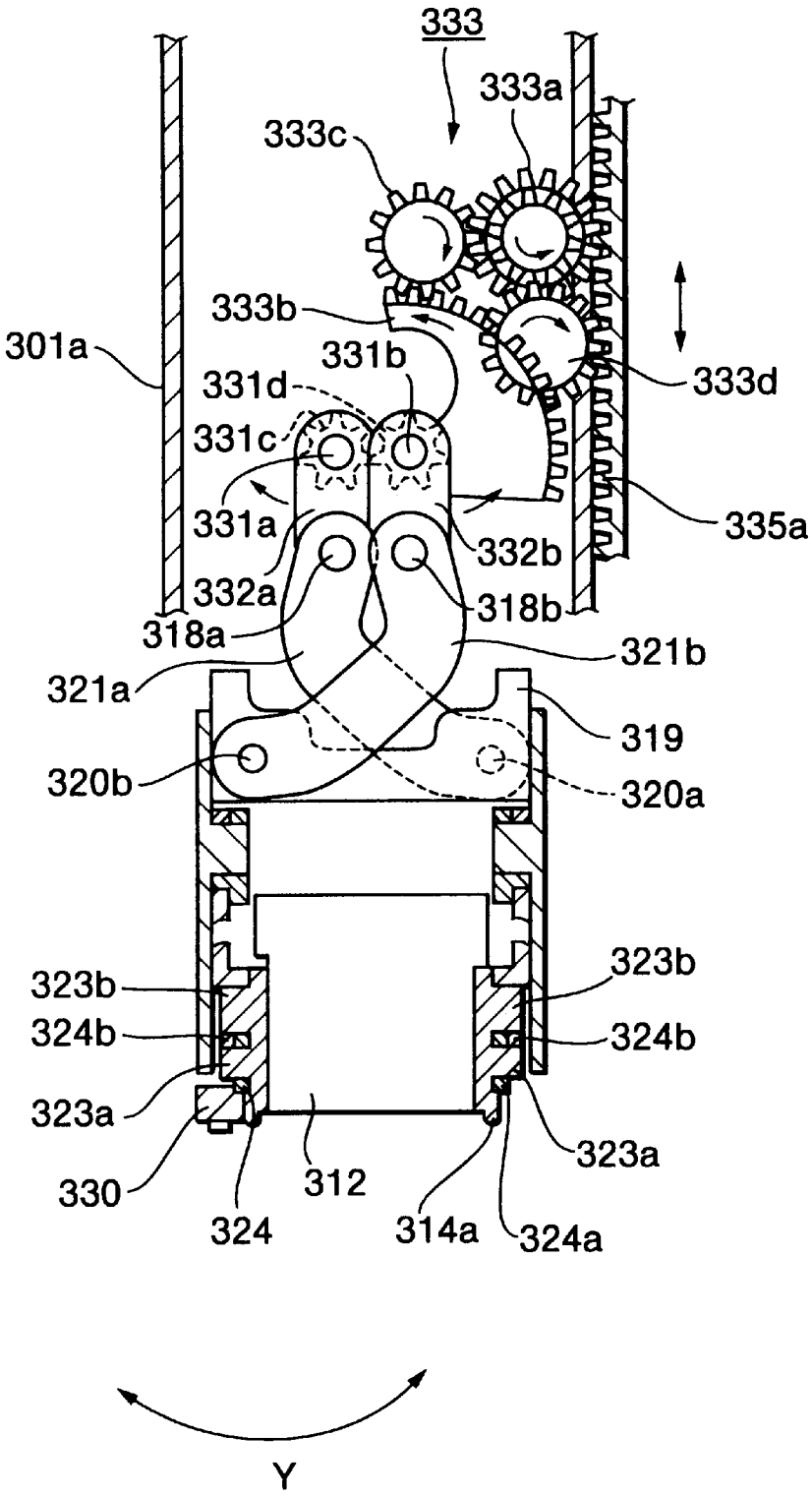
FIG. 32 is a cross-sectional view showing the head unit and a holder according to the fourth embodiment for supporting the head unit when the case is maintained in a vertical posture.
Figure 33:
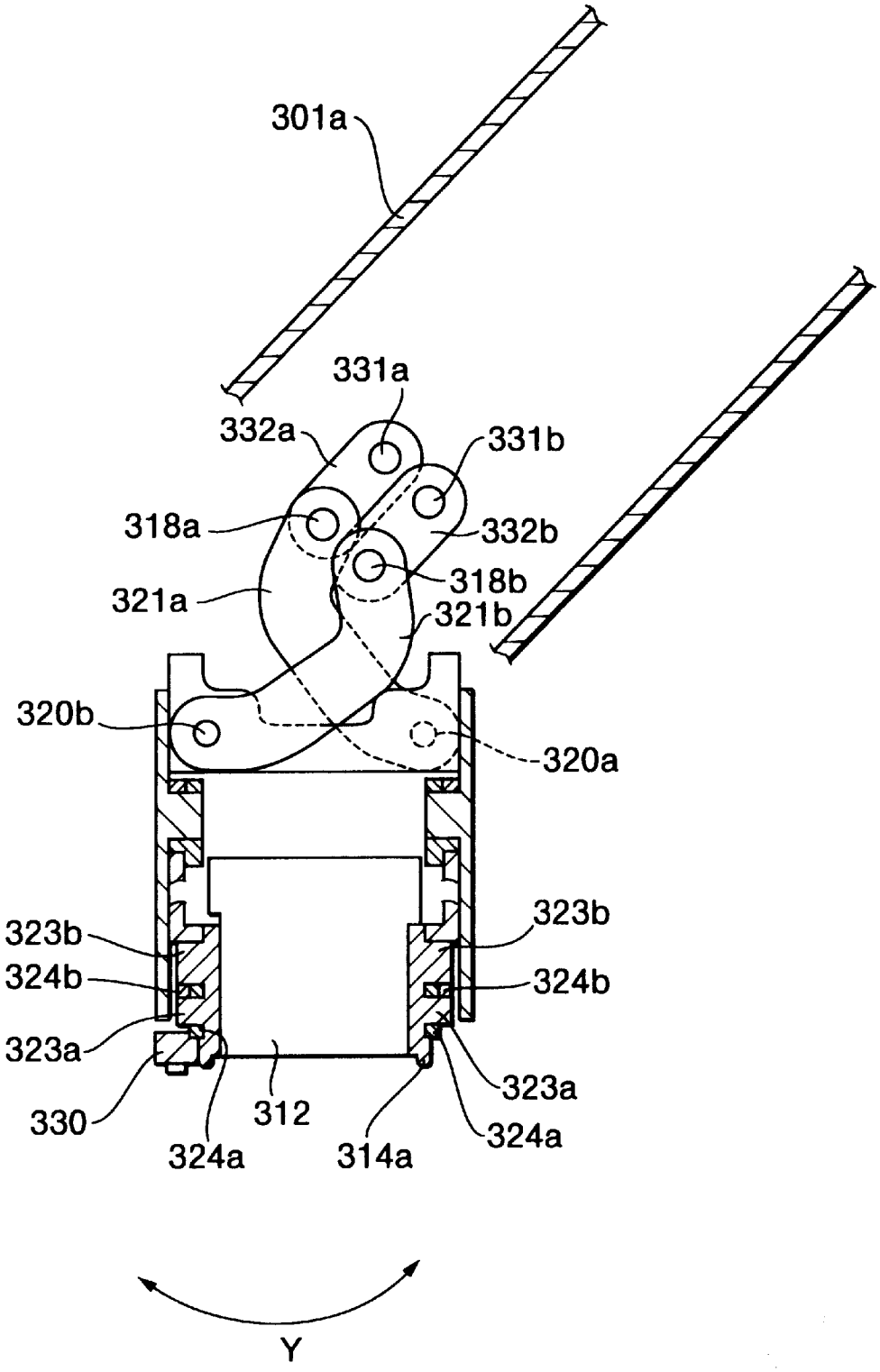
FIG. 33 is a cross-sectional view showing the holder and the head unit when swinging in a direction perpendicular to the printing direction, that is, away from and toward a user of the portable printing device according to the fourth embodiment.

Next, while referring to FIGS. 32 and 33, an explanation will be provided for swinging operations enabled by the first link mechanism 321 for the holder 319 and the head unit 314 with respect to the case 301*a*. FIG. 32 is a cross-sectional view showing the holder 319 and the head unit 314 when not swinging. FIG. 33 is a cross-sectional view showing the holder 319 and the head unit 314 when swinging in the Y direction, that is, the direction perpendicular to the printing direction, or said differently, away from and toward a user of the portable printing device 301.

As described above, the link mechanism 321 includes three arms in a crossed configuration with each other, that is, the pair of arms 321*b* attached to the side surfaces of the holder 319, and the single arm 321*a* attached to the upper surface of the holder 319. When the user does not tilt the case 301*a* either away from or toward him or herself, then as shown in FIG. 32, the arms 321*a,* 321*b* support the holder 319 and the head unit 314 in parallel alignment with the case 301*a*.

From this normal position, when the user tilts the case 301*a* toward him or herself, that is, applies force in the rightward direction as viewed in FIG. 32, then the arm 321*a* will rotate in the counterclockwise direction, as viewed in FIG. 32 around the shaft 318*a* and the arms 321*b* will rotate in the counterclockwise direction around the shafts 318*b*. As a result, as shown in FIG. 33, the case 301*a* will tilt toward the user while the head unit 314 is maintained in a normal posture with respect to the print medium P. Said differently, the holder 319 and the head unit 314 will pivot rightward as viewed in FIG. 33, that is, in the direction toward to the user. At this time, because force is applied in the direction perpendicular to the rotational plane of the arms 324*a,* 324*b,* the head unit 314 will not swing in the X direction about the link mechanism 324, which connects the holder 319 to the head unit 314.

Although not shown in the drawings, when the user tilts the case 301*a* away from him or herself from the normal position, that is, in the leftward direction as viewed in FIG. 32, then the arm 321*a* will pivot in the clockwise direction as viewed in FIG. 32 around the shaft 318*a* and the arms 321*b* will pivot in the clockwise direction around the shaft 318*b*. As a result, the holder 319 and the head unit 314 will swing with respect to the case 301*a* away from the user so that the case 301*a* is tilted away from the user while the head unit 314 is maintained in an appropriate posture with respect to the print medium P. At this time also, the head unit 314 will not swing in the X direction about the link mechanism 324. It should be noted that a detection switch 330 for detecting presence or absence of the print medium P is provided to the left side of the head holder 314*a,* that is, as viewed in FIG. 32.

Figure 34:
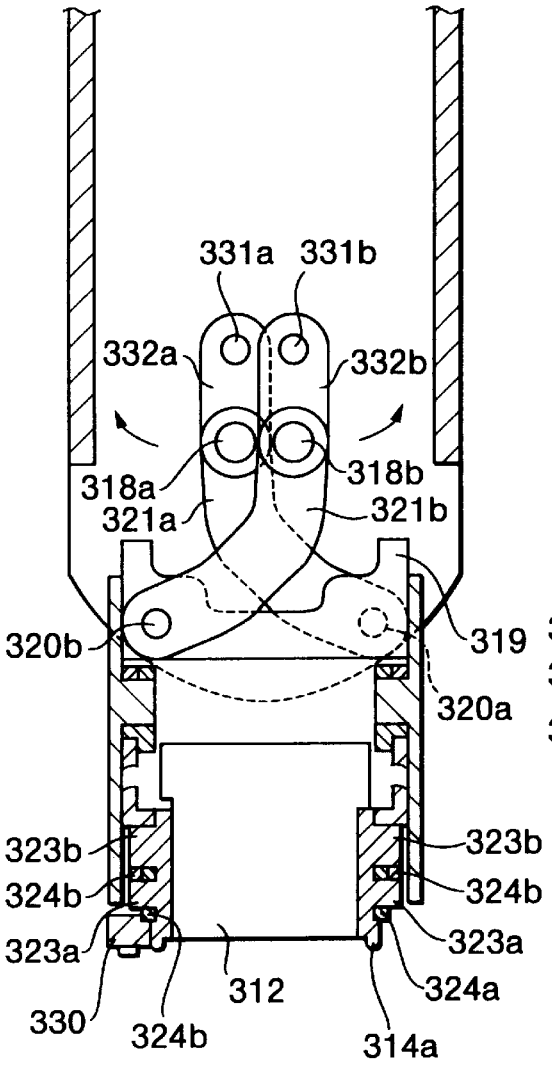
FIG. 34 (*a*) is a cross-sectional view showing the portable printing device according to the fourth embodiment when the head unit is in a printing position.
Figure 34:
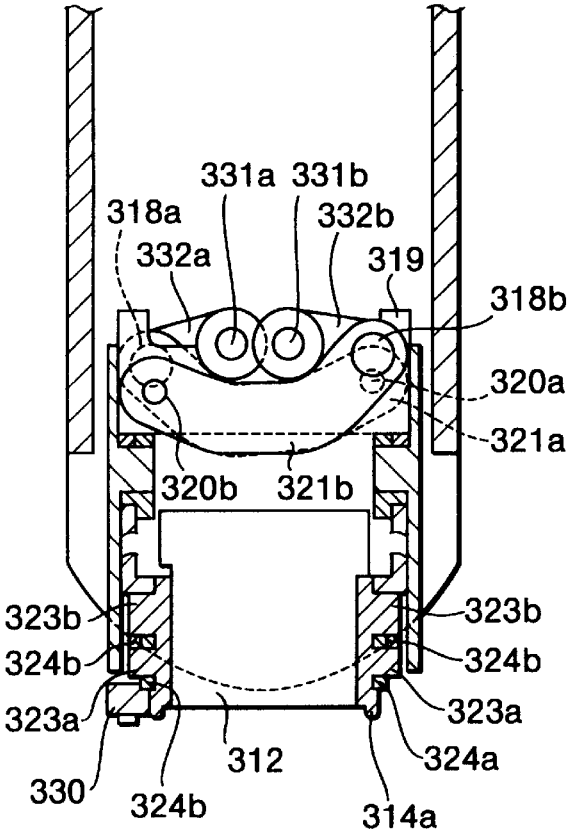
Figure 35:
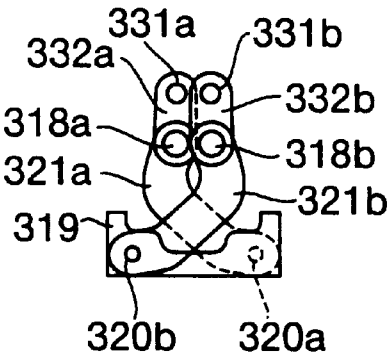
FIGS. 35 (*a*) through 35 (*g*) are side views showing positions of the first link mechanism and its pivot arms when the head unit moves from its printing position to its housed position.
Figure 35:
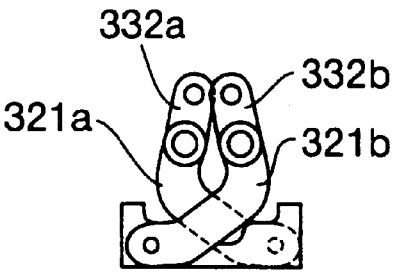
Figure 35:
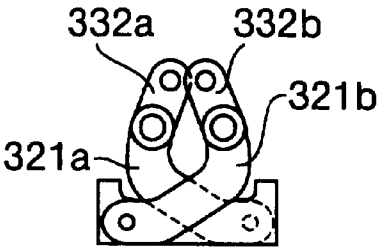
Figure 35:
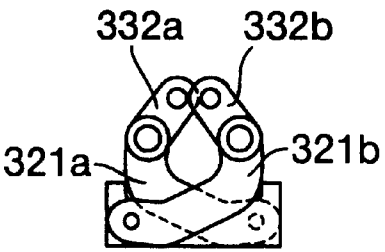
Figure 35:
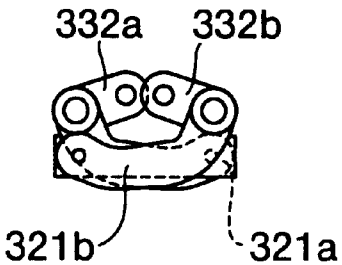
Figure 35:
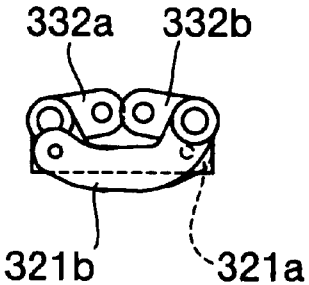
Figure 35:
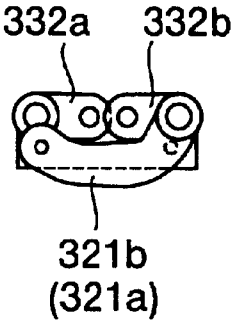

Next, an explanation will be provided for operations for moving the head unit 314 between a printing position and a housed position while referring to FIGS. 32, 34 (*a*), 34 (*b*), and 35 (*a*) through 35 (*g*). FIG. 34 (*a*) is a cross-sectional view showing the portable printing device 301 when the head unit 314 is in the printing position. FIG. 34 (*b*) is a cross-sectional view showing portable printing device 301 when the head unit 314 is in the housed position. FIGS. 35 (*a*) through 35 (*g*) are side views showing positional changes of the link mechanism 321 and pivot arms 332*a,* 332*b* when the head unit 314 moves from its printing position to its housed position.

As shown in FIG. 32, a pair of gears 331*c,* 331*d* in meshing engagement with each other are rotatably disposed about shafts 331*a,* 331*b* above the shafts 318*a,* 318*b* of the first link mechanism 321. The pivot arms 332*a,* 332*b* are disposed so that one end is pivotable in association with rotation of a corresponding one of the shafts 331*a,* 331*b* and so that the other end is freely pivotable about a corresponding one of the shafts 318*a,* 318*b.* In other words, the pivot arms 332*a,* 332*b* link the shafts 331*a,* 331*b* with the shafts 318*a,* 318*b.*

With this configuration, when the gear 331*d* and the shaft 331*b* are rotated in the counterclockwise direction as viewed in FIG. 32, the shaft 331*a* rotates in the counterclockwise direction by meshing engagement between the gears 331*c,* 331*d.* The pivot arms 332*a,* 332*b* pivot in the clockwise direction and the counterclockwise direction, respectively in association with rotational movement of the shafts 331*a,* 331*b.* When pivot arms 332*a,* 3312*b* pivot in this manner, then the arms 321*a,* 321*b,* which are connected to the tips of the pivot arms 332*a,* 332*b,* rotate in the manner indicated in FIGS. 35 (*a*) through 35 (*g*) in association with rotation of the pivot arms 332*a,* 332*b.*

The pivot arms 332*a,* 332*b* are designed to be pivotable to a pivoting angle of 90°. When the pivot arms 332*a,* 332*b* are pivoted to the 90° pivot angle, then the arms 321*a,* 321*b* will be at their maximally raised position shown in FIG. 35 (*g*) so that the holder 319 and the head unit 314, which are linked with the arms 321*a,* 321*b,* are moved by movement of the arms 321*a,* 321*b* from the printing position as shown in FIG. 34 (*a*) to the housed position as shown in FIG. 34 (*b*).

Figure 36:
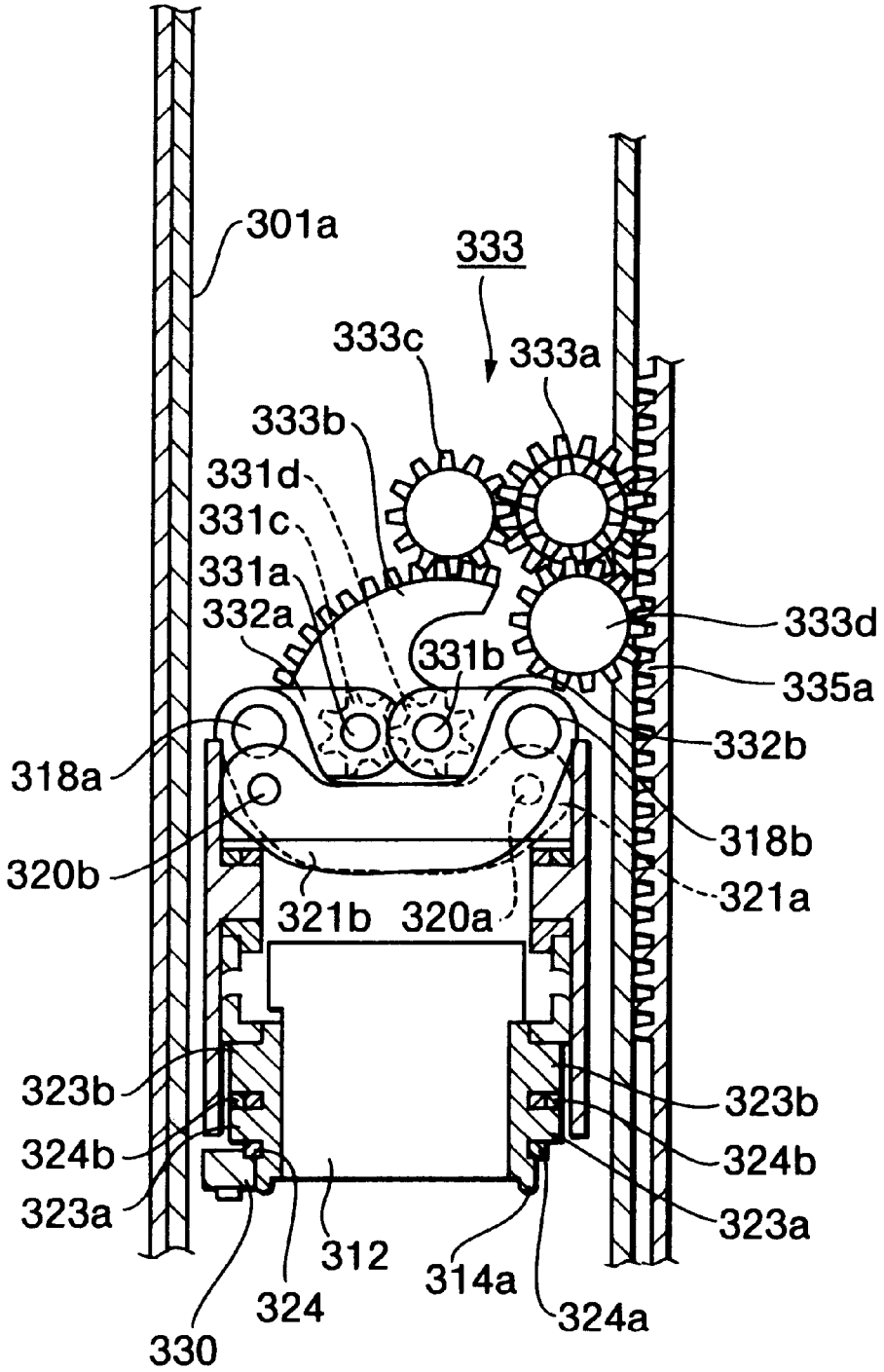
FIG. 36 is a cross-sectional view showing a gear system of the fourth embodiment for operating the first link mechanism when the head unit is in the housed position.

Next, while referring to FIGS. 32 and 36, an explanation will be provided for a gear mechanism 333 for driving rotation of the shaft 332*b*. FIG. 36 is a cross-sectional view showing the portable printing device 301 and the gear mechanism 333 when the head unit 314 is in the housed position. The gear mechanism 333 includes: a large diameter gear 333*b* provided integrally with the shaft 331*b* of the pivot arm 32*b* so as to rotate about the same axis as the shaft 331*b;* a gear 333*c* in meshing engagement with the large gear 333*b;* a gear 333*a* in meshing engagement with the gear 333*c;* and a gear 333*d* in meshing engagement with the gear 333*a*. The cap 335 for covering the head unit 314 is provided around the outer periphery of the case 301*a* so as to be slidable with respect to the case 301*a*. A rack 335*a* in meshing engagement with the gear 333*d* of the gear mechanism 333 is formed on inner surface of the cap 335. The gear 333*d* is for converting linear movement of the rack 335*a* into rotational movement and transmits the rotational movement to the gear 333*a*. The gear 333*c* transmits rotation of the gear 333*a* to the large gear 333*b*.

While the head unit 314 is in the printing position as shown in FIG. 32, pushing the cap 335 down will rotate the gear 333*d* in the clockwise direction as viewed in FIG. 32 in association with downward movement of the rack 335*a*. Similarly, the gear 333*a* will rotate in the counterclockwise direction as viewed in FIG. 32. Also, the gear 333*c* in meshing engagement with the gear 333*a* will rotate in the clockwise direction and the large gear 333*b,* which is in meshing engagement with the gear 333*c,* will rotate in the counterclockwise direction. When the gear 333*b* rotates in the counterclockwise direction, then both the shafts 331*b* and the pivot arm 332*b* will rotate in the counterclockwise direction. Because the shafts 331*a,* 331*b* are linked together by meshing engagement between the gear 331*c,* 331*d,* the shaft 331*a* and the pivot arm 332*a* pivot in the clockwise direction symmetrically with the shaft 331*b* and the pivot arm 332*b*. As a result of this pivoting action, the pivot arms 332*a,* 332*b* move the arms 321*a,* 321*b* of the link mechanism 321 in the manner indicated in FIGS. 35 (*a*) through 35 (*g*). Therefore, the holder 319 and head unit 314 move upward into the housed position as shown in FIG. 34 (*b*). In order to move the head unit 314 from the housed position to the printing position, the user moves the cap 335 upward so that the gears of the gear mechanism 333 and the pivot arms 332*a,* 332*b* and the shafts 331*a,* 331*b* rotate in the directions opposite to those described above.

According to the present embodiment, when the cap 335 is moved, then linear movement of the cap 335 is converted into rotational movement by the rack 335*a* and the gear mechanism 333. The rotational movement is transmitted to the shafts 331*a,* 331*b* so that the pivot arms 332*a,* 332*b* pivot in lateral symmetry with each other. The arms 321*a,* 321*b* of the first link mechanism 321 also pivot in lateral symmetry with each other so that the head unit 314 is raised upward and housed in the case 301*a*. With this configuration, the head unit 314 can be freely moved into and out of the case 301*a* without risk that the head unit 314 will be exposed from the case 301*a* by accidental operation while the head unit 314 is in its housed position. Further, the portable printing device 301 has a more compact size when not being used for printing.

Various changes and modifications may be made to the configuration described in the fourth embodiment.

For example, other drive mechanisms can be used for pivoting the pivot arms 332*a,* 332*b* other than the rack 335*a* formed to the cap 335 and the gear mechanism 333. For example, a motor can be provided for rotating the pivot arms 332*a,* 332*b*. The motor can be controlled to drive pivot movement in association with vertical movement of the cap 335. Further, although the embodiment describes the shaft 331*b* of the pivot arm 332*b* being rotated by movement of the cap 335, the shaft 331*a* of the pivot arm 332*a* can be rotated by movement of the cap 335 and the shaft 331*b* of the pivot arm 332*b* as can be designed to rotate in association with rotation of the shaft 331*a*. Further, although the present embodiment describes the print head 312 as the ink jet type print head, other type print heads can be used, such as wire dot print heads.

Figure 12:
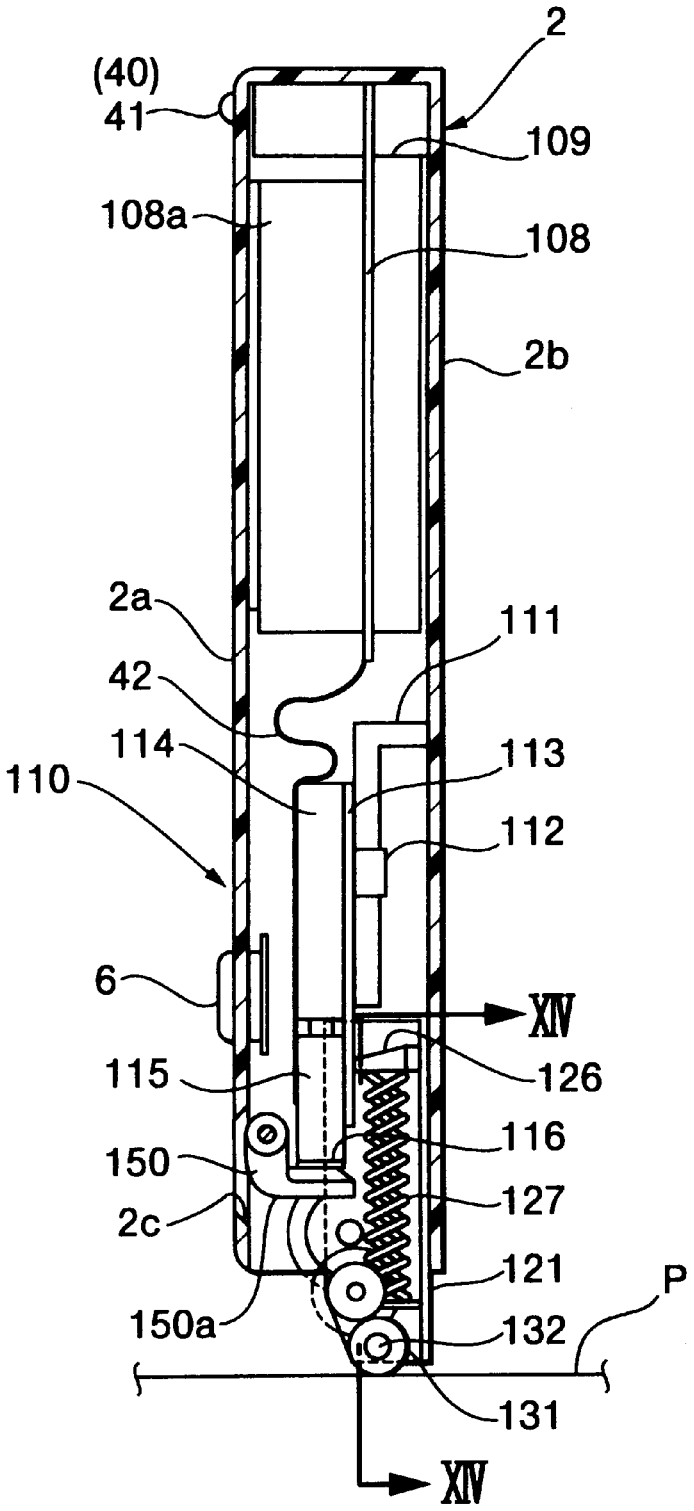
FIG. 12 is a cross-sectional view taken along line XII—XII of FIG. 9 showing the portable printing device of the second embodiment during a non-printing period.

Also, the link mechanisms of the fourth embodiment could be applied to the configurations described in the first through third embodiments and vice versa. For example, a shutter-like cap member, such as the cap member 150 of the first embodiment, could be provided to the configuration of the fourth embodiment. With this configuration, when the head unit 314 moves upward into the housed position as shown in FIG. 34 (*b*), then in the same manner as shown in FIG. 12, the shutter-like cap member is brought into intimate sealing contact with the nozzle plate of the head unit 314, thereby preventing ink of the head unit 314 from drying out. On the other hand, when the head unit 314 is in the printing position as shown in FIG. 34 (*a*), then in the manner shown in FIG. 17, the cap member is retracted to the side of the head unit, so that printing can be performed.

Figure 37:
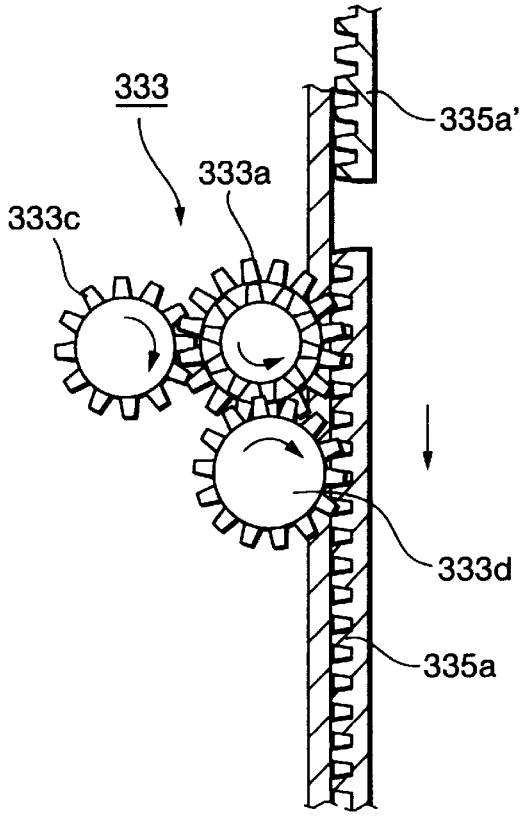
FIG. 37 (*a*)is a side view showing essential portions of a mechanism for capping a print head according to a modification of the fourth embodiment while the print head is in a printing position.
Figure 37:
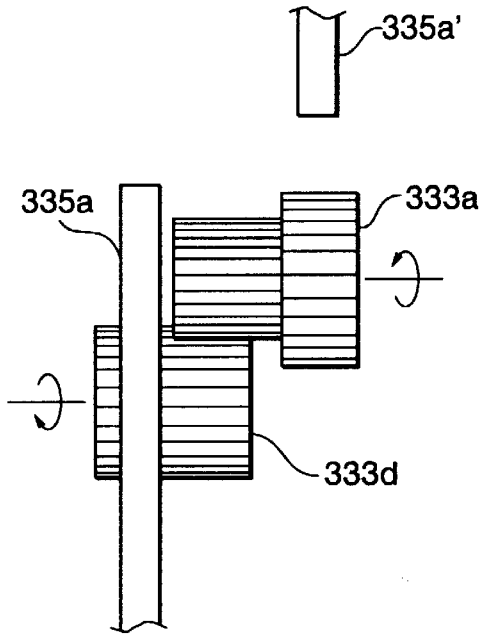
Figure 37:
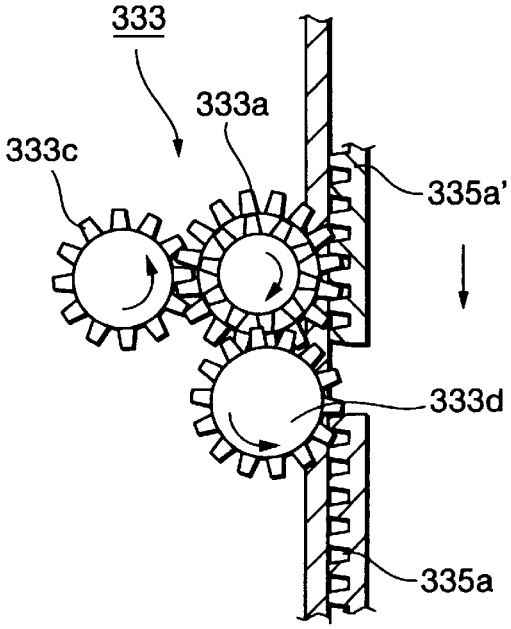
Figure 37:
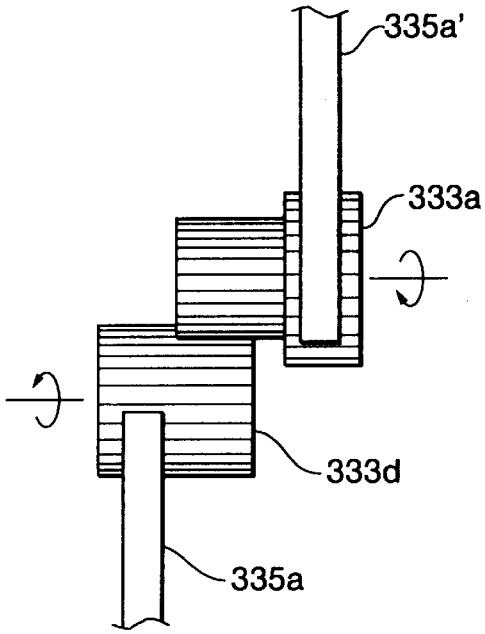

Also, as shown in FIGS. 37 (*a*)through 37 (*d*), a second rack 335*a′* can be provided in order to increase the degree of sealing contact between the print head and the cap member. The second rack 335*a′* is disposed in parallel with and above the rack 335*a*. As best seen in FIGS. 37 (*b*) and 37 (*d*), the second rack 335*a′* is shifted laterally from the rack 335*a*. Because the large-diameter gear of the two-step gear 333*a* is exposed through the side wall of the case 301*a*, the rack 335*a′* is engageable with the large-diameter gear of the two-step gear 333*a* when the cap 335 is moved sufficiently downward.

With this configuration, when the cap 335 is first moved downward, meshing engagement between the rack 335 and the gear 333*d* rotates the gears of the gear mechanism 333 move in the directions described in the fourth embodiment and as indicated by arrows in FIG. 37 (*a*). As a result, the head unit 314 is moved upward into its housed position.

However, as shown in FIGS. 37 (*c*) and 37 (*d*), further downward movement of the cap 335 disengages the rack 335*a* from the gear 333*d* and brings the rack 335*a'* into meshing engagement with the gear 333*a*. As a result, the gears of the gear mechanism 333 will rotate in directions indicated by arrows in FIG. 37 (*c*), thereby lowering the head unit 314 slightly. Because the head unit 314 is lowered slightly in this manner, the nozzle plate of the head unit 314 will be brought into tight sealing contact with the cap member. This effect can be further improved by lengthening the rack 335*a* so that the head unit 314 is first raised to a position higher than its housed position, before it is lowered slightly into the housed position by operation of the second rack 335*a'*.

While the invention has been described in detail with reference to the four embodiments thereof, it would be apparent to those skilled in the art that various changes and modifications may be made therein without departing from the spirit of the invention defined in the appended claims.

What is claimed is:

1. A portable printing device for printing an image on a print medium, the portable printing device comprising:

a case;

an ink jet print unit having a print head with a print surface formed with nozzles for ejecting ink, the print head being switchable between a raised position and a lowered position with respect to the case; and a shutter member having a cap which intimately covers the print surface of the print head when the print head is in said raised position.

2. A portable printing device as claimed in claim 1, further comprising a drive unit which raises the print unit during a non-print period and which lowers the print unit during a print period, the shutter member covering the print unit when the print unit is raised during the non-print period and which retracts away from the print unit when the print unit is lowered during the print period.

3. A portable printing device as claimed in claim 2, wherein the shutter member covers and uncovers the print surface of the print head in linked association with the drive unit raising and lowering the print unit.

4. A portable printing device as claimed in claim 3, wherein the shutter member is supported on the case for movement between a capping position wherein the cap member is in sealing contact with the head surface of the print head and a retracted position wherein the cap member is retracted to a side of the print head, the shutter member moving into said retracted position in association with the print head moving into said lowered position, the shutter member being disposed so that the cap member wipes the print surface of the print head when the shutter member moves into said retracted position.

5. A portable printing device as claimed in claim 2, further comprising a print unit position detection unit which detects when the print unit has been switched into said raised position and which stops drive of the drive unit when said print unit position detection unit detects that the print unit has been switched into said lowered position.

6. A portable printing device as claimed in claim 1, further comprising a print medium detection unit which detects presence of the print medium at a position confronting the print unit, the drive unit lowering the print unit when the print medium detection unit detects presence of the print medium at the position confronting the print unit.

7. A portable printing device as claimed in claim 6, further comprising a print unit position detection unit which detects when the print unit has been switched into said raised position and which stops drive of the drive unit when said print unit position detection unit detects that the print unit has been switched into said lowered position.

8. A portable printing device as claimed in claim 6, further comprising a control unit which supplies print data to the print unit and controls the print unit to print according to the print data, the control unit raising the print unit into said raised position when no print data remains unprinted.

9. A portable printing device for printing an image on a print medium, the portable printing device comprising:

a case having an open portion and a housing portion provided interior to the open portion;

an ink jet print unit having a print head with a print surface formed with nozzles for ejecting ink;

a head position switching mechanism to which the print head is attached, and which switches a position of the print head between a raised position and a lowered position with respect to the case, wherein the print head is in a housed position housed within the housing portion of the case in the raised position, and the print head is in a printing position for performing print operations through the open portion of the case in the lowered position; and a shutter member having a can which intimately covers the print surface of the print head when the print head is in the raised position.

10. A portable printing device as claimed in claim 9, wherein the shutter member includes a cap member brought into sealing contact with the print surface of the print head when the head position switching mechanism switches the print head into said housed position.

11. A portable printing device as claimed in claim 10, further comprising a movement detector including a timing roller provided adjacent to the print head in said printing position, the movement detector detecting relative movement between the print head and the print medium based on rotation of the timing roller against the print medium.

12. A portable printing device as claimed in claim 11, wherein the head position switching mechanism includes:

a slide plate manually slidable between a raised position and a lowered position, the print head being fixed to the slide plate so that the print head is in said housed position when the slide plate is in said raised position and the print head is in said printing position when the slide plate is in said lowered position;

an engagement protrusion provided to the case;

a first engagement portion provided on the slide plate and engageable with the engagement protrusion when the slide plate is in said raised position; and a second engagement portion provided on the slide plate and engageable with the engagement protrusion when the slide plate is in said lowered position.

13. A portable printing device as claimed in claim 10, wherein the shutter member is supported on the case for movement between a capping position wherein the cap member is in sealing contact with the head surface of the print head and a retracted position wherein the cap member is retracted to a side of the print head, the shutter member moving into said retracted position in association with the print head moving into said printing position, the shutter member being disposed so that the cap member wipes the print surface of the print head when the shutter member moves into said retracted position.

14. A portable printing device as claimed in claim 13, flirter comprising an urging means for urging the shutter member into said capping position.

15. A portable printing device as claimed in claim 13, wherein the shutter member includes:

the cap member;

an operation lever integrally formed with the cap member; and a shaft disposed between the cap member and the operation lever, the cap member being pivotable around the shaft between the capping position and the retracted position;

and wherein a cam is disposed on the print unit so as to abut the operation lever and pivot the cap member into the retracted position when the print head moves into said printing position.

16. A portable printing device as claimed in claim 10, wherein the head position switching mechanism includes:

a slide plate manually slidable between a raised position and a lowered position the print head being fixed to the slide plate so that the print head is in said housed position when the slide plate is in said raised position and the print head is in said printing position when the slide plate is in said lowered position;

an engagement protrusion provided to the case;

a first engagement portion provided on the slide plate and engageable with the engagement protrusion when the slide plate is in said raised position; and a second engagement portion provided on the slide and engageable with the engagement protrusion when the plate is in said lowered position.

17. A portable printing device as claimed in claim 16, wherein the head position switching mechanism further includes an urging means for resiliently urging the slide plate into said raised position.

18. A portable printing device as claimed in claim 10, wherein the shutter member includes:

the cap member;

an operation lever integrally formed with the cap member; and a shaft disposed between the operation lever, the cap member being pivotable around the shaft between the capping position;

and wherein a cam is disposed on the print unit to abut the operation lever and pivot the cap member into the retracted position when the print head moves into said printing position.

19. A portable printing device as claimed in claim 9, further comprising a movable frame disposed near the open portion of the case, the movable frame movable between a retracted position, wherein the movable frame is retracted into the case, and a protruding position, wherein the movable frame partially protrudes from the open portion of the case; and wherein the head position switching mechanism switches the print head into said housed position in association with the movable frame moving into said protruding position and into said printing position in association with the movable fame moving into said housed position.

20. A portable printing device as claimed in claim 19, further comprising a movement detector including a timing roller provided adjacent to the print head in said printing position, the movement detector detecting relative movement between the print head and the print medium based on rotation of the timing roller against the print medium.

21. A portable printing device as claimed in claim 19, wherein the shutter member is supported on the case for movement between a capping position wherein the cap member is in sealing contact with the head surface of the print head and a retracted position wherein the cap member is retracted to a side of the print head, the shutter member moving into said retracted position in association with the print head moving into said printing position, the shutter member being disposed so that the cap member wipes the print surface of the print head when the shutter member moves into said retracted position.

22. A portable printing device as claimed in claim 21, further comprising an urging means for urging the shutter member into said capping position.

23. A portable printing device as claimed in claim 21, wherein the shutter member includes:

the cap member; and a shaft around which the cap member is pivotably supported between the capping position and the retracted position.

24. A portable printing device as claimed in claim 23, wherein the shutter member further includes an operation lever integrally provided to the cap member so as to be pivotable around the shaft in association with the cap member and wherein a cam is disposed on the print unit so as to abut the operation lever and pivot the cap member into the retracted position when the print head moves into said printing position.

25. A portable printing device as claimed in claim 19, wherein the head position switching mechanism includes:

a pinion supported rotatably on the case;

a drive rack provided on the movable frame so as to engage with the pinion from one side; and a follower rack provided to the print head so as to engage with the pinion from another side opposite the one side.

26. A portable printing device as claimed in claim 19, wherein the head position switching mechanism includes an urging means that resiliently urges the movable frame into said protrusion position.

27. A portable printing device as claimed in claim 9, wherein the head position switching mechanism includes:

a link mechanism freely swingably supporting the print unit with respect to the case; and a pair of shafts provided to the link mechanism and movable in a separation direction wherein the shafts separate from each other, the print unit moving from the printing position to the housed position by movement of the shafts in the separation direction.

28. A portable printing device as claimed in claim 27, wherein the link mechanism includes crossed arms disposed between confronting surfaces of the case and the print unit, the crossed arms enabling the print head to freely swing with respect to the case.

29. A portable printing device as claimed in claim 28, further comprising a pair of pivotable arms supported so as to rotate in lateral symmetry, the shafts of the link mechanism being freely rotatably supported at tips of the pivotable arms so that when the pivotable arms rotate in lateral symmetry, the shafts separate from each other.

30. A portable printing device as claimed in claim 29, further comprising:

pivot shafts pivotably supporting the pivotable arms with respect to the case; and a pair of gears in mutual meshing engagement and disposed for rotation about the pivot shafts, at least one of the pair of gears being rotatably drivable.

31. A portable printing device as claimed in claim 30, further comprising a cap member freely slidably disposed with respect to the case and including a rack in meshing engagement with the at least one of the pair of gears, the cap member being linked with the arms so that sliding movement of the cap member pivots the arms in association therewith, thereby switching the print unit between its housed position and its printing position.

32. A portable printing device as claimed in claim 27, further comprising a pair of pivotable arms supported so as to rotate in lateral symmetry, the shafts of the link mechanism being freely rotatably supported at tips of the pivotable arms so that when the pivotable arms rotate in lateral symmetry, the shafts separate from each other.

33. A portable printing device as claimed in claim 32, further comprising:

pivot shafts pivotably supporting the pivotable arms with respect to the case; and a pair of gears in mutual meshing engagement and disposed for rotation about the pivot shafts, at least one of the pair of gears being rotatably drivable.

34. A portable printing device as claimed in claim 33, further comprising a cap member freely slidably disposed with respect to the case and including a rack in meshing engagement with the at least one of the pair of gears, the cap member being linked with the arms so that sliding movement of the cap member pivots the arms in association therewith, thereby switching the print unit between said housed position and said printing position.

* * * * *